US012194336B2

(12) United States Patent
Whalen et al.

(10) Patent No.: US 12,194,336 B2
(45) Date of Patent: Jan. 14, 2025

(54) DAP PLATFORM, INTEGRATED LIFTS, SYSTEM AND RELATED DEVICES AND METHODS

(71) Applicants: Boost Treadmills, LLC, Palo Alto, CA (US); Robert Tremaine Whalen, Los Altos, CA (US)

(72) Inventors: Sean Tremaine Whalen, Mountain View, CA (US); Thomas Jack Waldo Allen, Palo Alto, CA (US); Robert Tremaine Whalen, Los Altos, CA (US); Gunnar Manglus, Uniküla (EE); Kristjan Tiimus, Tabasalu (EE); Mart Seger, Tallinn (EE)

(73) Assignee: Boost Treadmills, LLC, Palo Alto, CA (US)

( * ) Notice: Subject to any disclaimer, the term of this patent is extended or adjusted under 35 U.S.C. 154(b) by 0 days.

(21) Appl. No.: 17/964,849

(22) Filed: Oct. 12, 2022

(65) Prior Publication Data

US 2023/0115873 A1 Apr. 13, 2023

Related U.S. Application Data

(60) Provisional application No. 63/254,969, filed on Oct. 12, 2021, provisional application No. 63/254,972, (Continued)

(51) Int. Cl.
*A63B 22/00* (2006.01)
*A63B 21/00* (2006.01)
*A63B 22/02* (2006.01)

(52) U.S. Cl.
CPC .... *A63B 22/0046* (2013.01); *A63B 21/00181* (2013.01); *A63B 22/02* (2013.01); (Continued)

(58) Field of Classification Search
CPC ..... A63B 21/00181; A63B 22/0046; A63B 22/02; A63B 2208/053; A63B 2225/093; (Continued)

(56) References Cited

U.S. PATENT DOCUMENTS 1,504,166 A 8/1924 Thomley
1,292,613 A 12/1966 Macleod
(Continued)

FOREIGN PATENT DOCUMENTS

JP 2002-36064 12/2002
JP 2008538511 10/2008
(Continued)

OTHER PUBLICATIONS

Showa Denki Taiwan, "Showa For Medical With Comfortable Rehabilitation" (Terasu Walker manual), Oct. 16, 2014, Taiwan (see pp. 19-23 of ENG translation).

*Primary Examiner* — Joshua Lee
(74) *Attorney, Agent, or Firm* — Anthony Kandare; Kandare IP, LLC

(57) ABSTRACT

A support platform for retaining a DAP system inflatable enclosure is provided that includes a top cover including a support surface defining a truncated access opening, a bottom cover including a panel, and a plurality of side covers each including a panel, in which the top, bottom and side covers are connected to form an airtight platform defining an interior for retaining an exercise device. A base opening of the enclosure can be secured at a perimeter region of the access opening above the exercise device. The platform further includes an exercise device upper interface for securing the support surface to an upper region of the exercise device, a lower interface for securing a lower region of the exercise device to the bottom cover or ground, and a blower interface for forming an airtight connection with a (Continued)

blower. The truncated access opening limits pneumatic forces secured by the exercise device.

21 Claims, 33 Drawing Sheets

Related U.S. Application Data filed on Oct. 12, 2021, provisional application No. 63/255,001, filed on Oct. 12, 2021.

(52) U.S. Cl.
CPC ... *A63B 2208/053* (2013.01); *A63B 2225/093* (2013.01); *A63B 2225/62* (2013.01)

(58) Field of Classification Search
CPC ..... A63B 2225/20; A63B 2225/50; A63B 2225/62
See application file for complete search history.

(56) References Cited

U.S. PATENT DOCUMENTS 3,292,613 A 12/1966 Macleod
3,335,529 A 8/1967 Gedney
3,353,309 A 11/1967 Kwake
5,112,045 A 5/1992 Mason et al.
5,133,339 A 7/1992 Whalen et al.
5,273,502 A 12/1993 Kelsey et al.
5,372,561 A 12/1994 Lynch
5,398,678 A 3/1995 Gamow
5,626,540 A 5/1997 Hall
5,667,461 A 9/1997 Hall
5,688,225 A 11/1997 Walker
5,860,857 A 1/1999 Wasastjerna et al.
6,174,268 B1 1/2001 Novak
6,689,075 B2 2/2004 West
7,544,172 B2 6/2009 Sanlos-Munne et al.
7,591,795 B2 * 9/2009 Whalen ..... A63B 22/02 600/19
7,883,450 B2 2/2011 Hidler
8,235,724 B2 8/2012 Gilley et al.
8,464,716 B2 * 6/2013 Kuehne ..... A63B 21/068 601/19
8,762,167 B2 6/2014 Blander et al.
8,840,572 B2 * 9/2014 Whalen ..... A61G 10/023 601/6
8,900,098 B2 * 12/2014 Egan ..... A63B 24/0087 482/4
9,087,454 B2 7/2015 Crivello et al.
9,272,175 B2 * 3/2016 Egan ..... A63B 21/00181
9,642,764 B2 * 5/2017 Kuehne ..... A61H 1/00
9,672,754 B2 6/2017 Yuen
10,004,656 B2 * 6/2018 Whalen ..... A63B 22/02
10,219,734 B2 * 3/2019 Williams ..... A62B 31/00
10,307,653 B2 6/2019 Ebsen
10,843,036 B2 * 11/2020 Bayerlein ..... A63B 22/025
11,097,175 B2 8/2021 Rodriguez
11,517,781 B1 * 12/2022 Whalen ..... A61G 10/023
D976,341 S 1/2023 Whalen
D976,342 S 1/2023 Whalen
D976,344 S 1/2023 Whalen
11,559,720 B2 * 1/2023 Bayerlein ..... A63B 69/0064
D976,340 S 10/2023 Whalen
11,794,051 B1 10/2023 Whalen
11,883,713 B2 1/2024 Whalen
2002/0022554 A1 2/2002 Borsheim
2002/0025889 A1 * 2/2002 Egger ..... A63B 22/0605 482/57
2002/0065173 A1 5/2002 Cook
2003/0046113 A1 3/2003 Johnson et al.
2003/0153438 A1 8/2003 Gordon
2004/0016043 A1 1/2004 Uno et al.
2004/0019304 A1 1/2004 West
2004/0249675 A1 12/2004 Stark et al.
2004/0259689 A1 12/2004 Wilkins
2005/0239613 A1 10/2005 Colombo
2006/0052728 A1 3/2006 Kerrigan
2006/0240947 A1 10/2006 Qu
2007/0054783 A1 * 3/2007 Egger ..... A61H 1/0237 601/1
2008/0070757 A1 3/2008 Albert
2009/0047644 A1 2/2009 Mensah et al.
2009/0082700 A1 3/2009 Whalen et al.
2010/0000547 A1 1/2010 Johnson et al.
2010/0006737 A1 1/2010 Colombo et al.
2010/0170546 A1 7/2010 Popovic et al.
2011/0098615 A1 4/2011 Whalen et al.
2011/0120567 A1 5/2011 Kuehne et al.
2011/0312473 A1 12/2011 Chu
2012/0029666 A1 2/2012 Crowley et al.
2012/0238921 A1 * 9/2012 Kuehne ..... A63B 71/0009 601/5
2012/0277643 A1 11/2012 Whalen et al.
2012/0302301 A1 11/2012 Homsi
2013/0117908 A1 5/2013 Dyson
2013/0325491 A1 12/2013 Ferrari
2014/0026893 A1 1/2014 Johnson et al.
2014/0058312 A1 2/2014 Ziehler et al.
2014/0113775 A1 4/2014 Egan
2014/0194252 A1 * 7/2014 Arimoto ..... A63B 23/04 482/51
2015/0011917 A1 1/2015 Whalen et al.
2016/0242993 A1 8/2016 Whalen et al.
2017/0014295 A1 1/2017 Whalen et al.
2017/0128769 A1 * 5/2017 Long ..... H04L 67/10
2017/0367916 A1 * 12/2017 Kuehne ..... A63B 21/00181
2019/0046828 A1 2/2019 Kuehne et al.
2019/0099315 A1 4/2019 Kuehne
2019/0099320 A1 4/2019 Whalen et al.
2019/0392939 A1 * 12/2019 Basta ..... G16H 20/30
2020/0221975 A1 * 7/2020 Basta ..... A61B 5/112
2020/0384309 A1 12/2020 Long et al.
2021/0187348 A1 * 6/2021 Phillips ..... A63B 22/025
2021/0196552 A1 7/2021 Whalen et al.
2021/0205165 A1 7/2021 Kuehne
2021/0251841 A1 8/2021 Whalen et al.
2021/0267833 A1 9/2021 Kuehne
2022/0054893 A1 2/2022 Basta et al.
2022/0059198 A1 2/2022 Basta
2022/0401782 A1 12/2022 Whalen
2023/0058141 A1 2/2023 Long et al.
2023/0109901 A1 4/2023 Whalen
2023/0263695 A1 8/2023 Whalen et al.
2024/0082630 A1 3/2024 Phillips et al.

FOREIGN PATENT DOCUMENTS

JP D1395000 8/2010
JP 1421980 8/2011
JP 2012214936 11/2012
TW 425592 7/2005
TW I235427 7/2005

* cited by examiner

DAP PLATFORM, INTEGRATED LIFTS, SYSTEM AND RELATED DEVICES AND METHODS

CROSS-REFERENCES TO RELATED APPLICATIONS

This application is related to U.S. patent application Ser. No. 17/351,236 filed on Jun. 18, 2021, entitled "Unweighting Exercise Equipment", which is a continuation of U.S. patent application Ser. No. 16/016,340 filed on Jun. 22, 2018, entitled "Unweighting Exercise Equipment", which claims priority to U.S. provisional patent application No. 62/523,363 filed on Jun. 22, 2017.

This application is also related to U.S. nonprovisional patent application Ser. No. 17/688,890 filed on Mar. 7, 2022, entitled "DAP System Adjustments Via Flexible Restraints and Related Devices, Systems and Methods," which claims priority to U.S. provisional patent No. 63/159,697 filed Mar. 6, 2021, entitled, "DAP System Adjustments Via Flexible Restraints and Related Devices, Systems and Methods." This application is further related to U.S. nonprovisional patent application Ser. No. 17/540,225, filed on Dec. 1, 2021, entitled "Unweighting Enclosure, System and Method for an Exercise Device."

Further, this application is related to the following U.S. nonprovisional patent applications filed on even date herewith as follows:

- U.S. patent application Ser. No. 17/964,851 entitled "DAP System Control and Related Devices and Methods-filed on Oct. 12, 2022, now U.S. Pat. No. 11,872,433; and
- U.S. patent application Ser. No. 17/965,517 entitled "Height-Adjustable Seal Frame Structure for DAP Exercise System."

In addition, this application is related to the following U.S. provisional patent applications:

- U.S. app. No. 63/254,969 filed on Oct. 12, 2021, entitled "DAP System, Platform, Integrated Lifts and Related Devices and Methods";
- U.S. app. No. 63/254,972 filed on Oct. 12, 2021, entitled "DAP System, Enclosure, Seal Frame and Related Devices and Methods"; and
- U.S. app. No. 63/255,001 filed on Oct. 12, 2021, entitled "DAP System, Enclosure, Controls and Related Devices and Methods".

Each of the above applications is hereby specifically incorporated by reference in its entirety.

BACKGROUND

Aspects, features, and concepts described herein relate to supplemental equipment for exercise and rehabilitation devices, and particularly to equipment known as unweighting, antigravity, or differential air pressure (DAP) systems, devices and method, as well as to related devices, systems and methods for use with DAP systems and devices.

Systems for unweighting individuals for rehabilitation and fitness training have been a popular modality. Traditional methods have included aquatic training and using a hoist to lift a person or animal off a walking surface. Harness and hoist systems provide benefits related to their historical use in that they are well-known and can also allow for precise and granular unweighting, but become significantly uncomfortable at off-loading greater than about 25% of normal body weight. Further, aquatic systems can be difficult to control in terms of degree of off-loading, and are cumbersome to use along with having large space and resource requirements.

Systems that create a pressure differential can vary pressure differentials more precisely and are easier to use allowing for a wide range of unloading in small steps. One benefit of this is in the case of rehabilitation, for which it has been shown that increments as small as 1% of normal body weight can effectively determine and bypass a pain threshold below which a user can exercise pain free. More recently, systems creating a pressure differential across a portion of a user have been developed and are generally in commercial use in the rehabilitation and training centers around the world. These systems apply a pressure difference at a portion of the user's body with a net force at the center of pressure. If the net pressure differential is oriented parallel with the force of gravity and located near the user's waist, this off-loading force acts approximately directly counter to the force of gravity and therefore minimally alters the users natural gait patterns.

DAP systems have been commercialized by companies like Showa Denki in Japan, Sasta Fitness of the UK, Vacuwell of Poland. and AlterG Inc. in the US. While these systems offer benefits, they are expensive, large, non-adjustable, require specialized power sources, or are generally limited in access to the market because of the high cost and space burden, or general discomfort in design for users of different body types or heights.

Conventional DAP systems rely on the use of a shell placed around an existing treadmill or similar exercise device. A completely separate chamber is formed that encompasses a base portion of the exercise equipment including the running belt/rollers/deck of a treadmill or the seat and pedals of a stationary bicycle placed inside. These structures duplicate the framing of the combined system and therefore increase the cost, size, shipping bulk, part count, and overall complexity of the system. Further, such conventional DAP systems limit user adjustment of the corresponding exercise device including modifying incline or tilt settings, which impact the pressure differential of conventional DAP systems.

In addition, conventional DAP systems develop substantial vertical and lateral forces in the thousands of pounds in the DAP chamber during use due to conventional unweighting designs exposing large surface areas to unweighting pressures. These systems include supplemental reinforcements and structural additions for the corresponding exercise equipment, which typically is not designed to accommodate such extreme external loading. The elevated forces developed by such conventional systems include outboard expansion forces exerting lateral forces and upward/downward expansion forces applying vertical loads against nearby components of the exercise equipment or applying torque to the framing that may impact lifetime and function of the exercise equipment. Further, even though safety mechanisms and system can reduce and mitigate risks of failure and user injury in conventional DAP systems within low probability ranges, the extreme forces involved, and potential harms inflicted in the event of failure nonetheless amount to significant design risk.

Conventional DAP Systems rely on reinforced, heavy duty support structures and cage-like arrangements for ensuring safety and counteracting high system forces during use. These support structures encroach of the user's freedom of movement for many ranges of motions including arm swing movements and potential weaving or sway running movements of many users, which limit the user and increase risk of injury for unintentional contact with the rigid structures. Further, conventional rigid support platforms have multiple connections with support bars, rods and other structures that generate various vibrations, squeaks and other noises during use, and further induce harmonics among DAP components. These noises create annoying conditions for their use, which can inhibit their usage. Further, vibrations and other regular movements along and within components of conventional DAP systems can degrade system integrity and increase maintenance needs and costs.

Thus, needs exist for overcoming various drawbacks and limitations of conventional DAP systems including reducing size and complexity of DAP support structures along with improving system performance during use.

SUMMARY

This summary introduces certain aspects of the embodiments described herein to provide a basic understanding. This summary is not an extensive overview of the inventive subject matter, and it is not intended to identify key or critical elements or to delineate the scope of the inventive subject matter.

According to aspects and features of inventive subject matter described herein, a support platform configured for use with a differential air pressure (DAP) exercise system for retaining an inflatable enclosure thereof over a treadmill during use includes a top cover having a support surface, in which the top cover has a maximum length and a maximum width, and a truncated access opening defined through an inner portion of the support surface, in which the support surface is configured for secure attachment to an upper portion of the treadmill proximate a perimeter region of the access opening and a perimeter length of the truncated access opening is less than two times the maximum length plus two times the maximum width. The platform can further include a bottom cover that includes a panel, and a plurality of side covers that each include a panel, in which the top cover, the bottom cover and the plurality of side covers are connected to each to form a substantially airtight platform defining an interior cavity for retaining therein an exercise device for the DAP system. The platform can also include an exercise device upper interface for securing an upper region of the exercise device to the support surface in an airtight connection, and a blower interface configured for forming an operative, airtight connection with a blower.

In some implementations, the support surface of the top panel can have a plurality of reinforced side regions that each form an integrated beam, and the panel of the bottom cover can likewise have a plurality of reinforced side regions each forming an integrated beam. Each panel of the plurality of side cover can have an upper reinforced side region forming an integrated beam, in which an attachment face of the integrated beam can be secured to an adjacent top cover attachment face along at least a portion of one of the reinforced side regions of the top cover, and a lower reinforced side region forming an integrated beam, in which an attachment face of the integrated beam can be secured to an adjacent bottom cover attachment face along at least a portion of one of the reinforced side regions of the bottom cover. Each side cover can further include a first lateral side region, and a second lateral side region opposite the first lateral side region. The platform can further include a plurality of brackets disposed along a perimeter region of each of the top cover and the bottom cover and forming at least one integrated column supporting the top cover at a vertical offset above the bottom cover, in which each bracket can be secured at a lower end region to the bottom cover along at least a portion of one of the plurality of bottom cover reinforced side regions, and secured to the top cover at an upper region opposite the lower region along at least a portion of one the plurality of top cover reinforced side regions. The top, bottom and side covers can form a substantially frameless platform for supporting the enclosure above the exercise device during use of the dap system.

In some implementations, a damping gap can be defined between mating pairs of the attachment faces, and a gasket can be formed from a flat, compressible material disposed between each mated pair of the attachment faces for preventing direct contact between mated attachment faces and damping vibrations therebetween. The platform can further include a plurality of fastener-collar sets securing each mated pair of the attachment faces and fixing a minimum compressible distance between the attachment faces. In some implementations, the platform can include a plurality of substantially hollow crossbeams attached to and extending across a width of the bottom cover.

In some implementations, the plurality of brackets can include a plurality of corner brackets each disposed proximate a corner formed between intersecting edge portions of each of the top cover and the bottom cover. The platform can include a pair of mated angled surfaces formed along mating vertical edge portions of each pair of side covers meeting at each one of the corners, and the mated angled surfaces can be spaced apart from each other without direct contact between the mating vertical edge portions. In some implementations, the plurality of brackets can include a pair of vertical lift brackets attached to opposite lengthwise side portions of the platform and to each of the top cover and the bottom cover at a middle portion of an opposite lengthwise pair of each of the plurality of reinforced side regions. Each vertical lift bracket can be attached to an adjacent reinforced side region of each of the top and bottom covers and to a first or second lateral side region of adjacent ones of the side covers, and can reinforce the support platform along its length. Each vertical lift bracket can be formed from a thin sheet and can include a pair of vertically oriented, parallel angle supports spaced apart from each other and opposing each other, in which the pair of angle supports can be arranged for reinforcing a corresponding vertical lift attached to each one of the vertical lift brackets in a vertical orientation. Each vertical lift bracket can further include a bottom flange formed from the thin sheet configured to attach to a bottom of a corresponding one of the vertical lifts.

In some implementations, the platform can further include a pair of vertical pillars integrated with the platform, such that each vertical pillar is attached to a corresponding one of the vertical lift brackets for providing a support structure for the corresponding vertical lift. In some arrangements, each vertical pillar can include an extruded pillar having a pair of outboard columns extending along a height of each pillar, and each outboard column can be attached to the corresponding vertical lift bracket. The platform can further include a unitary handle attached to a top end of each of the extruded pillars and connecting the pair of pillars to each other at the top ends.

In some implementations, for at least one of the top cover, the bottom cover, and the plurality of side covers, at least one integrated beam of the plurality of reinforced edge regions can include a C-channel formed within the corresponding panel along at least one reinforced side region. The C-channel can be mated with: a C-channel formed within the corresponding panel along at least one reinforced side region; a reinforcing member configured as an opposing C-channel; a multi-faceted, substantially hollow structure formed along at least one reinforced side region defining a closed shape; and a columnar reinforcement defined along at least one edge portion of an extruded panel. In some implementations, each of the side covers can be configured for independent removal from and attachment to the platform, and the interior cavity and the exercise device can be accessible through an exposed opening corresponding with removal each side cover.

In some implementations, each of the plurality of side covers can be attached to the top cover in one of a stacked beam arrangement and a parallel beam arrangement. For the stacked beam arrangement, the attachment face of the upper reinforced side region and the adjacent attachment face secured thereto of the top cover can be oriented substantially parallel with a top surface region of the top cover, and each attachment face can be offset and vertically lower than the top surface region, such that the integrated beam of the upper reinforced side region can be located under the attached, adjacent integrated beam of the top cover. For the parallel beam arrangement, the attachment face of the upper reinforced side region and the adjacent attachment face secured thereto of the top cover can be oriented substantially perpendicular with a top surface region of the top cover, and the integrated beam of the upper reinforced side region can be located alongside the attached, adjacent integrated beam of the top cover.

In some implementations, the exercise device includes a pair of frame structures including a left frame structure and a right frame structure, and the exercise device upper interface includes a plurality of left fasteners and a plurality of right fasteners, in which each of the left fasteners are configured to secure an upper region of the left frame structure to the support surface along a left portion of the access opening perimeter region, and each of the right fasteners are configured to secure an upper region of the right frame structure to the support surface along a right portion of the access opening perimeter region. Further, the exercise device lower interface can include a plurality of left bottom connectors and a plurality of right bottom connectors, in which each of the left bottom connectors are configured to connect a lower region of the left frame structure to one of the bottom cover and the ground, and each of the right bottom connectors are configured to connect a lower region of the right frame structure to one of the bottom cover and the ground, and further include a plurality of ground supports each configured to extend from the bottom cover to the ground in alignment with a corresponding one of the left bottom connectors and the right bottom connectors connecting to the bottom cover for extending support for the left and right frame structures through the bottom cover and directly to the ground.

In some implementations, the support platform can further include a plurality of pass-through openings defined through the bottom cover that are each arranged for passing one of the left and right bottom connectors not connected to the bottom cover through the bottom cover directly to the ground and thereby enable optional height adjustments for the exercise device with respect to the ground and the platform. In some implementations, the exercise device can include a treadmill, the left frame structure and the right frame structure can each extend parallel to each other in a longitudinal direction of the treadmill along opposite lateral regions of the treadmill, and the left and right frame structures can secure corresponding left and right portions of the perimeter region along the truncated access opening during use by exerting, proximate the perimeter region, reaction forces substantially equal in magnitude and opposite in direction to upward forces transmitted by the enclosure base to the support surface of the top cover.

In some implementations, the upper region of each of the left frame structure and the right frame structure form a left upper flange and a right upper flange respectively, in which each of the left and right upper flanges have a top, substantially horizontal, flange surface, and the lower region of each of the left frame structure and the right frame structure form a left lower flange and a right lower flange respectively. The left wall can connect the left upper flange to the left lower flange and define a left channel-shaped frame structure, and a right wall can connect the right upper flange to the right lower flange and define a right channel-shaped frame structure. The pair of left and right channel-shaped frame structures can form a pair of parallel, channel-shaped frame structures, each having a top, substantially horizontal, flange surface that is substantially coplanar with the other. The set of upper flanges of the pair of channel-shaped frame structures together can form a parallel, longitudinally oriented pair of support tracks for the treadmill disposed proximate and below the top cover support surface and extending lengthwise along opposite, left and right portions of the perimeter region of the truncated access opening. Further, the pair of support tracks can be secured at multiple locations to the top cover support surface along the opposite left and right portions of the perimeter region of the truncated access opening.

In some implementations, a left lift can be attached to a left side of the platform along a longitudinal midregion of the platform, in which the left lift is securely attached to a left side region of the top cover and to a left side region of the bottom cover at a bottom region of the lift, so that the left lift extends vertically upward from the bottom region. The platform can further include a right lift attached to a right side of the platform along a longitudinal midregion of the platform, in which the right lift is securely attached to a right side region of the top cover and to a right side region of the bottom cover at a bottom region of the lift, such that the lift extends vertically upward from the bottom region. The platform can also include a transverse bridge member extending horizontally between a vertically movable carriage attached to the left lift and a vertically movable carriage attached to the right lift, in which the transverse bridge member restrains each carriage at a horizontal, transverse distance across a depth of the DAP system for a range of vertical heights of the carriages. The pair of lifts having vertically movable carriages and the transverse bridge member can form a hybrid transverse framework across the DAP system configured for opposing at the bottom region of each lift and the opposite side regions of the platform outward torques exerted on the platform by the base of the enclosure during use of the DAP system.

According to aspects and features of inventive subject matter described herein, a differential air pressure (DAP) System can include an exercise device including a treadmill having a pair of frame structures extending in a longitudinal direction of the treadmill along opposite lateral regions, an inflatable enclosure having a base defining a base opening, in which the enclosure extends upward from the base to a top opening defined therein, and a support platform. The support platform can include a top panel having a plurality of reinforced side regions that each form an integrated beam and further defines a truncated access opening through the top cover, in which the enclosure base opening is secured at the top side of the top cover proximate a perimeter of the access opening. The platform can further include a bottom cover that includes a panel having a plurality of reinforced side regions, in which each reinforced side region forms an integrated beam, and a plurality of side covers that can each include a panel. Each side cover panel can have an upper reinforced side region forming an integrated beam, in which an attachment face of the integrated beam can be secured to an adjacent top cover attachment face along at least a portion of one of the reinforced side regions of the top cover, and a lower reinforced side region forming an integrated beam, in which an attachment face of the integrated beam can be secured to an adjacent bottom cover attachment face along at least a portion of one of the reinforced side regions of the bottom cover. Each side cover can further include a first lateral side region, and a second lateral side region opposite the first lateral side region. The platform can further include a plurality of brackets disposed along a perimeter region of each of the top cover and the bottom cover and forming at least one integrated column supporting the top cover at a vertical offset above the bottom cover, in which each bracket can be secured at a lower end region to the bottom cover along at least a portion of one of the plurality of bottom cover reinforced side regions, and secured to the top cover at an upper region opposite the lower region along at least a portion of one the plurality of top cover reinforced side regions. In addition, the platform can include an inner frame structure secured at an upper region to the top cover in proximity to the access opening perimeter and secured at a lower region to the bottom cover.

The pair of treadmill frame structures can be secured to and integrated with the platform inner frame structure, such that each frame structure of the pair of frame structures can be secured to the top cover proximate the truncated access opening perimeter and to the lower cover as part of the inner frame structure. As such, the support platform can exert reaction forces and torques substantially equal in magnitude and in opposite directions to upward forces transmitted by the enclosure base and torques imparted by the upward forces during use of the dap system, and the treadmill pair of frame supports integrated with the platform inner frame structure can substantially receive and counteract for the platform rotational torques imparted by the upward forces in a generally longitudinal direction of the DAP system.

In some arrangements according to aspects and features described herein, the DAP System can further include a hybrid framework configured for substantially counteracting for the platform rotational torques imparted by the upward forces in a generally transverse direction of the DAP System. The hybrid framework can include a pair of vertical lifts integrally attached to opposite sides of the platform along a mid-region of the platform in the longitudinal direction of the DAP System disposed proximate the enclosure top opening. Each vertical lift can be structurally attached at a base portion to one of the plurality of reinforced side regions of the top cover and to one of the plurality of reinforced side regions of the bottom cover, and each vertical lift can have a vertically drivable carriage attached thereto. The hybrid framework can further include a bridge member having a pair of lateral connectors, in which each lateral connector can be disposed at an opposite lateral side region of the bridge member and secured to a carriage of a corresponding one of the vertical lifts. The bridge member can restrain each carriage of the pair of lifts at a transverse distance between the carriages along a range of vertical heights for each carriage when located at a raised end portion of each lift opposite the base portion. The hybrid framework can further include a DAP System controller operatively connected to the pair of lifts configured for vertically driving each carriage to a vertical height within the range of vertical heights for DAP System operations for which the inflated enclosure is in an inflated condition. As such, the bridge member can restrain the pair of vertical lifts at a transverse distance therebetween along the raised end portion of each lift when the enclosure is in the inflated condition, and the restrained pair of vertical lifts can substantially counteract for the platform rotational torques imparted by the upward forces in the generally transverse direction of the DAP System.

Other exercise-related support devices, related systems, and components, and/or methods according to embodiments will be or become apparent to one with skill in the art upon review of the following drawings and detailed description. It is intended that all such additional devices, related components, systems, and/or methods included within this description be within the scope of this disclosure.

DETAILED DESCRIPTION

Figure 1:
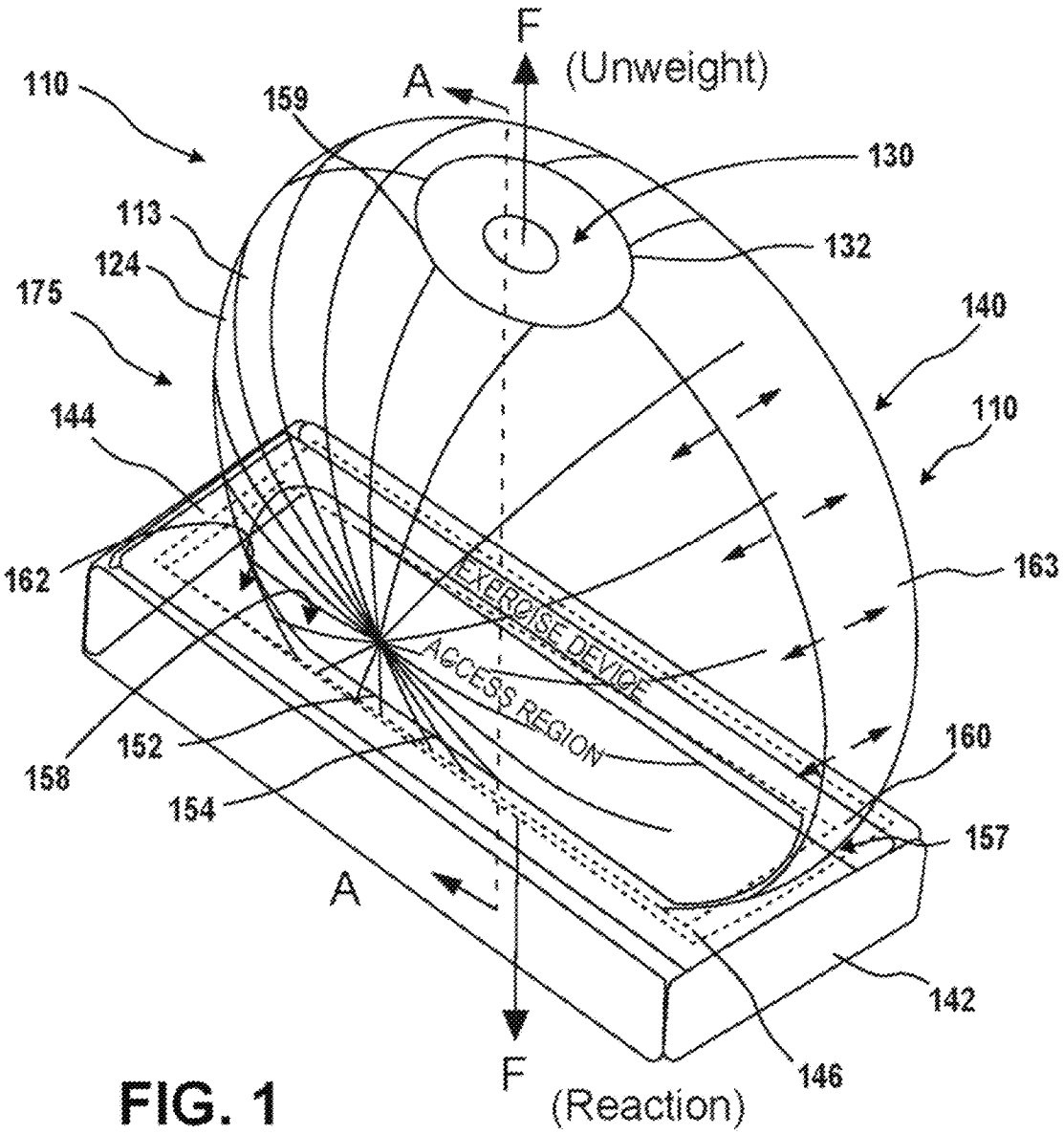
FIG. 1 is a top perspective view of a schematic representation of a platform in use with an independently supportable inflatable enclosure and an exercise device of an example DAP System according to inventive aspects, features and concepts described herein.

For the purposes of promoting an understanding of the aspects, features and principles pertaining to the invention and configurations discussed herein, reference will now be made to the example configurations and arrangements illustrated in the drawings along with language describing the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one arrangement," "an arrangement." or similar language means that a particular feature, structure, or characteristic described in connection with the arrangement is included in at least one arrangement of the present invention. Thus, appearances of the phrases "one arrangement," "an arrangement," and similar language throughout this specification may, but do not necessarily, all refer to the same arrangement, different arrangements, or component parts of the same or different illustrated invention. Additionally, reference to the wording "an arrangement," or the like, for two or more features, elements, etc. does not mean that the features are related, dissimilar, the same, etc. The use of the term "an arrangement," or similar wording, is merely a convenient phrase to indicate optional features, which may or may not be part of the invention as claimed.

Each statement of an arrangement is to be considered independent of any other statement of an arrangement despite any use of similar or identical language characterizing each arrangement. Therefore, where one arrangement is identified as "another arrangement," the identified arrangement is independent of any other embodiments characterized by the language "another arrangement." The independent embodiments are considered to be able to be combined in whole or in part one with another as the claims and/or art may direct, either directly or indirectly, implicitly, or explicitly. Although the wording "an arrangement," or the like, does not appear at the beginning of every sentence in the specification, such as is the practice of some practitioners, is merely a convenience for the reader's clarity.

References for "herein" or similar terminology including "used herein," "shown herein" or "discussed herein" are understood to mean the instant patent application, as well as all related patent applications incorporated by reference and/or identified in the present application. Further, the same references and the like are understood to include later filed patent applications including provisional or non-provisional patent applications that denote, identify or incorporate by reference the instant patent application.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

As used herein, the term "about" when used in connection with a referenced numeric indication means the referenced numeric indication plus or minus up to 10 percent of that referenced numeric indication. For example, the language "about 50" covers the range of 45 to 55. Similarly, the language "about 5" covers the range of 4.5 to 5.5.

As used in this specification and the appended claims, the words "top," "above," and "upward" refer to elevation directions away from the ground level of an exercise device in its typical or intended usage orientation at or towards a higher elevation, and the words "bottom," "below," "base" and "downward" refer to elevation directions at or towards the ground level of an exercise device at a lower elevation in its typical usage orientation. Thus, for example, the top of a structure for an exercise device that is farthest from the ground level of the exercise device would be the vertical distal end of the structure, and the end opposite the vertical distal end (i.e., the end interfacing with the exercise device closest to ground level) would be the vertical base or bottom end of the structure.

Further, specific words chosen to describe one or more embodiments and optional elements, or features are not intended to limit the invention. For example, spatially relative terms—such as "beneath," "below." "lower," "above," "upper," "proximal," "distal," and the like—may be used to describe the relationship of one element or feature to another element or feature as illustrated in the figures. These spatially relative terms are intended to encompass different positions (i.e., translational placements) and orientations (i.e., rotational placements) of a device in use or operation in addition to the position and orientation shown in the figures. For example, if a device in the figures were turned over, elements described as "below", or "beneath" other elements or features would then be "above" or "over" the other elements or features. Thus, the term "below" can encompass both positions and orientations of above and below. A device may be otherwise oriented (e.g., rotated 90 degrees or at other orientations) and the spatially relative descriptors used herein interpreted accordingly. Likewise, descriptions of movement along (translation) and around (rotation) various axes include various spatial device positions and orientations.

Similarly, geometric terms, such as "parallel," "perpendicular," "round," "curvilinear," "articulated" or "square," are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

In addition, the singular forms "a," "an," and "the" are intended to include the plural forms as well, unless the context indicates otherwise. The terms "comprises," "includes," "has," and the like specify the presence of stated features, steps, operations, elements, components, etc., but do not preclude the presence or addition of one or more other features, steps, operations, elements, components, or groups.

Unless indicated otherwise, the terms exercise apparatus, device, equipment, systems, and variants thereof, can be interchangeably used.

In this specification, the applicant may refer to an exercise machine and an existing exercise machine. The reader shall note that the distinction is that an existing exercise machine may already be designed prior to consideration for use of the same with a DAP system and an existing exercise machine may further already be installed in the field, for example in a gym, training facility, etc. The reader shall interpret minor modifications of the exercise machine or existing exercise machine for use with a DAP system as still part of the exercise machine and still within the spirit of the scope of the subject matter disclosed. Further, although many examples related to a DAP System or example DAP System are shown and discussed along with example treadmill exercise devices or equipment, it is understood that the application and invention are not so limited and various other types of exercise devices or equipment could replace the example treadmill devices or equipment.

As used herein, an "independently-supportable" inflatable enclosure refers to an inflatable enclosure formed from a substantially inelastic material defining a base opening configured to be secured to a base support, configured to form an airtight connection with an air supply, and defining a top port configured to form an airtight connection with a user interface such that, when inflated, secured to the air supply, and forming an airtight connection with a user, the inflatable enclosure is capable of independently extending in an upward direction from the base support and providing unweighting forces on the user without requiring a support framework or other attachments or connections to support members regardless of whether the inflatable enclosure makes contact with a supplemental support member. As such, an independently supportable inflatable enclosure forms a hollow, thin-shelled inflatable support enclosure extending from the secure attachment with the base support upward to the top port and user interface.

Example Platform with Truncated Access Opening with Enclosure & DAP System

Referring now to FIG. 1, a schematic representation of functional components of a differential air pressure (DAP) system 140 is shown, with which inventive aspects and features of platforms described herein can be incorporated and used as part of DAP system including arrangements having low-hoop stress inflatable enclosures as described in related patent applications identified above and incorporated herein by reference, as well as with other inflatable enclosure arrangements. FIG. 1 depicts a DAP system 140 that includes an inflatable enclosure 110 attached to a support platform 142 within which an exercise device is 160 is located and retained below the enclosure. During use when the enclosure 110 is in the inflated condition, upward forces applied to a user by the inflatable enclosure can offset portions of the user's weight while providing user access to the exercise device via an access region formed through the enclosure 110 and platform 142.

The platform 142 acts as a central support structure and interface between the enclosure 110 and exercise device 160, for which aspects and features of lightweight, high strength, platforms described herein can enhance functionally and structural features. For example, platform 142 can include a top cover having a support surface 144 that defines a truncated access opening 149 for enabling user interactions with a top region of the exercise device that the user can engage with while supported by the inflatable enclosure 110 along with truncating the access opening to limit the size and volume of the inflatable enclosure along with unnecessary pneumatic forces. In contrast, conventional DAP system platforms securely attach inflatable enclosures along an external, lateral framework extending around an exercise device used with the DAP system, such as frame elements around side portions of a treadmill, without having a top cover or support surface disposed over the exercise device that defines a truncated access opening 149 for enabling user interactions with the exercise device. The truncated access opening and corresponding truncated base opening for the enclosure can provide a streamlined, efficient enclosure shape and arrangement with respect to a truncated access opening that is appropriate for DAP system functionality including upweighting support for a user, but that involves lower pneumatic forces overall vs. platforms and arrangements lacking top covers or support surfaces.

With continued reference to FIG. 1, inflatable enclosure 110 is generally shown in an inflated condition operating as part of the DAP system 140, in which a base opening 154 at a base 152 of inflatable enclosure 110 is securely attached to the top cover support surface 144 of platform 142 about a truncated access opening 149 defined through the support surface, which provides airtight communication with an inflation device (not shown). An exercise device 160 is located within the platform 142 below the enclosure base opening 154 and access opening 149, which can include a treadmill. Platform 142 operatively secures the base 152 and base opening 154 of the inflatable enclosure 110 over the exercise device 160 and in alignment with the truncated access opening 149 during use for providing unweighting support to the user along with user access to the exercise device while in the inflated condition, which efficiently limits and streamlines a shape and arrangement for the truncated access opening and for the corresponding inflatable enclosure base opening and thereby overall enclosure shape and volume.

The support surface 144 is firmly attach or secured to the base of the inflatable enclosure in an airtight connection and can permit independent support of the enclosure when inflated as it extends upward from base 152 in a substantially vertical direction for supporting the user above the access region 162, which can cooperate with and be enhanced by innovative aspects and features of low hoop stress inflatable enclosures described herein and in greater detail in related patent applications described above and incorporated herein by reference. Further, as described in greater detail below along with FIG. 9 for example platform 2040, access opening 149 defined through the support surface 144 of platform 140 can be formed as a truncated access opening having a reduced or limited shape and access area versus a vertical shape and access area available for the exercise device and top cover or support surface of the platform independent and apart from the exercise device. As such, platform 140 in combination with enclosure 110 can involve lower pneumatic volumes and applications of upward forces during use than conventional DAP systems, along with lower forces being transmitted to the platform area.

As further shown in FIG. 1, the DAP system including the enclosure 110 and the platform 142 can be shaped and arranged for use with a treadmill as the exercise device, in which the platform can include exercise device interfaces (not shown) for attaching the platform to a framework of the treadmill such that applied forces and moments in a longitudinal direction along the platform can be transmitted to and reinforced by the corresponding, longitudinally aligned treadmill framework, while also reducing applied transverse forces and moments. As shown, a top port or top opening 130 can be formed through a top portion of the inflatable enclosure 110, which as shown can be aligned vertically with, and above, the exercise device 160 and a corresponding access region through an inner space of the inflatable enclosure. A top port frame or seal frame 132 can be attached proximate and about a perimeter region of top port 130 for stabilizing a support region about a user attached to the enclosure at the top opening in an airtight, supported arrangement with the inflatable enclosure 110. Seal frame 132 can be formed as a rigid frame that maintains a low surface stress, mechanical equilibrium arrangement of the inflatable enclosure 110 about the top port. The seal frame 132 can be attached to a top portion of the enclosure proximate the top port 130 in an arrangement for transmits tensile and compressive forces, and any other stresses and strains encountered in the top portion of the enclosure about the top port, which can help stabilize a region of the top port to which the user is attached.

When in the inflated condition shown, air pressure acting against the surface of the flexible enclosure skin 113 applies upward unweighting forces on the user and against the support platform 142 at the support surface 144, which forces are carried within the enclosure skin 113 and transmitted to the platform 142 via the enclosure interface with support surface 144. The meridional radial lines 124 shown for the inflatable enclosure 110 are representative of a general surface stress arrangement that can be provided through the enclosure while inflated, for which the seal frame 132 can help maintain despite top port 130 interrupting a portion of the enclosure surface by transmitting stresses across the seal frame. However, the radial lines are shown only for schematic, illustrative purposes without necessarily denoting any tension members, reinforcements integrated in the enclosure surface, embedded fibers, isotensoid supports and the like. Rather, the radial lines are indicative of an optional innovative, low surface tension arrangement of the inflatable enclosure that can be used with platform 142 and cooperate with innovative aspects and features of platforms described herein.

In particular, in the inflated configuration illustrated in FIG. 1, the example DAP system 140 forms an independently supportable, hollow-shell support mechanism for substantially offsetting outboard forces applied to the enclosure and minimizing upward forces and moments applied to the platform in a generally transverse direction of the DAP system, for which treadmill framework features can correspondingly reinforce. Such a streamlined enclosure arrangement combined with a platform 142 having a truncated access opening and reinforced with treadmill framework elements such that the DAP system can independently support the enclosure in a stable inflated arrangement, can nonetheless benefit from various additional features and enhanced functionality of other platform arrangements according to additional aspects, features, and concepts described below. Such aspects, features and concepts can pertain to structural and functional features involving the use of optional lifts, which further can be integrated into and with support platform 142. Further, aspects, features and concepts described herein are not limited to the schematic representation of DAP system 140 and enclosure 110 and/or similar arrangements, but can be combined with and provide various benefits and enhanced features for use with conventional DAP systems and enclosures or other DAP arrangements and enclosures according to aspects and features of platforms described herein.

Example Platforms Shown with Example Hollow-Shell Frameworks and Restraints

Aspects, features, options, design choices and arrangement considerations pertaining to additional features and mechanisms discussed below pertaining to platforms usable with DAP systems can be configured to support, enhance, augment and/or otherwise cooperate with, if not synergistically improve, beneficial features, arrangements and functions enabled or provided via hollow-shell framework enclosures described above or elsewhere herein. Thus, it is understood that discussions pertaining to example features of platforms, platforms having integrated lifts, and other features and related concepts can be implemented with example DAP systems described herein as example arrangements. However, it is understood that aspects, features, options and arrangements discussed hereafter can likewise be configured for beneficial or cooperative use with other types of DAP systems and enclosures including with conventional DAP systems and enclosure arrangements.

Example Platform with Vertical Lifts Shown with Enclosure and DAP System

Figure 2B:
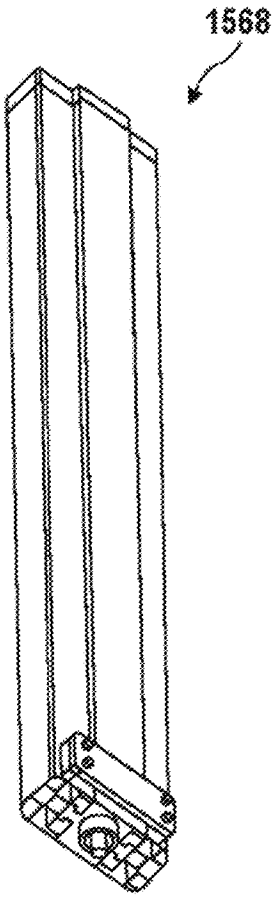
FIG. 2B is a perspective view of the lift mechanism of FIG. 2A.
Figure 2A:
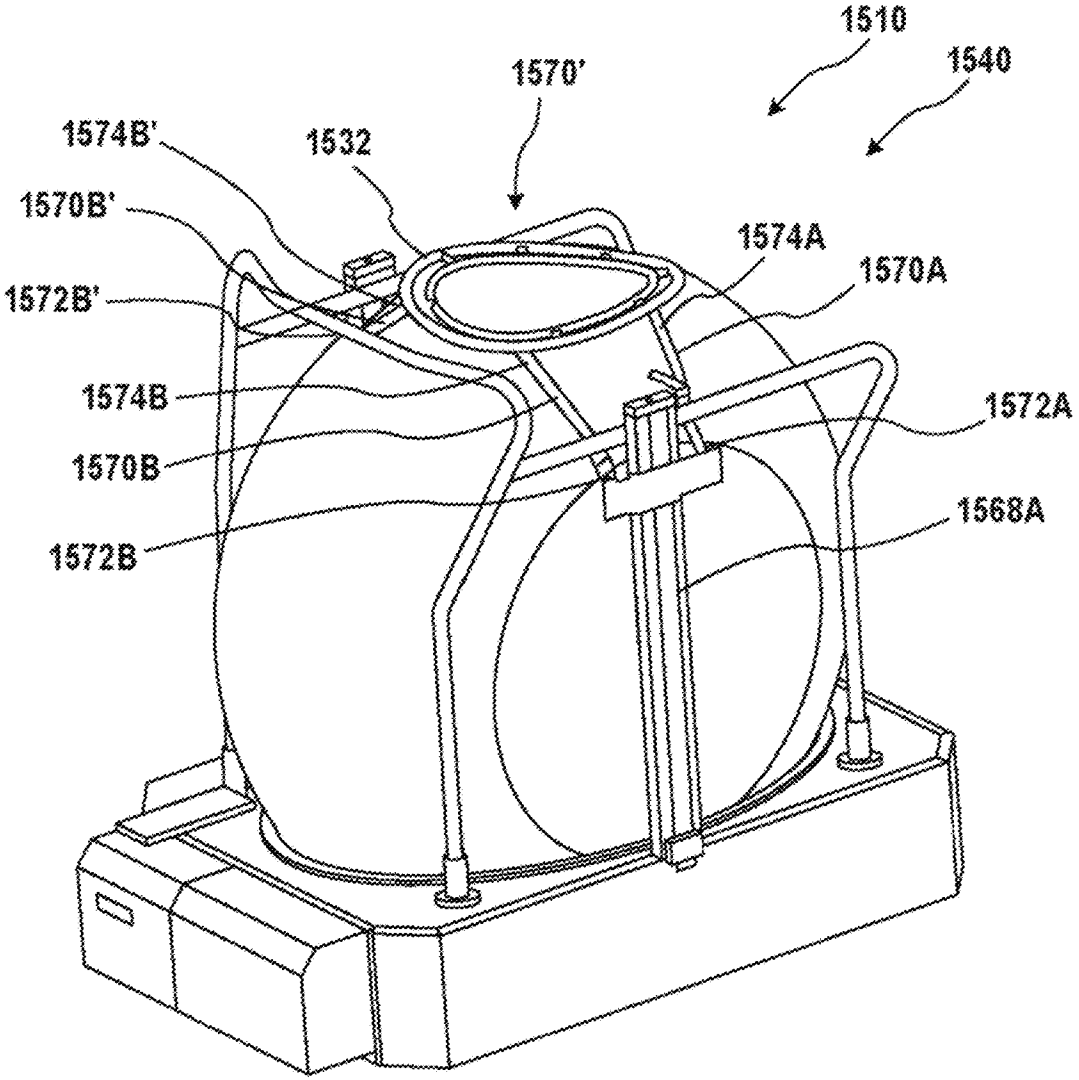
FIG. 2A is a schematic front perspective view showing of another example platform in use with an inflatable enclosure and exercise device (not shown) of a DAP system, in which the platform includes a pair of lift mechanisms along the lateral portions of the platform according to inventive aspects and features of various examples and inventive concepts discussed herein.

Referring now to FIGS. 2A and 2B, a DAP System 1540 and enclosure 1510 are shown used with a platform 1542 in accordance with inventive concepts and features described herein, which includes a pair of lifts attached along opposite sides of the platform that are each connected to a seal frame via flexible restraints. As discussed in greater detail below including along with FIGS. 42A to 42C, the pair of lifts attached to or integrated as part of the platform along with transverse connections to a seal frame or other bridge member can form a hybrid transverse framework for further enhancing innovative structural and functional beneficial aspects and features pertaining to platforms and DAP systems described herein.

As shown in FIGS. 2A and 2B, four (4) flexible lift restraints 1572A,B,A'&B' are attached to seal frame 1532 at a second attachment 1574A,B,A'&B', which likewise extend outboard and connect with a vertically movable carriage 1568, 1568' located along each lateral region of enclosure 1510. Further, DAP System 1540 includes vertical lifts 1568 and 1568' that can each be disposed on an external, outboard side of the driven side with respect to the enclosure 1510, and attached to the platform 1542 at opposite sides of the platform. Accordingly, inadvertent contact can be avoided with outer portions of the enclosure wall during vertical movements that can potentially pinch or otherwise weaken outer portions of the enclosure wall. Although vertical lifts 1568 and 1568' can be spaced apart and arranged with respect to the enclosure to avoid contact with outer walls, an outboard arrangement of vertical lifts 1568 and 1568' can further avoid any potential inadvertent contact to further protect long-term integrity of the enclosure. The orientation may however be flipped without departing the inventive concepts herein, so that the lift carriages are located on the inner face of the channel. Such a configuration may shift the loading on connecting members to a more vertical orientation which may reduce the tensile forces on those connecting members (e.g., straps).

Figure 3:
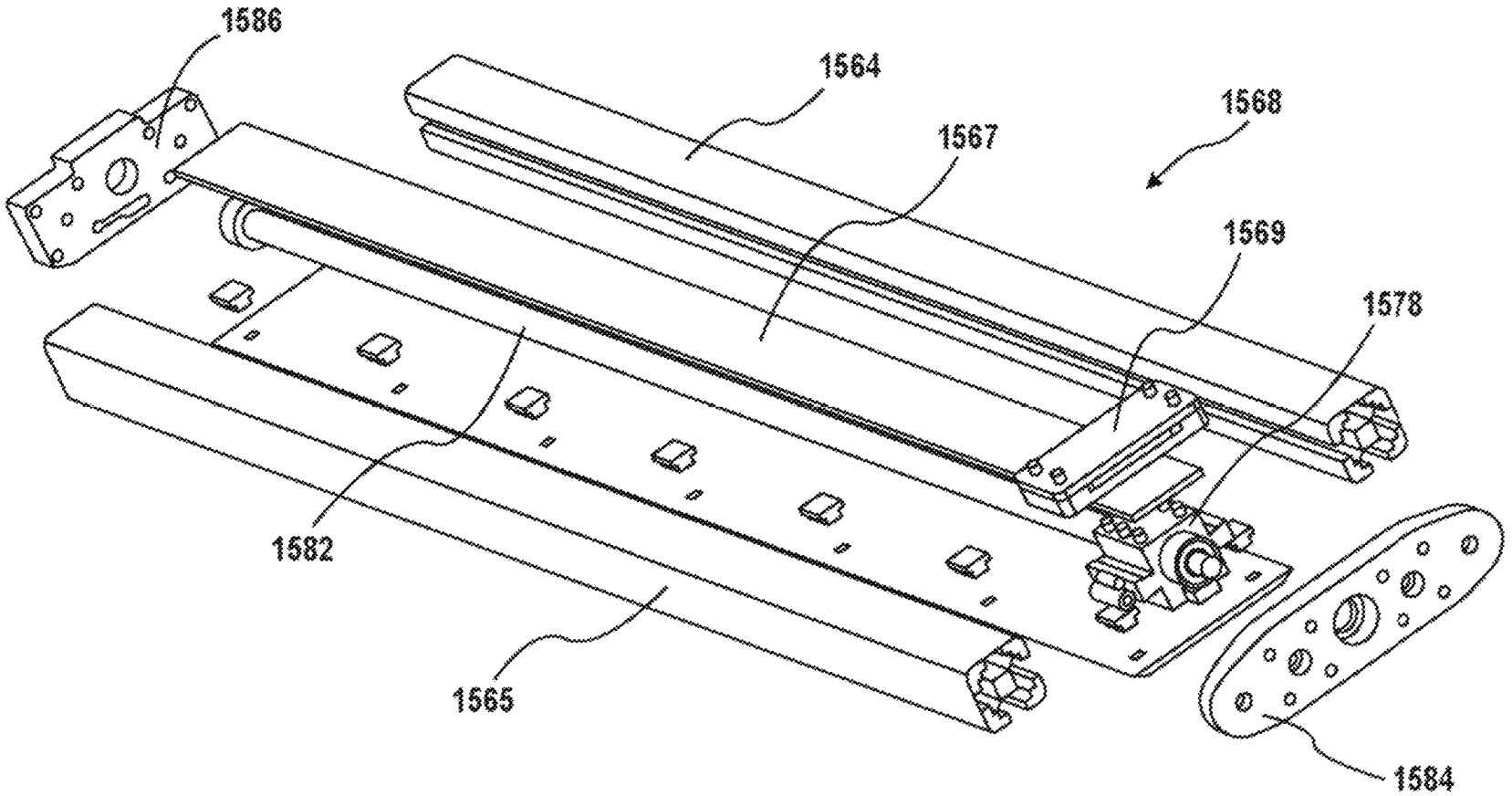
FIG. 3 is an exploded perspective view of the lift mechanism of FIG. 2A.

Referring to FIG. 3, an exploded view of an example linear drive vertical lift 1568 is generally shown, which can be attached to and integrated with platform 1542 for providing various benefits including performance features, such as height adjustments for the user, and structural features as described further below. Each vertical lifts 1568, 1568' can include a pair of spaced apart, opposing vertical side rail supports 1564 and 1565 and a vertical inboard wall extending therebetween and oriented toward the enclosure during use, which protects against contact with the enclosure wall. A slide surface 1567 is disposed opposite the inboard wall 1587 and likewise extends between the side rail supports 1564 and 1565 about which a driven slide or carriage 1569 translates vertically during use for controlling height of the top bracket 1532 and tensile forces imparted to the top bracket 1532 through connections with lift restraints 1570A, B,A'&B'. A drive screw 1582 is vertically and rotatably retained within the vertical lift 1568 extending parallel with the vertical central rail 1567 between an opposing top cap 1584 and bottom cap 1586. A drive slide 1578 forms a threaded connection about the drive screw 1582 for movement along the drive screw 1582, which is connected to driven slide or carriage 1569. A drive motor (not shown) controls rotations of drive screw 1582 for accurately and quickly controlling vertical movements of drive slide 1578 along the drive screw and, thereby, vertical movements of driven slide 1569 and lift restraints 1570A,B,A'&B' connected thereto. All the railing features can be formed as an integrally formed component as shown in the example of FIGS. 35-40.

Cooperative groups of vertical lifts 1568 and 1568' can be controlled substantially in unison for precisely controlling tensile forces imparted about the perimeter of the top bracket 1532. It is understood that height differentials can be selectively applied for desired results, such as to impart tilt or other preferences on the top bracket 1532 for a user. The drive screw and corresponding nut may have a pitch angle such that the mechanism is not backdrivable. In this manner, the motor does not need to compensate for the high loads imparted by the enclosure on the top frame and thus carried through the drive screw. A safety method of height adjustment may therefore be to check the pressure inside the enclosure to ensure it is below a predetermined safety limit before allowing activation of the lifting columns as a safety precaution not to burn out the motor.

Example Panelized Platform for DAP Systems Having Optional Integrated Lifts

Figure 4A:
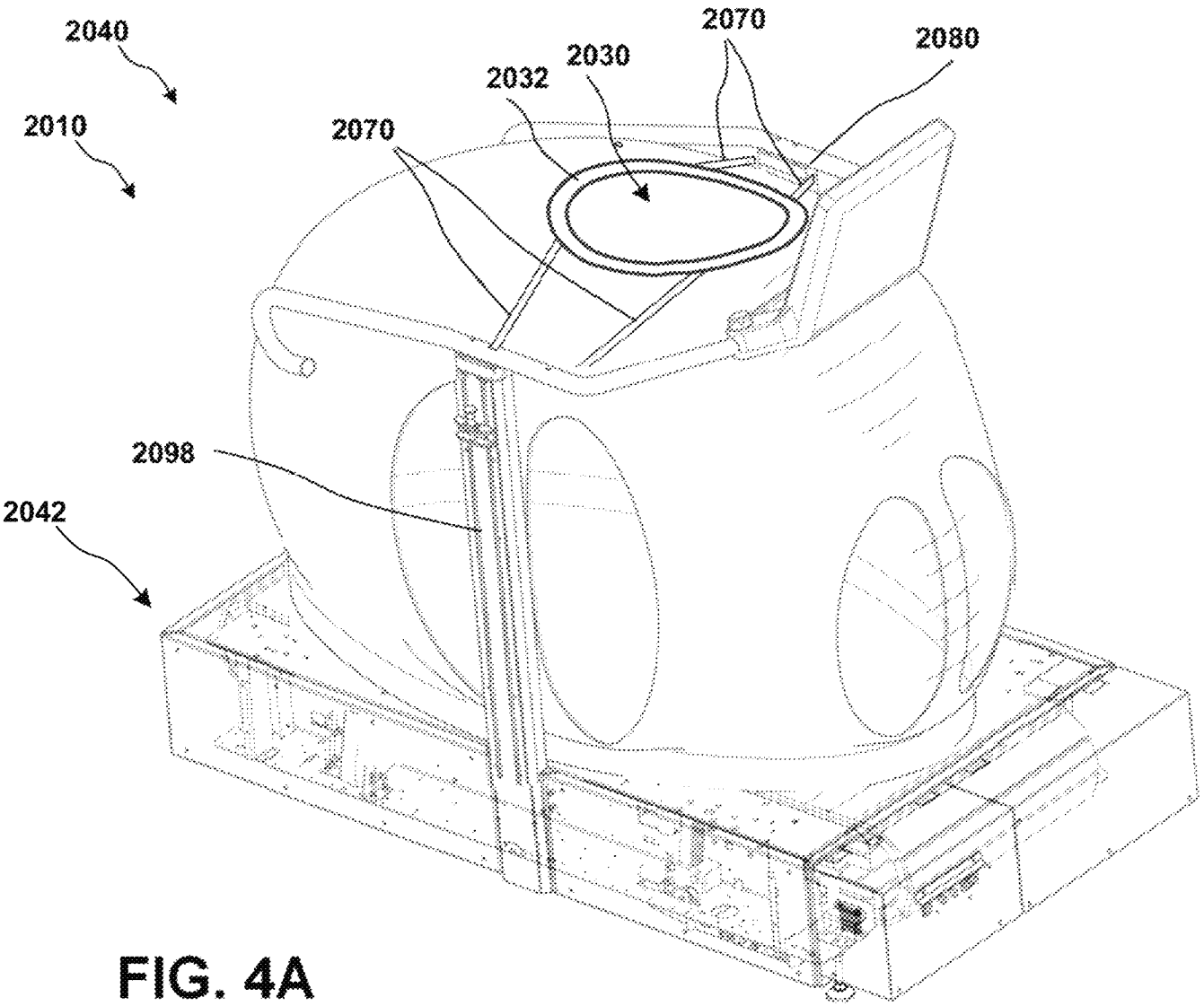
FIG. 4A is a right front perspective view of a schematic representation of a platform shown in use with an enclosure, and an exercise device for an example DAP system, which the platform includes a pair of vertical lifts according to aspects, features, and inventive concepts discussed or shown herein.
Figure 4B:
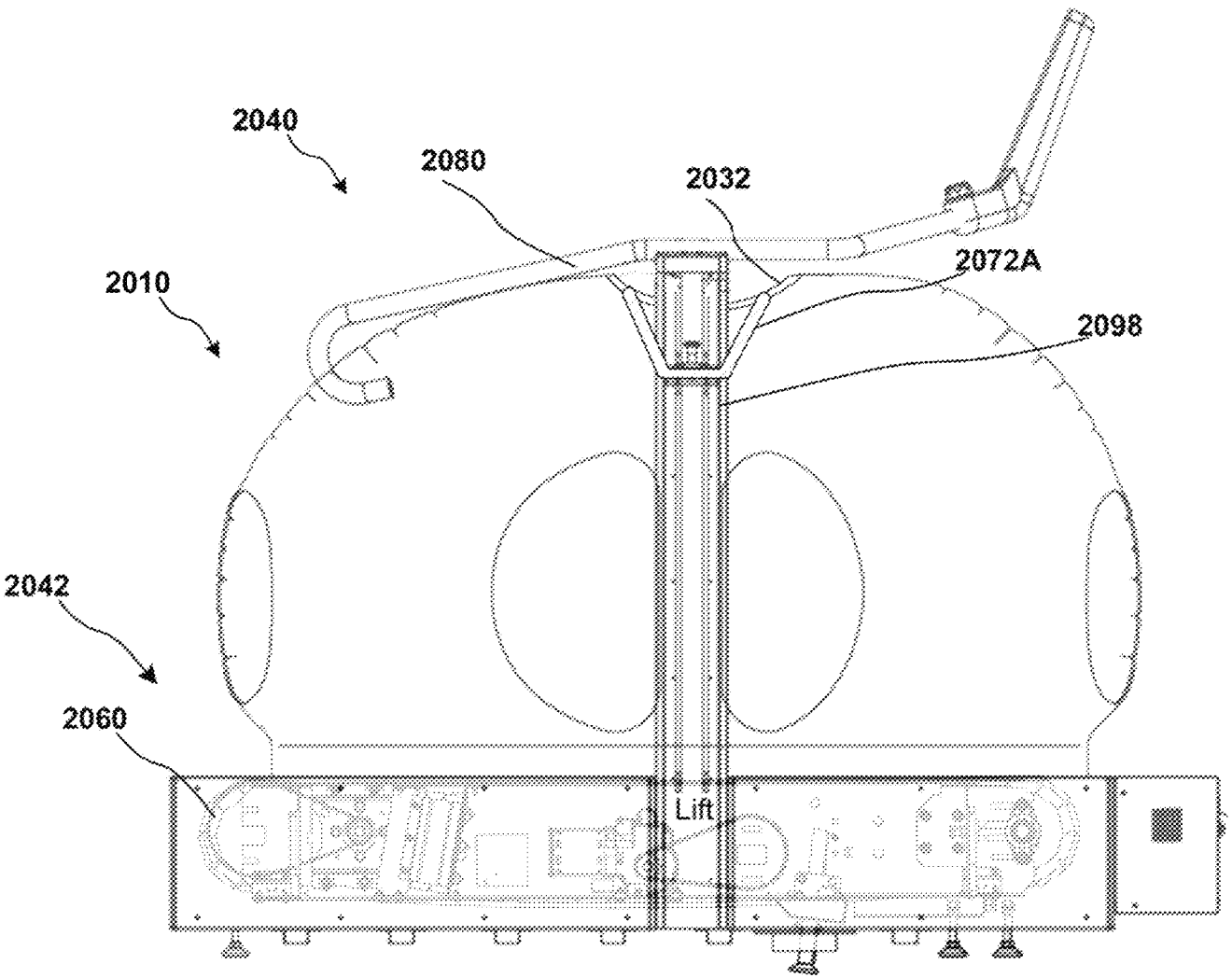
FIG. 4B is a right side view of the DAP System of FIG. 4A, in which the platform is depicted as partially transparent showing an example treadmill exercise device located within the platform.

Referring now to FIGS. 4A to 6, an example platform 2042 for use with a DAP System is generally shown, which is depicted installed along with other components of a DAP System 2040. As such, FIG. 4A schematically depicts a DAP System 2040 arranged as an example height-adjustable differential air pressure (DAP) exercise system that includes a platform 2042 constructed as an ultralight, high-strength, panelized platform that can provide a wide range of beneficial features and options for use with DAP Systems. Such an example platform is shown in FIGS. 7-34 and described herein as an example arrangement incorporating combinations of aspects, features and related innovative concepts, which may or may not be used together in particular platform arrangements, nor are required or implied herein to be combined, and which separately and as combinations fall within the scope of subject matter of the invention. For discussion purposes, the example panelized platform will be described as part of the DAP System of FIG. 4A. The DAP System of FIGS. 4A to 6 generally includes the same aspects and preferences described along with the example DAP Systems of FIGS. 2A to 3 except as discussed hereafter.

The DAP System 2040 includes a support platform 2042 having a top cover 2050 that provides an enclosure support surface as its top surface, to which an inflatable enclosure 2010 is secured at a base opening defined through the enclosure and extending vertically from the base opening in an inflated condition. The enclosure defines a top opening 2030 through a top portion of the enclosure at an enclosure height extending from the base opening to the top opening. The DAP system further includes a seal frame 2032 attached to the inflatable enclosure proximate and about the top opening, and a plurality of lift restraints 2070 each having a first end, a second end, and a restraint length between the first end and the second end. A pair of vertical lifts 2096, 2098 are integrated within the construction of the platform 2042, which are each attached to lateral sides of the platform along a base portion of each lift and extend upward therefrom on opposite sides the enclosure.

Each lift 2096,2098 includes a linear drive mechanism connected with a movable carriage as shown and described in greater detail along with FIGS. 35-40. A DAP control system (not shown) controls operation of the linear drive mechanisms for raising and lowering each carriage along the lifts. The second end of each tensile lift restraint 2070 is attached to a corresponding carriage so that controlled movements of the carriages adjust the height of the top frame. The lift restraints can include a material that is generally flexible with respect to its shape or orientation, but that is substantially inflexible when placed under tensile stress. The use of flexible, tensile restraints thus decouple the pair of vertical lifts other than with respect to tensile stresses regarding connections with the seal frame, and thereby avoiding issues with racking or misalignment in any plane between the lift columns and missed timing or speed between left and right sides. With large span distance between the lift columns and the loading associated with the enclosure, the flexibility of the restraints promotes much less precise manufacturing and assembly and reduces cost.

Referring now to FIGS. 7 to 34 with specific reference to FIGS. 12-17, an example frameless panelized platform 2042 is generally shown that includes a top cover 2050 vertically spaced apart from a bottom cover 2053, and a plurality of side covers 2055, 2057, 2059, 2061, 2063 and 2065 each attached to the top cover at a top edge region and to the bottom cover at a bottom edge region thereof. The platform further includes a plurality of brackets that can include a plurality of corner brackets 2043 and optional lift brackets 2073, 2075, in which each bracket is also attached at a top region to the top cover and at a bottom region to the bottom cover.

The term "panelized" as used herein refers to a platform formed as an assembly of discrete, load-bearing panels attached to each other to form the platform, but that are otherwise independent from one another. The term "frameless" as used herein for the platform refers to a platform lacking an independent framework or skeletal support system to which panels are attached to form the platform and retain the platform shape. Further, the term "frameless" as used herein for the platform also refers to a platform formed as an assembly of panels, in which the panels include attached reinforcements, built-in supports, support features formed along with forming the panels, and/or panels otherwise including beam, column or other support members integrated therein. As such, the phrase "panelized, frameless" as used herein for the platform refers to a frameless platform formed from an assembly of independent panels having integrated support features, which are attached to one another to form and retain the platform. Although, as described further below, the platform can include an exercise device interface for attaching the platform to a framework of the exercise device that can secure the exercise device framework to the platform at the top and bottom covers, the platform nonetheless lacks a skeletal framework or other support structure for retaining the assembly of panels and forming the platform. In other words, the geometric shape of the platform, interconnections between panels, and the overall platform structure are not defined or maintained by an arrangement of beams, columns or other separate arrangement(s) of support members. Rather, the platform shape, interconnections between panels and the overall platform structure are defined by the assembly of panels having integrated support members and interconnections between adjacent panel support members.

Figure 9:
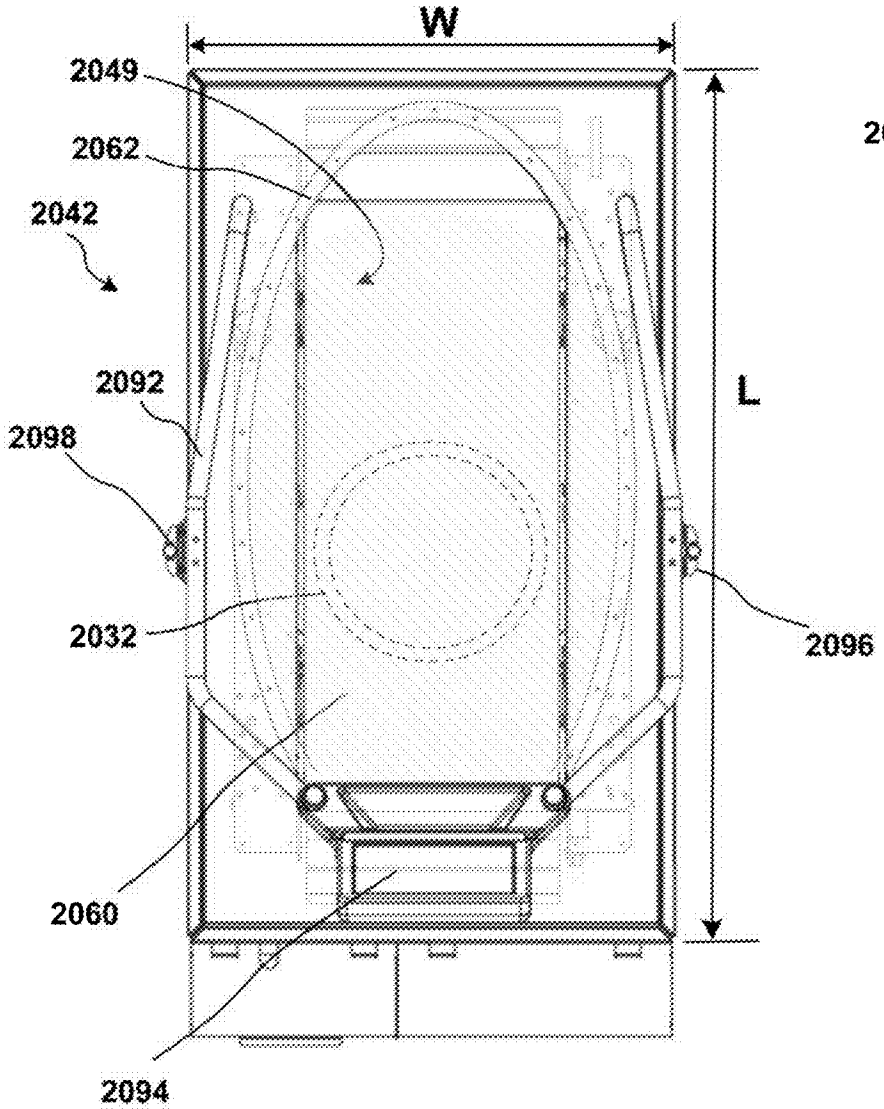
FIG. 9 is a top view of the DAP System of FIG. 4A shown without the DAP enclosure and the platform partially transparent showing the example treadmill exercise device located within the platform and further depicting the truncated access opening and range interactions for the user with the treadmill exercise device based on the location of the seal frame and top port shown in broken lines.

As can be seen in FIG. 9, the top cover 2050 forms a top surface of the platform 2042 and defines a truncated access opening 2049 therethrough into an inner cavity of the platform to a top region of the exercise device within the inner cavity. The term "access opening" as used herein refers to a closed shape defined through a surface or plane at the top of the platform that enables vertical usage access or engagement access for the user to the exercise device immediately below the top cover during DAP usage. Under such conditions, at which time the user and the user seal (not shown) extending from the user's waist region must extend though and be secured with the top port 2030 via an airtight connection, user mobility is limited by the DAP support arrangement and, thereby, options for interacting with the full range of exercise device access that would typically be available with the exercise device independent of the DAP system. Vertical usage access or engagement access for the user as used herein refers to exercise access downward, from a position above the exercise device where the user is located during use of the DAP system, which is appropriate and typical for engaging the device during an exercise session, such as vertical access to the top of a treadmill for interacting with its belt during ambulation. "Truncated" as used herein for the access opening refers to vertical access for engaging the device for exercise that is shortened or limited from within the enclosure and through the opening defined through the top cover compared with vertical usage or exercise access with the device according to aspects of the platform top cover including a maximum length, L, and a maximum width, W, independent of the DAP system, such as the treadmill standing alone apart from the DAP system.

With continued reference to FIG. 9, the typical vertical usage or exercise access region of example treadmill 2060 is outlined by dotted lines as rectangle extending around the upper, exposed regions of the treadmill track along with 'standing' or 'rest' portions on each side of the track that are typically accessible in a vertical direction by a user for engaging and using the treadmill during an exercise session apart from the DAP system. An inner side of base opening attachment ring 2062 outlines the truncated access opening 2049 defined through the top cover for providing vertical user access during use of the DAP system 2040 for user engagement with the exercise device 2060 for an exercise session. Seal frame 2032 is shown in broken lines, which extends about the top port and user seal due system use, which is shown at its vertical location during use of the DAP system including being centered between lifts 2096 and 2098. The example DAP system arrangement 2040, inflatable enclosure 2010 and platform 2042 depicted in FIG. 9 are for an ovate, elongated arrangement having extended leg kick space rearward vs. other arrangements, which includes an extended truncated access opening as shown. Nonetheless, due to movement limitations during use of the DAP system when the enclosure is inflated, the user is unable to engage full regions of the typical vertical access area including corner regions thereof while in the inflated condition.

Figure 6:
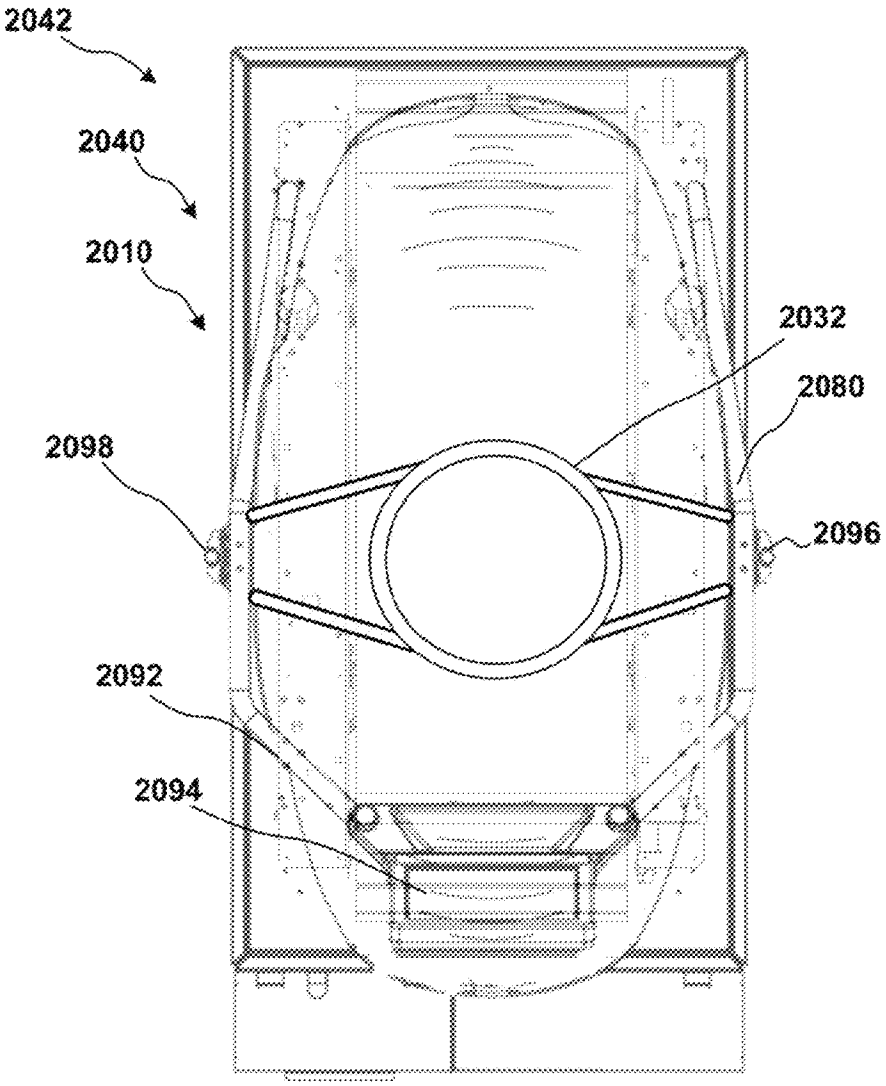
FIG. 6 is a top view of the DAP System of FIG. 4A.
Figure 5:
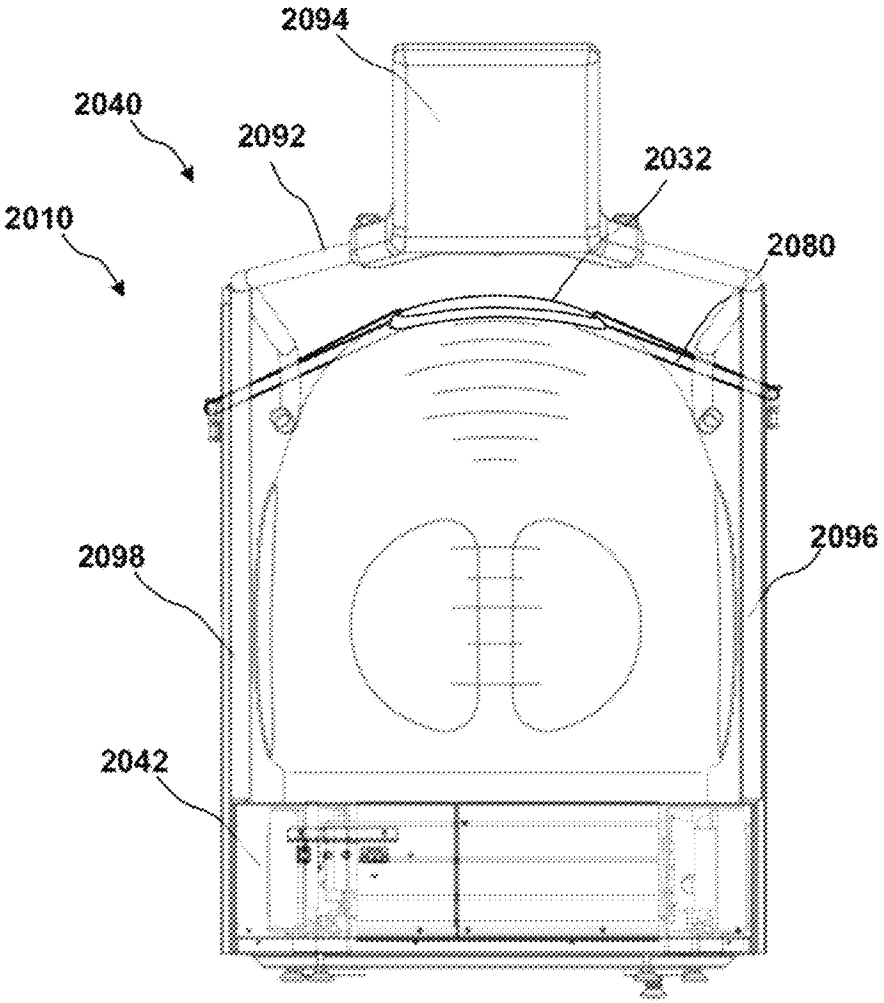
FIG. 5 is a front view of the DAP System of FIG. 4A.
Figure 8:
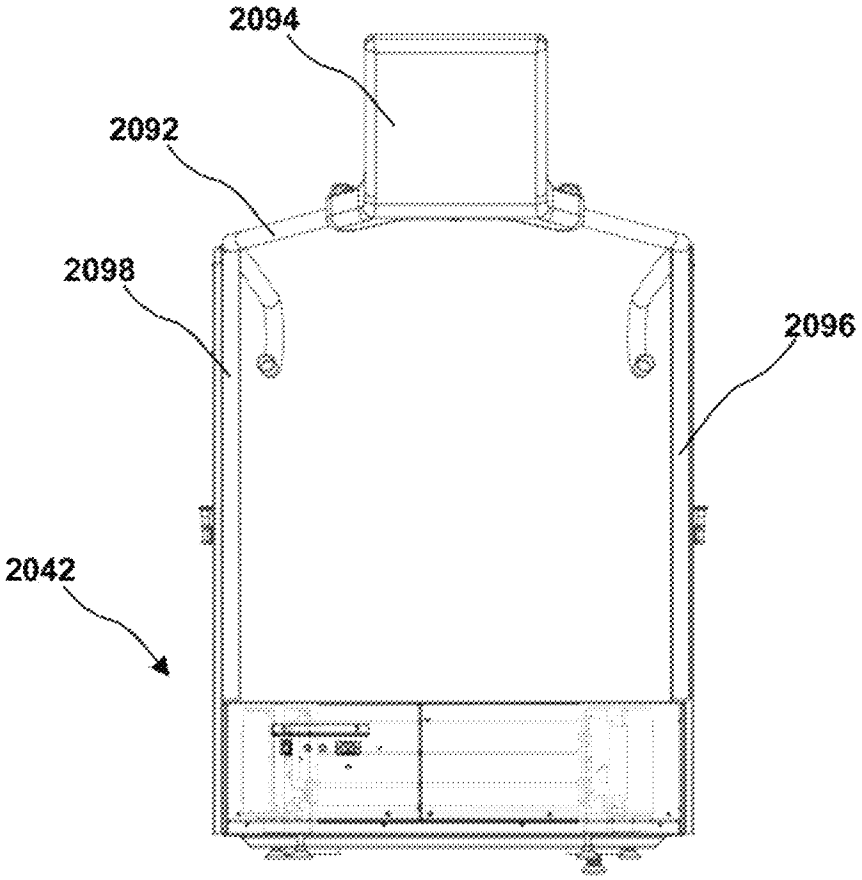
FIG. 8 is a front view of the DAP System of FIG. 4A depicted without the enclosure and the platform partially transparent showing the example treadmill exercise device located within the platform.
Figure 7:
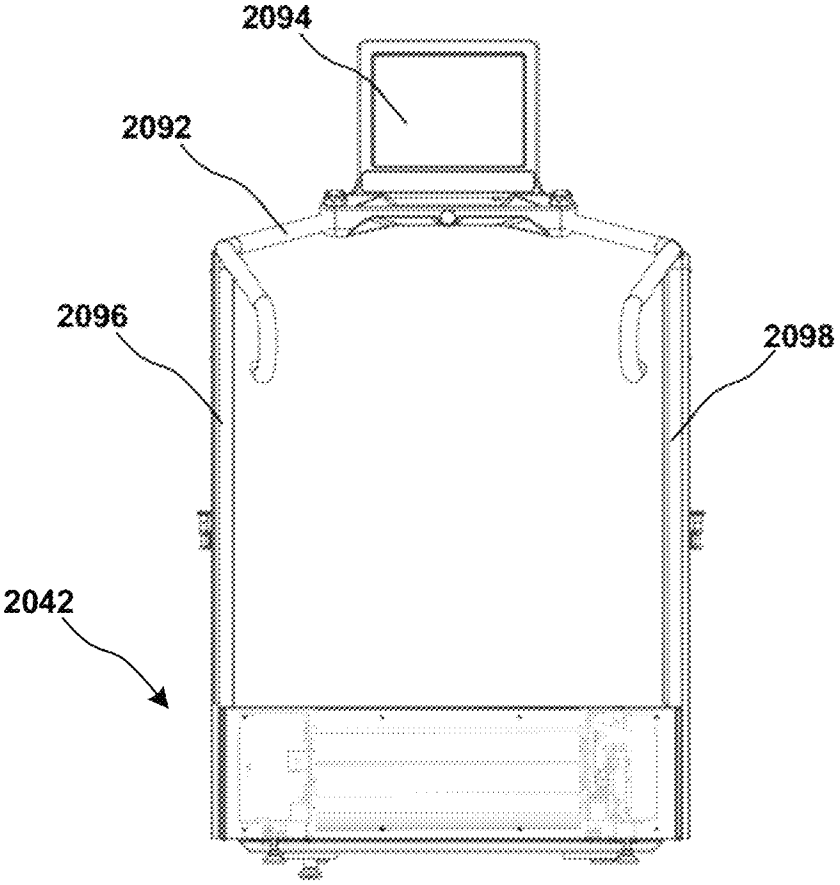
FIG. 7 is a rear view of the DAP System of FIG. 4A depicted without the enclosure and the platform partially transparent showing the example treadmill exercise device located within the platform.

As such, the top cover 2050 defines a truncated access opening 2049 that further corresponds with a base opening of enclosure 2010 as shown in FIG. 4A as well as FIG. 6 for a top view similar to FIG. 9. In some implementations, the truncated access opening 2049 can be formed as an ellipsoidal or generally curved shaped opening, such as the opening depicted in FIG. 9. Further, the enclosure base opening that attaches to the top cover along a perimeter region of the top opening can be shaped and defined for matching the truncated access opening 2019.

As noted above along with FIG. 1, conventional DAP systems have inflatable enclosure base openings and/or platform access openings as large as or even larger than typical vertical access regions for the exercise device on its own (i.e., outside of the DAP system), which can significantly increase enclosure volume and the magnitude pneumatic force applied by the enclosure base opening to its attachment with the platform. According to aspects and features of platform 2042 described herein, the access opening 2049 can be formed as a truncated access opening extending vertically through the top cover having an area that is less than a vertical exercise access area for the exercise device on its own apart from the DAP system, and which is partially truncated vs. a vertical access area of the exercise device independent of the DAP system.

Stated differently, for an exercise device like a treadmill or other exercise device typically having a generally rectangular vertical exercise access region, the truncated access opening 2049 through the top cover 2030 of the platform 2042 has an overall perimeter length according to inventive aspects and features described herein, which is less than two times a maximum length, L, and two times a maximum width, W, of the typical treadmill or similar exercise device and/or of a top cover thereof independent of the DAP system. Further, with respect to the enclosure base opening that is secured to the truncated access opening 2049, both the enclosure base opening and the truncated access opening can have a corresponding size, shape and area that includes a perimeter length less than two times the maximum length, L, of the top cover plus two times the maximum width, W, of the top cover which provides an upper limit for the truncated access opening (e.g., less than a corresponding rectangle having the L×W dimensions). Greater efficiency, corresponding volume and force reductions, and related benefits including improved system performance and operations can be realized through further truncations as reasonable and appropriate for system arrangements and usage, such as having a perimeter length of ninety percent or less than the 2×L plus 2×W upper limit.

Figure 11A:
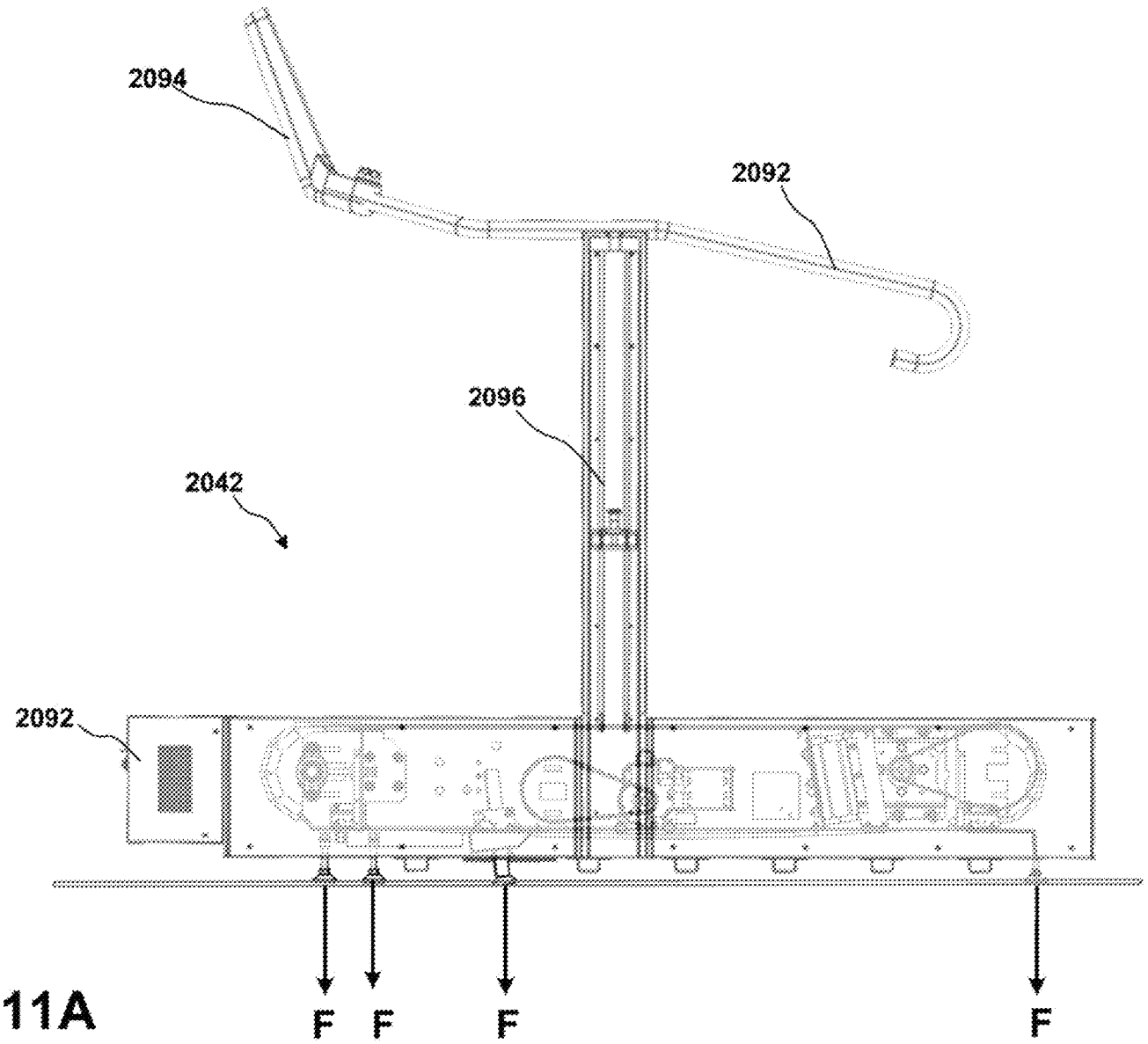
FIG. 11A is a left side view of the DAP System of FIG. 4A shown without the DAP enclosure and the platform partially transparent showing the example treadmill exercise device located within the platform, which includes schematic representations of downward forces applied via the example treadmill through alignments or interconnections of treadmill bottom supports with platform bottom supports for transmitting forces through the platform to ground, and/or pass-through arrangements of one or more bottom supports of the treadmill through the platform bottom directly to ground.
Figure 11B:
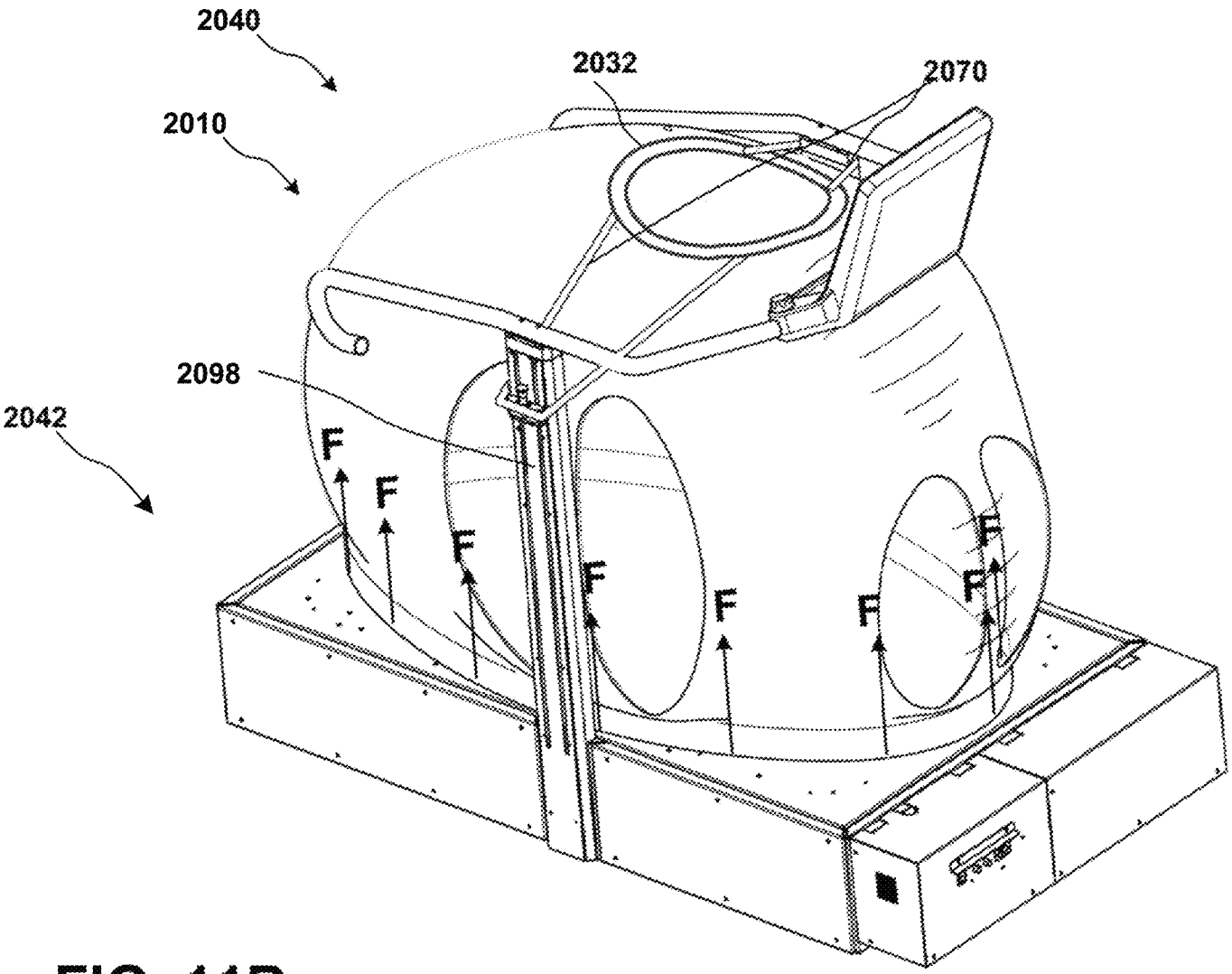
FIG. 11B is perspective view of the DAP System of FIG. 4A shown with the enclosure attached, which includes schematic representations for upwards forces applied to an enclosure attachment at an upper portion of the platform during use when inflated.
Figure 11C:
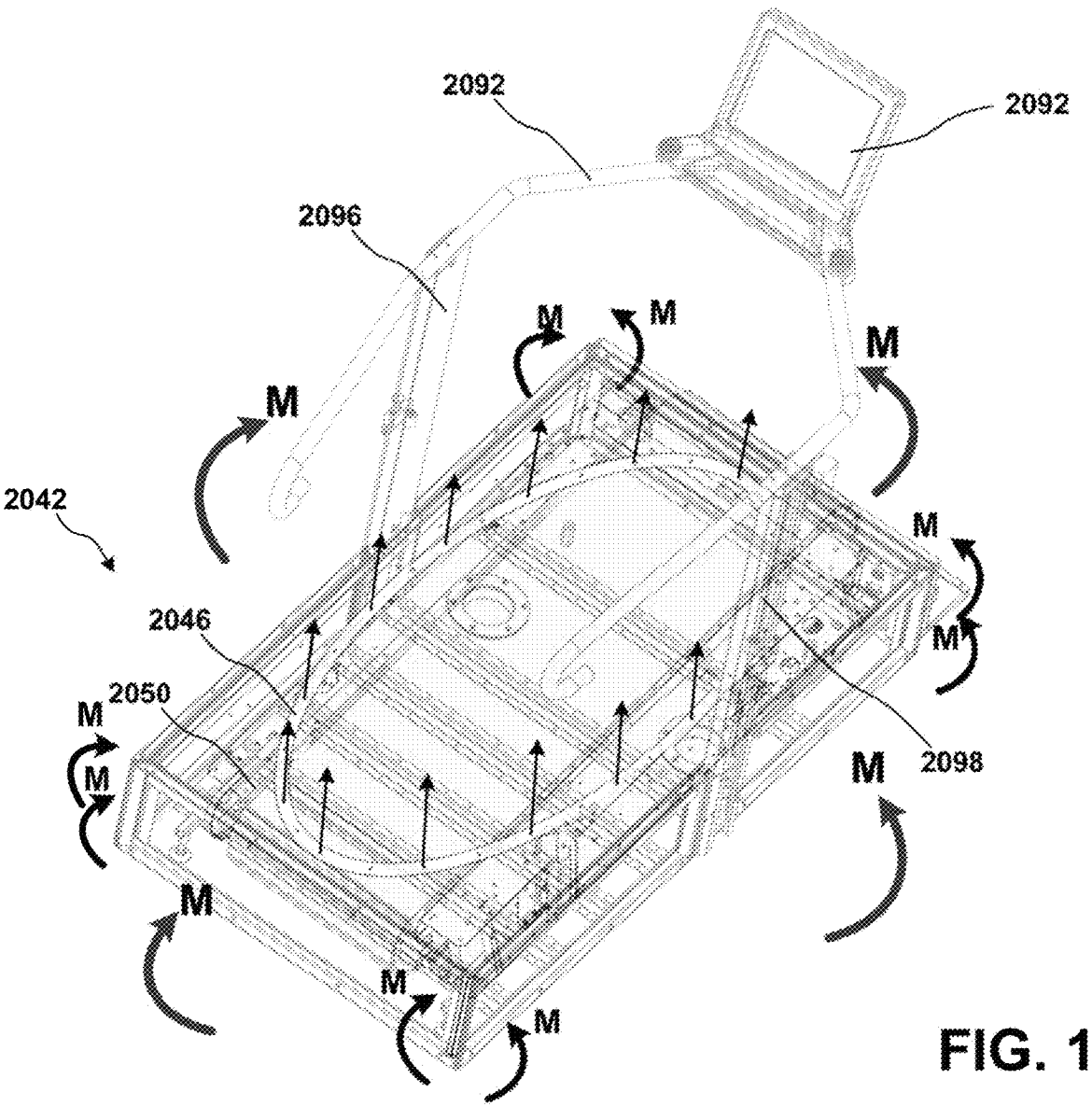
FIG. 11C is an upper, rear perspective view of the platform of the DAP System of FIG. 4A shown without the enclosure and omitting a blower box at the front of the platform and portions of an electronics compartment also at a front of the platform, which depicts platform covers or panels as transparent and schematically depicts forces applied to a top portion of the platform during use further to the forces schematically shown in FIG. 11B.
Figure 12:
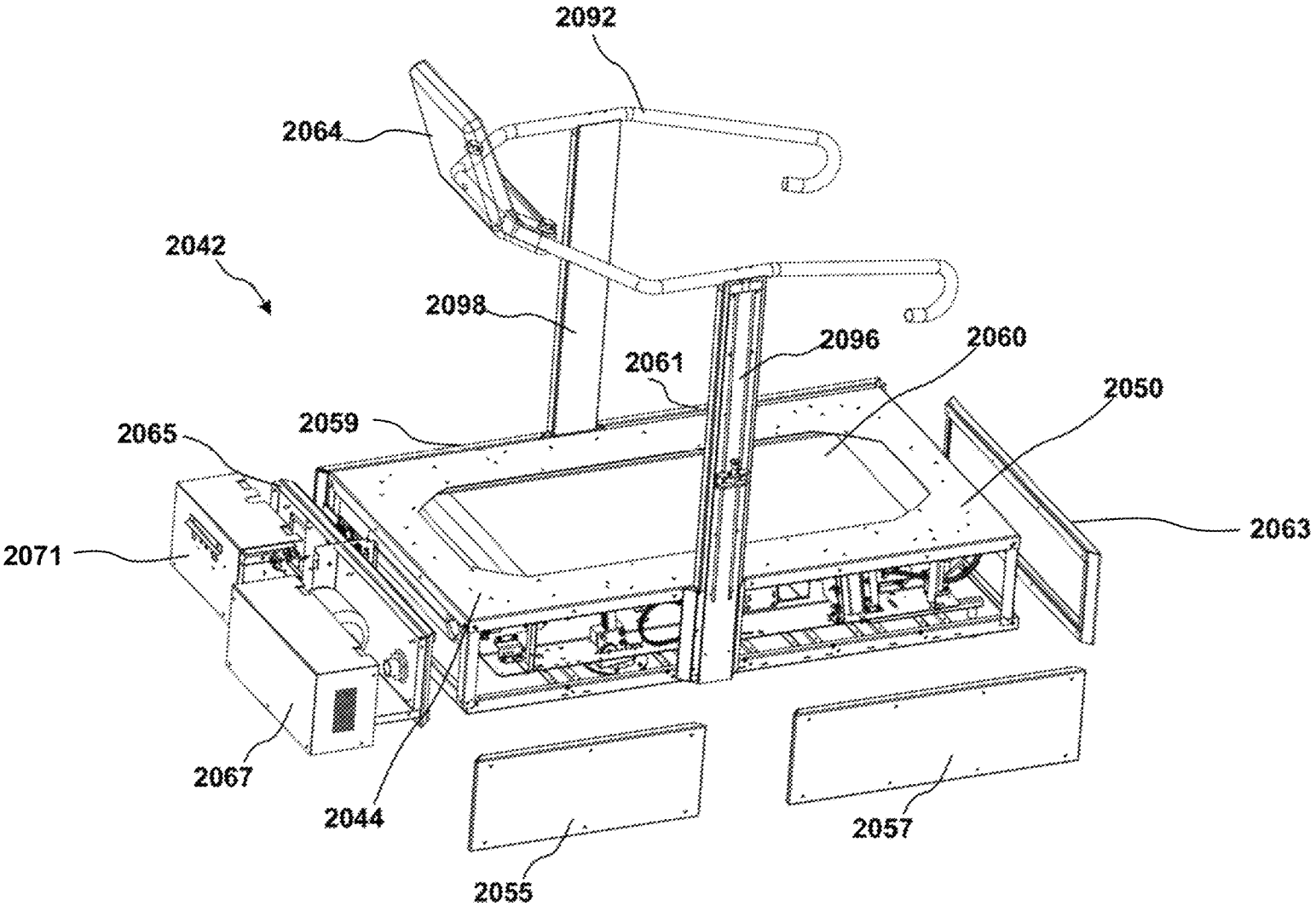
FIG. 12 is a left front perspective view of the DAP System of FIG. 4A with the platform partially exploded shown without the enclosure and depicting the example treadmill within the platform.
Figure 17:
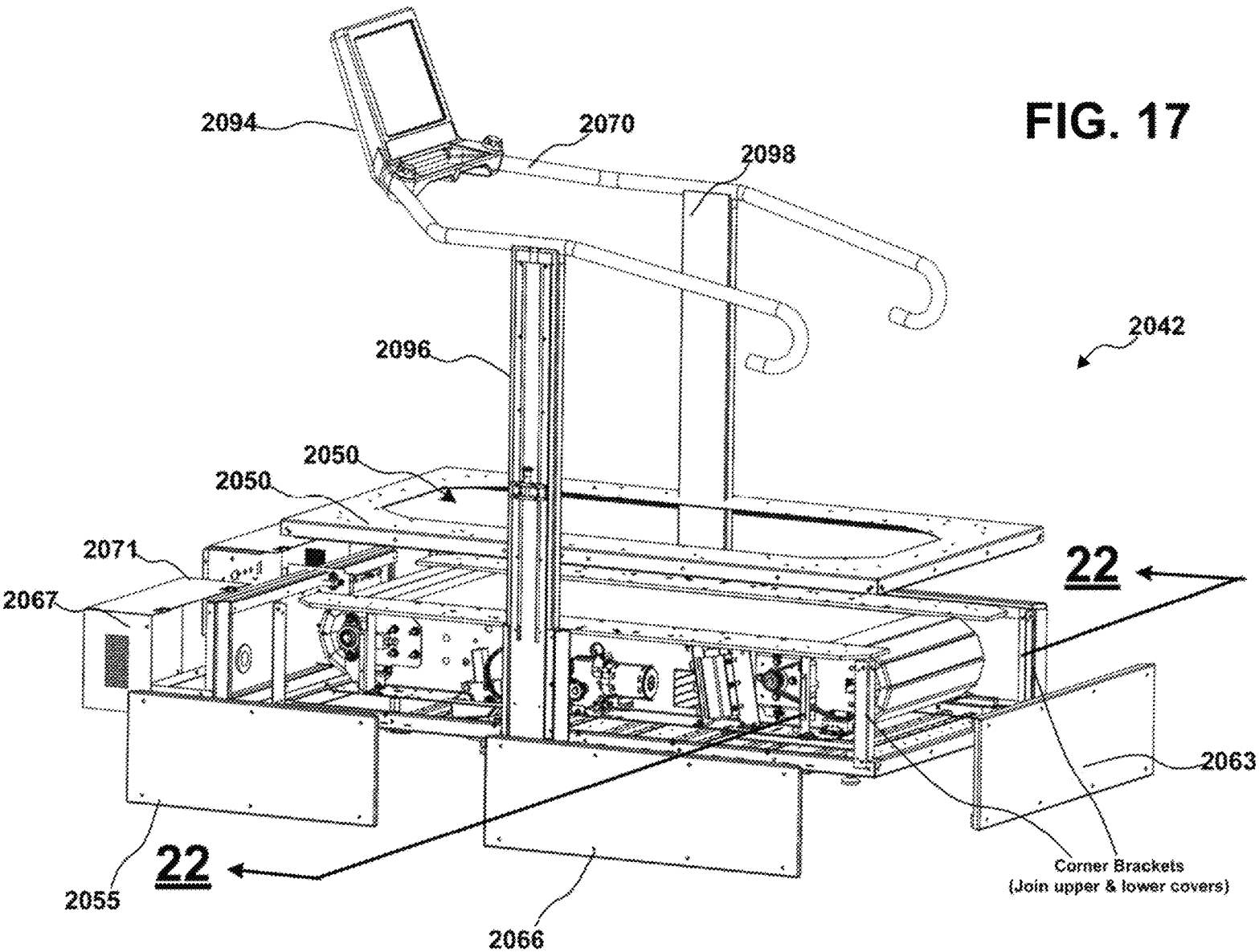
FIG. 17 is a left rear perspective view of the DAP System of FIG. 4A without the DAP enclosure as depicted in FIG. 16 showing a further exploded view of the enclosure.

As best seen in FIG. 9 along with FIG. 17, an exercise device arranged in the present example as a treadmill device can be retained within the platform, which a DAP user can access during use through the opening on the top cover. Thus, as schematically represented in FIGS. 11B and 11C, during usage the enclosure exerts high upward forces on the frame and clamping bars 2046 (FIG. 11C) for retaining the inflated enclosure.

Figure 19:
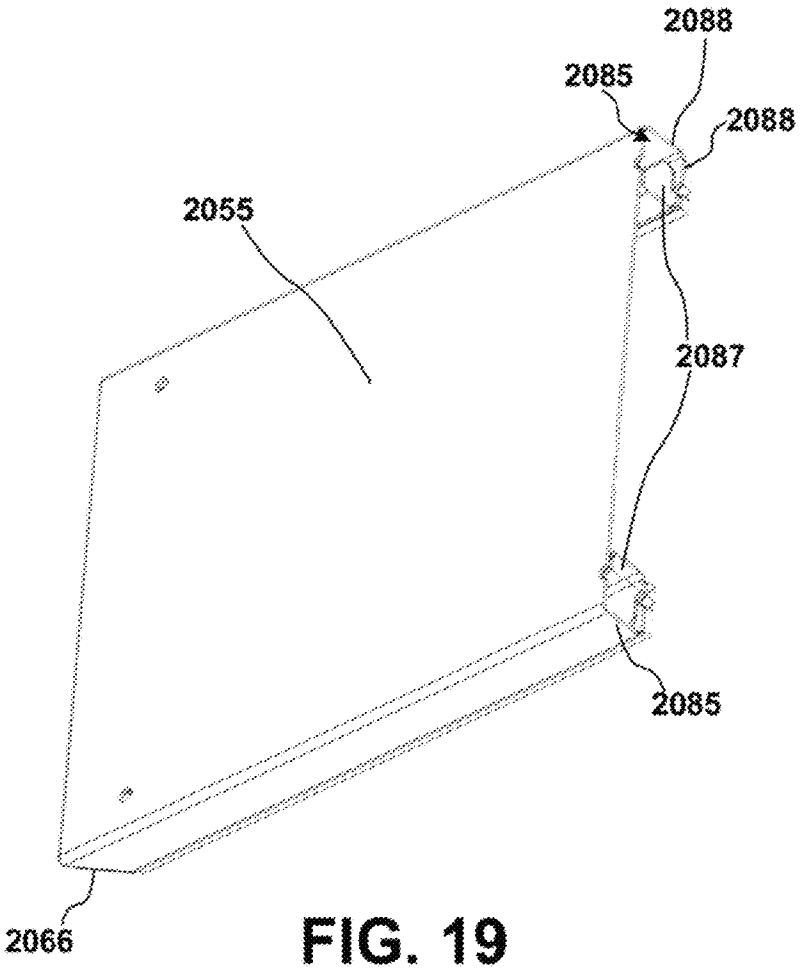
FIG. 19 is a perspective view of cut view of the front left cover shown in FIG. 18 as indicated along Line 19-19 shown in FIG. 18.
Figure 18:
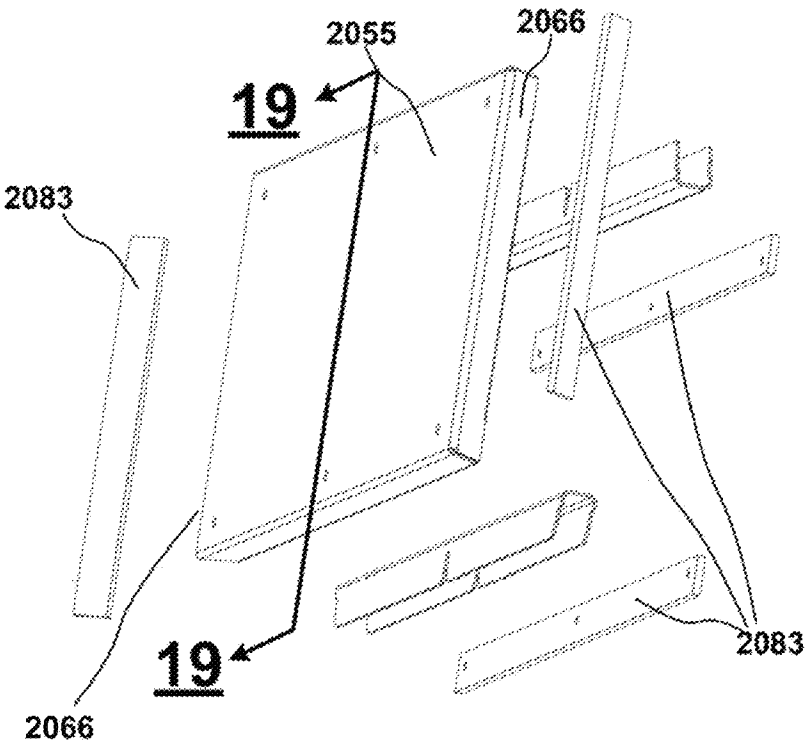
FIG. 18 is an exploded perspective view of the front left cover shown in FIG. 17.
Figure 21:
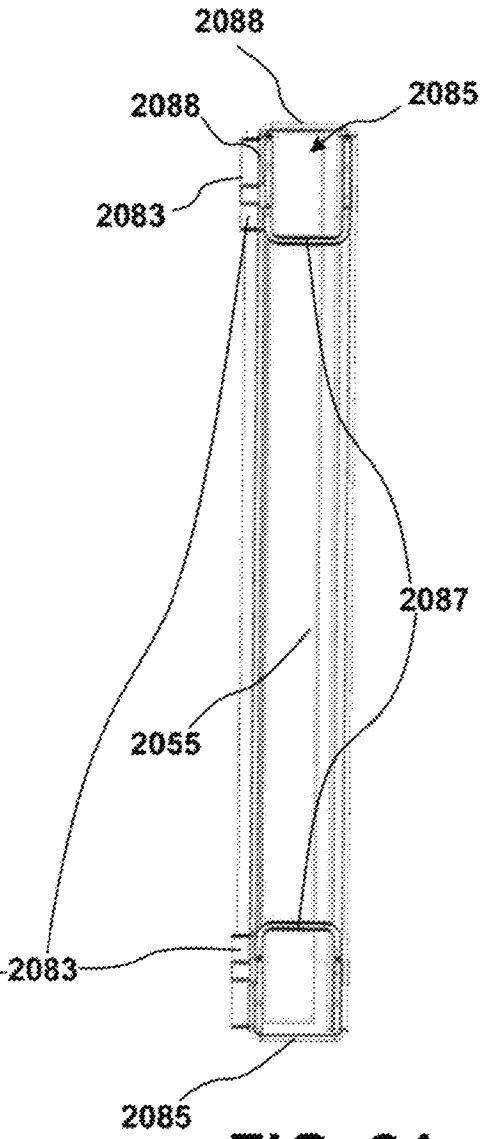
FIG. 21 is a cross-sectional view according to Line 19-19 shown in FIG. 18 for the portion of the left cover depicted of FIG. 19.
Figure 20:
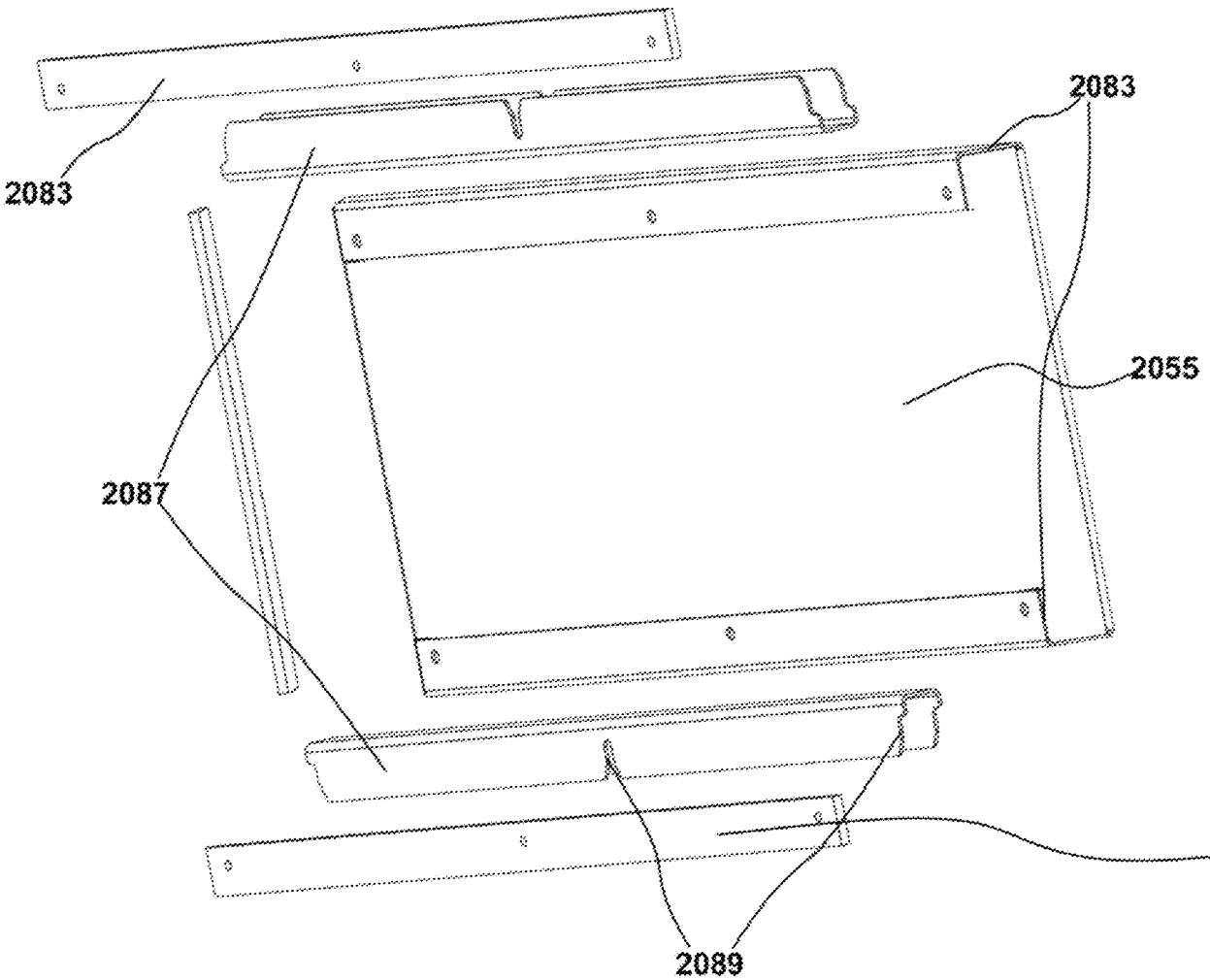
FIG. 20 is an exploded perspective view of the front left cover shown in FIG. 18 viewed from an inboard side opposite the outboard side viewable in FIG. 18.

As further depicted in FIGS. 9-17 along with FIGS. 18-20, the high-strength, lightweight, panelized support platform 2042 for a DAP System 2040 generally includes a top cover 2050 having an ellipsoidal opening enclosure opening formed therein, a bottom cover 2053, and a plurality of side covers attached to each of the top and bottom covers that are attached to one another along reinforced edge regions as an assembly to form the support platform 2042. Each of the covers can be formed from a thin sheet of material, such as a metal material including steel or aluminum sheet metal, but which can also include composite materials such as ceramic, KEVLAR, and the like, and various combinations of materials including, for example molded thermoplastic components having inserts, such as embedded reinforcement or attachment members. Further, each and/or some of the covers can be formed in whole or in part as molded or extruded components. The top cover 2050 can generally include a thin sheet of material having a length, a width, and a plurality of reinforced edge regions having a reinforcement member and an attachment surface or face 2021. The term "edge region" as used herein for a cover including a top, bottom or side cover refers to a region extending along a side or edge of the cover, which can include more than a discrete side surface or edge and generally includes a side surface or edge boundary along with regions of the cover proximate the side surface or edge boundary, such as a portion of the cover extending inward away from the side surface or edge boundary.

The term "reinforced edge region" as used herein for a cover including a top, bottom or side cover refers to an edge region as described above that includes one or more structural features extending along a substantial portion of the edge region. Such structural features can include the following: a separate structural member attached or connected to the side region; a shape feature formed in the cover material at the side region that provides structural enhancement, such as one or more ribs formed in the material or one or more bends forming a structural feature like a channel; a structural featured defined by the material forming the cover, such as column, beam, or rib structures defined in an extrusion forming all or part of the cover; and/or an insert embedded within a molded cover or portion thereof, such as an injection molded cover or component. In some implementations, each reinforced edge region can include, form or define an attachment surface configured for mated attachment with an attachment surface of another cover and/or an attachment surface of bracket, brace or other platform component.

In some implementations, such as the example implementation shown in FIGS. 9-17 and shown in greater detail in FIGS. 18-21, each of the top cover, bottom cover and side covers include a plurality of reinforced edge regions, in which each reinforced edge region forms a C-channel 2085 along a span thereof with each C-channel forming at least one attachment surface or attachment face 2088. Each C-channel can be formed via bends in the material forming the corresponding cover, such as bends formed in sheet metal material that forms the cover or bends defined in an extruded or molded cover material.

The bottom cover 2053 can likewise be formed similar to the top cover from a thin sheet of material having a length, a width, a plurality of edge regions that correspond with the top cover length and width and edge regions. The bottom cover 2053 can be formed from the same or similar materials as the top cover and in a like manner. As such, each bottom cover edge region can form a C-channel along a span thereof, in which each C-channel has an outer attachment surface. Such a construction for both the top and bottom cover can provide a lightweight, yet sturdy top cover for firmly transferring enclosure retention forces through the enclosure platform to the bottom cover and further withstanding the same. The side covers can be formed from a similar construction and material as the top cover and bottom cover, which can firmly connect the top and bottom covers and effectively transfer forces encountered by the top cover through the platform to the bottom cover, while keeping all covers extremely lightweight.

The platform 2042 can be constructed as a lightweight, yet high-strength structure based on innovative usage, arrangements and combinations of engineering features and concepts. One such beneficial feature includes benefits gained from geometric arrangements of a lightweight material that would otherwise lack structural properties required for an effective platform arrangement, which can include innovative use and arrangements of C-channels along edge regions of each of the top and bottom covers, such as via bending metal sheets or forming similar shapes and constructions in composite sheet materials. As can be seen along with corresponding drawings and as discussed further below, C-channel geometry arrangements along edge regions of the thin sheets forming the top and bottom covers are shaped and arranged to have high area moments of inertia for acting as beams along edge regions of the platform covers. The use of these beams along with their placement and arrangements can form beams having high bending strength along with rigid structural integrity. Further, attachments between adjacent covers can be formed along attachment surfaces of the C-channel geometric beams for thereby connecting beams of adjacent covers to one another for further reinforcement and structural support. In addition, bolted connections or similar between adjacent geometric beams can provide high shear strength support for the platform along the geometric beams via these connections.

As such, the platform 2042 can be formed via a plurality of side covers 2055, 2057, 2059, 2061, 2063 and 2065, which can likewise be formed from thin sheet material along with having arrangements of geometric beams formed along edge regions as C-Channels. However, rather than form C-Channels along all edge regions, each of the side covers can form C-channel geometric beams along each of their top edge region and bottom edge region for attaching to corresponding C-channels of the top and bottom covers for rigidly attaching to each of the top and bottom covers and connecting them together. Further, the C-channels of each side covers being oriented and arranged for attachment with the top and bottom cover C-channels can complement the strength and integrity of one another—particularly for resisting bending and other forces applied to the platform from the enclosure during use.

With particular reference to FIGS. 18-21 along with FIGS. 22-27 depicting usage examples, an example side cover 2055 (front left side cover shown in FIG. 17) is shown in various views for illustrating C-channel beams 2085 formed along the top and bottom edge region of each of the side covers. Bolt or screw attachment holes are shown through the example side cover 2055 extending perpendicularly through each of the C-channels 2085 for attaching directly to a corresponding edge surface (mid C-channel surface) of the top and bottom covers for firmly connecting the top, bottom and side covers to form platform 2042. Such a platform arrangement and construction is generally frameless in that the geometric C-channel beams are integrated within the lightweight cover constructions and rigidly attached to each other in a highly complementary and high shear strength manner to create the high-strength platform structure. In addition, as can be seen in FIGS. 18-21, each of the top and bottom edge regions of each of the side covers can have its high bending strength, low area moment of inertia C-channels further reinforced through the addition of reverse C-channel reinforcement or support bars 2087.

Reverse C-channel support bars 2087 can be formed from the same and/or a different material than the corresponding side covers, top cover or bottom cover. For example, a lightweight aluminum sheet metal material could be used to form all or most platform covers along with having geometric C-channel beams formed in the same, and the reverse C-channel support bars 2087 could be formed, for example, from a higher strength steel sheet metal. Thus, combinations of lightweight and higher strength materials could be combined along with geometric structural features being formed in platform covers for cooperatively providing high strength properties and characteristics needed for effective use of the platform with a DAP System, as well as for keeping component weight and costs low.

Note also that other geometric structural elements could be formed via other shapes, component orientations, connections and arrangements, such that inventive aspects and features described herein are not limited to a particular geometry, shape or arrangement of components. However, as noted above, the C-channel beam construction provides beneficial structural integrity, bending strength, high-shear strength connections and other benefits for forming a support platform. The use of reverse C-channel supports 2087 can significantly enhance such benefits to the platform construction with minimal impacts for costs, weight, noise during use or related effects. As shown in FIGS. 11-21, each of the reverse C-channel supports are arranged in a complementary manner in a reverse orientation, such as a one-hundred-and-eighty-degree orientation with a corresponding side cover C-channel 2085 to which it is mated. Further, each reverse C-channel support 2087 can be sized for nesting within the 'C' opening or gap naturally formed for each of the side cover C-channel top and bottom beams 2085. Thus, a reverse C-channel support 2087 can be nested within each top and bottom C-channel beam 2085 of each of the side covers for providing even greater structural strength and integrity to the platform arrangement.

In particular, each reverse C-channel support 2087 when nested with a corresponding C-channel beam 2085 of a side cover complements the area moment of inertia bending strength characteristics of the corresponding C-channel beam 2085 via its reverse orientation and nesting arrangement. In addition, the nesting arrangement provides double lateral wall support both on the inboard and outboard regions of the combined top beam or bottom beam formed via the nested arrangement of C-channel beam 2085 and reverse C-channel support 2087. As best seen in FIG. 20, each of the reverse C-channel supports 2087 can include contoured gaps 2089 and contoured edge surfaces 2089 formed therein, which can space apart each of the reverse C-channel supports 2087 from a bolt or screw extending through attachment openings defined in the corresponding side cover for connecting to the top and bottom covers. As such, the reverse C-channel supports 2087 can greatly enhance the strength and structural integrity of the side covers and overall platform while avoiding contact with screws, bolts or similar connectors that can increase the likelihood of squeaks or similar noises being created during use.

As further depicted in FIGS. 18-21, sheets of gasket material 2083 can be used with the generally frameless platform construction or other construction arrangements involving support beams attached to one another and the like. Multiple gaskets 2083 are shown in these figures and almost all exploded or assembly related views of the platform 2042. Flat gasket material 2083 can readily be placed between most attachments and connections for platform 2042 for absorbing vibrations or other minor movements during use of the DAP System, which can otherwise create annoying noises, propagate vibrations and potentially allow natural frequency enhanced vibrations to occur that can harm system components along with stressing the user. The use of gasket material between most, if not all, assembly attachments and connections can avoid such annoyances and detrimental circumstances to occur. Gasket material 2083 can generally be formed from a resilient, compressible material, such as a stiff foam material.

Figure 28:
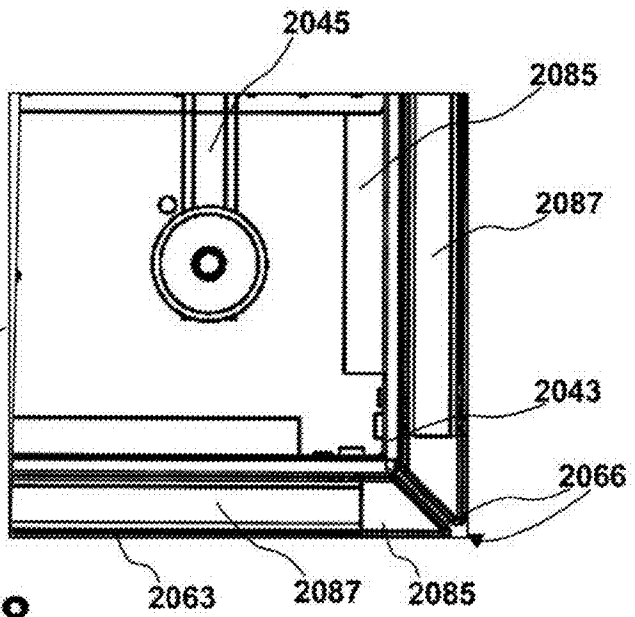
FIG. 28 is a close view of a portion of the platform depicted as a bottom view in FIG. 26 as indicated therein.

Referring now to FIG. 28 along with FIGS. 18-21, corner angles 2066 are generally shown along vertical edge regions of the side covers, such as corner angle 2066 shown in FIG. 18 for front left cover 2055 that forms a region of the front left corner of platform 2042, and corner angles 2066 shown in FIG. 28 along vertical edge regions of rear left cover 2057 and rear cover 2063. As best seen in FIG. 28, a corner gap can exist between corresponding mated corner angles 2066, which can include a gasket 2083. Notably, as further shown in FIG. 28, vertical edge regions 2066 of adjacent side covers including corner angles 2066 can be spaced apart from each other without having any attachments or connections extending therebetween. This design feature can significantly reduce the existence of vibrations and related noise occurring during usage, and can put all gaskets in compression vs. shear when tightening down the covers during attachment, which can often occur along vertical structural connections. Additional structural rigidity, alignment, and reinforcement of the vertical support structure between the top cover 2050 and the bottom cover 2053 can be provided via the use of corner brackets 2043 attached to edge C-channel beams of the upper cover and lower inside of the platform and apart from the side covers. The side covers can also be attached to the corner brackets 2043 along with the C-channel beams of the upper and lower covers via bolts or other connectors extending through the upper and lower cover C-channel beams along with intervening gasket material between the side cover/upper & lower cover connections. Such an arrangement can isolate the side cover connections with vertical corner bracket supports along with damping the same for minimizing the transmission of vibrations or movements through the side covers to other regions of the platform 2042. Corner brackets additionally can help keep the frame rigid when removing one or more side covers to maintain easy alignment for reassembly. The reader shall note that while these brackets are shown in the corners, the location of the brackets, or braces rather, can be along any point on the perimeter and still serve to add in rigidity and alignment.

Figure 10:
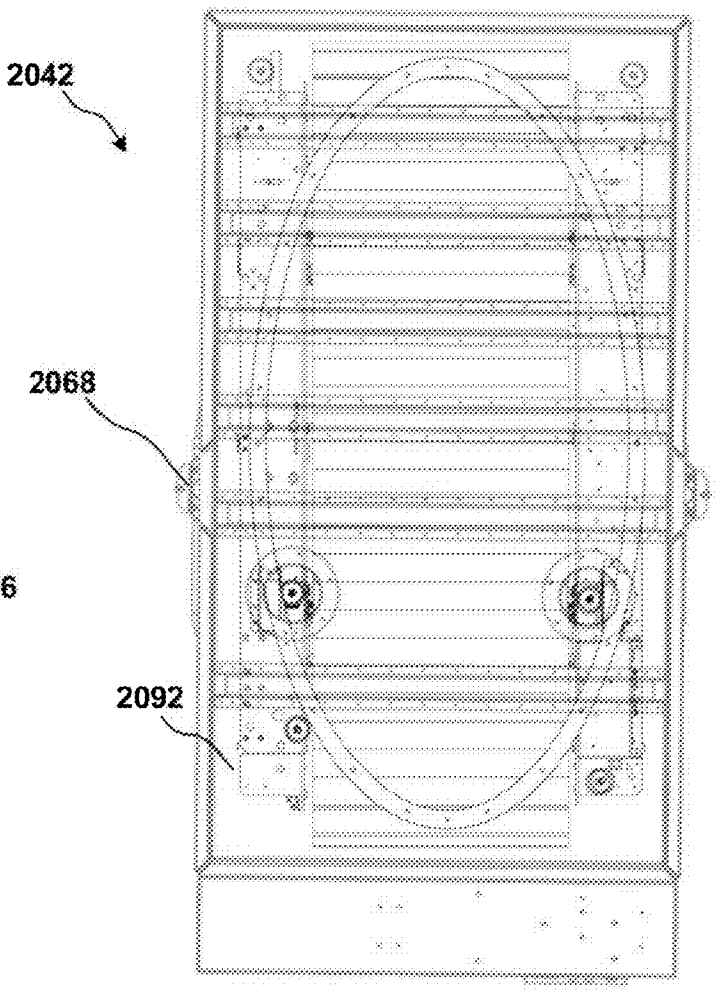
FIG. 10 is a bottom view of the DAP System of FIG. 4A shown without the DAP enclosure and the platform partially transparent showing the example treadmill exercise device located within the platform.
Figure 13:
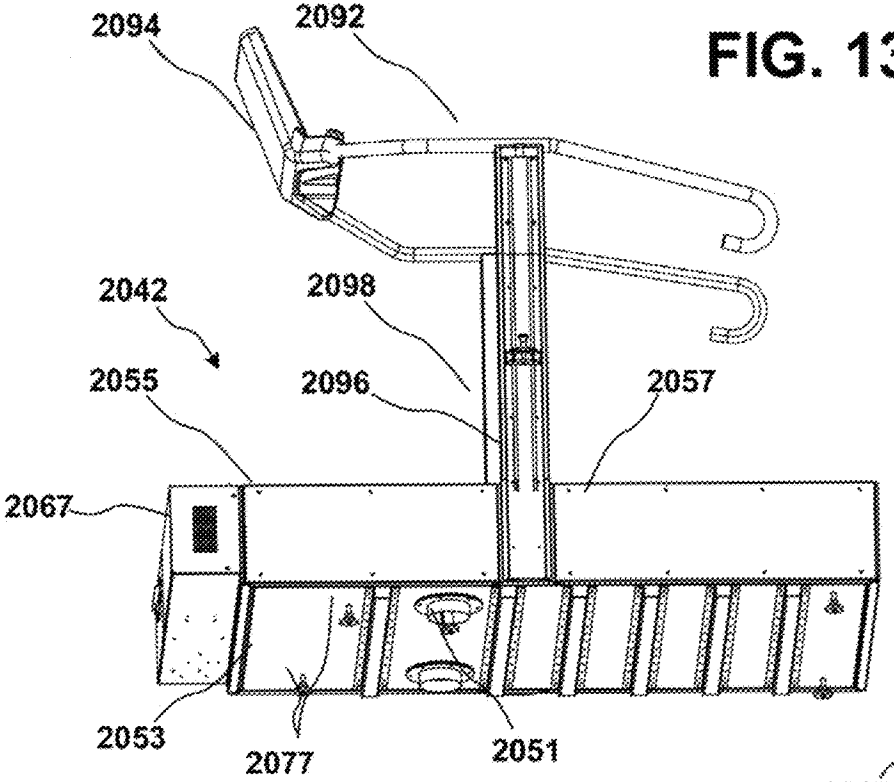
FIGS. 13 and 14 are bottom perspective views of the DAP System of FIG. 4A as depicted in FIG. 12.
Figure 14:
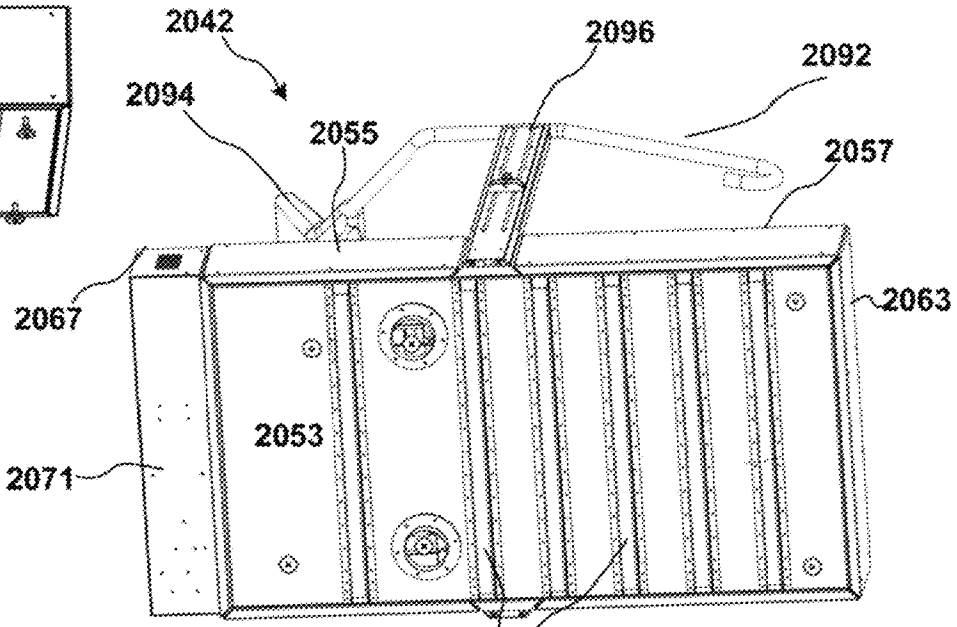
Figure 15:
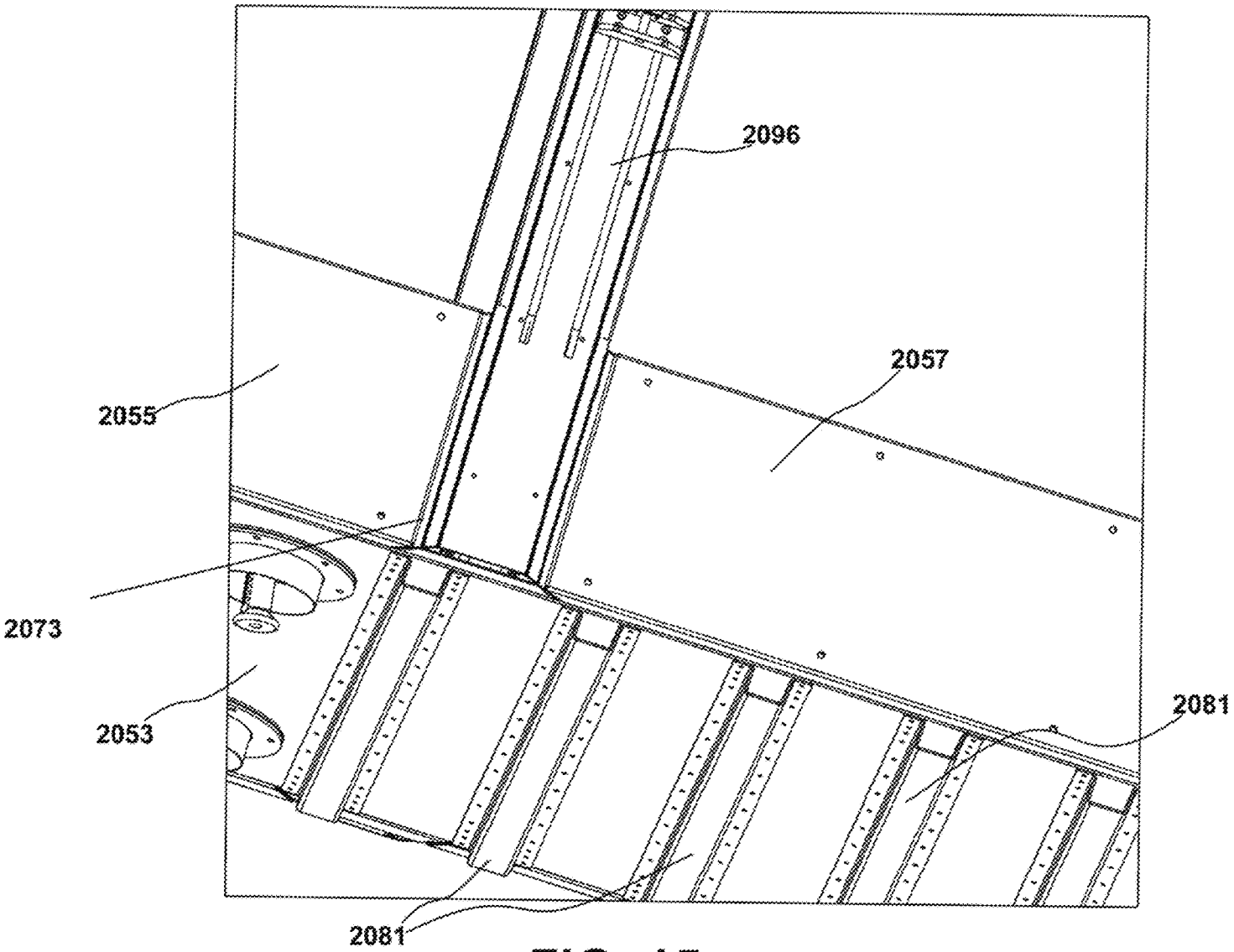
FIG. 15 is a close view of a middle portion of the platform depicted in the perspective views of FIGS. 13 and 14.
Figure 16:
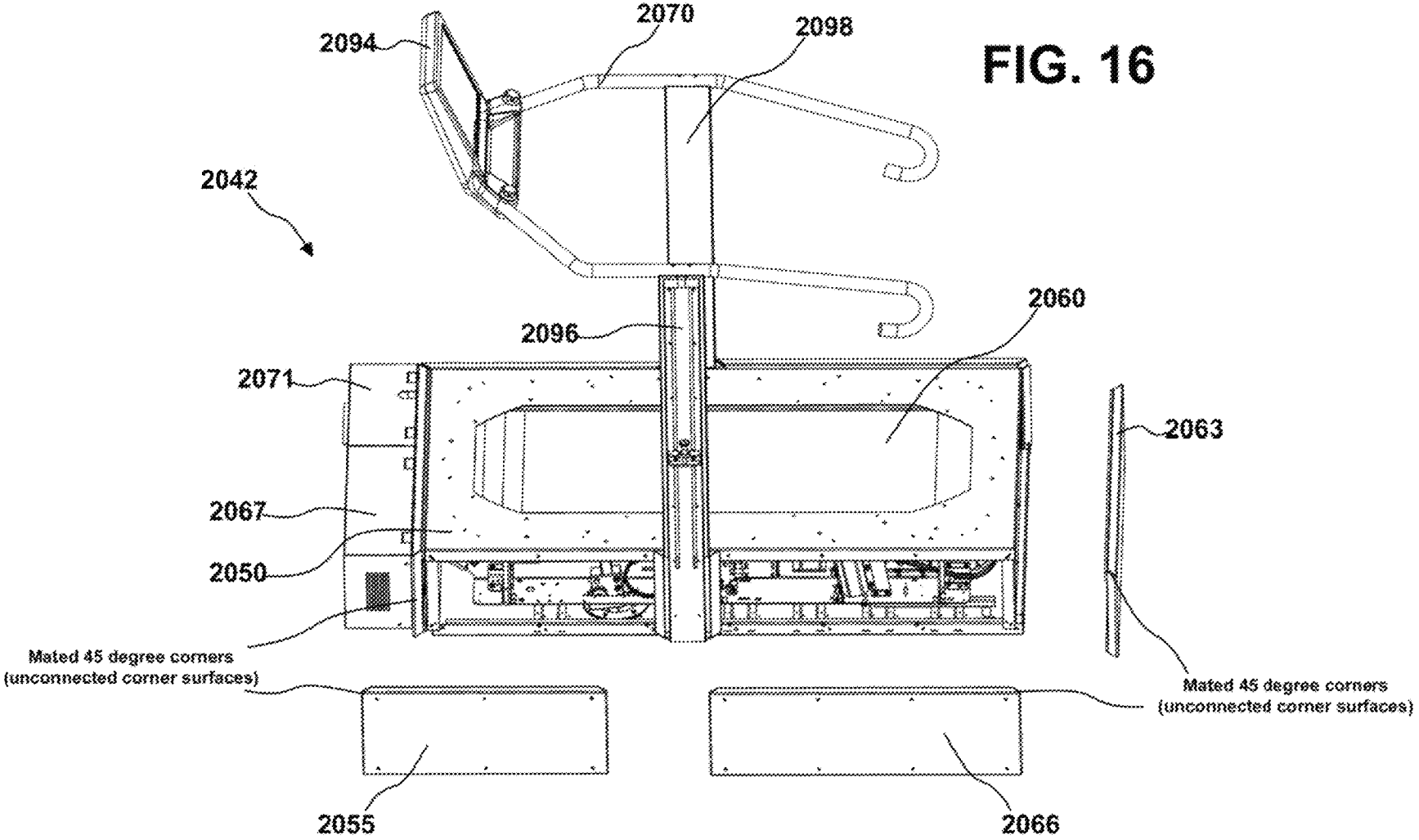
FIG. 16 is a left perspective view of the DAP System of FIG. 4A without the DAP enclosure and showing the platform in a partially exploded view with the example treadmill located therein.
Figure 26:
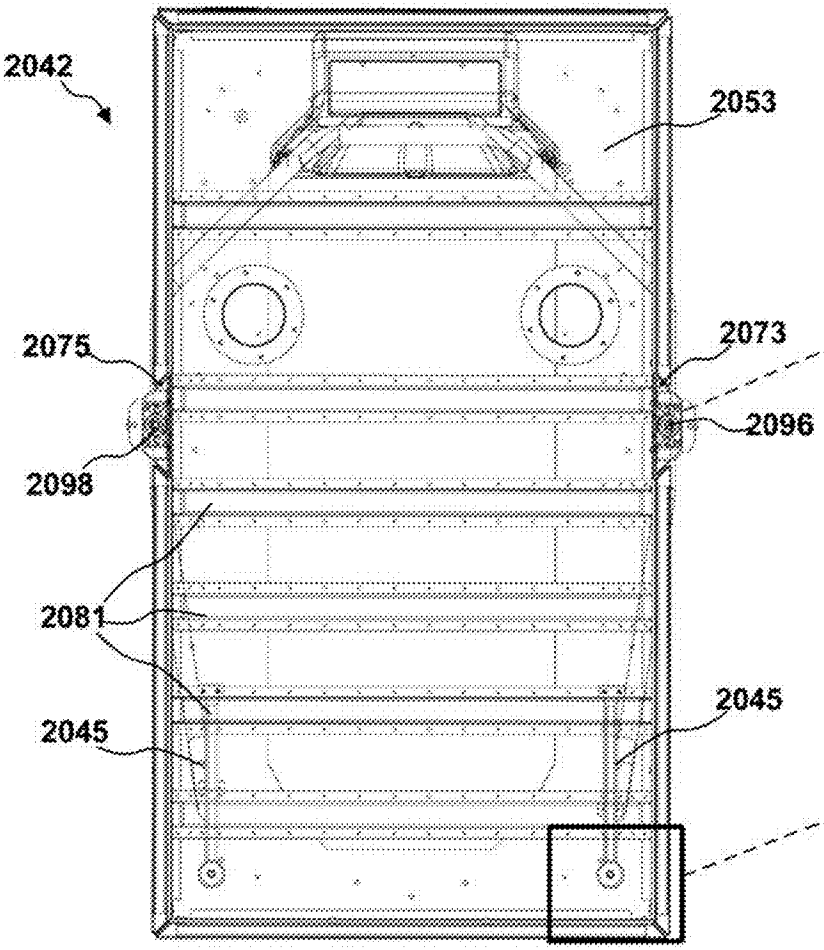
FIG. 26 is a bottom view of the DAP System of FIG. 4A without the DAP enclosure or treadmill depicted, which is shown with the bottom cover and top cover shown as partially transparent.

Referring now to FIG. 26 along with FIGS. 10, 13 & 14, external crossbeams 2081 are shown attached to the exterior of the outer or bottom cover 2053 extending across the width of the platform 2043 and tapered at the ends. Although shown attached at an exterior side of the outer or bottom cover 2053, crossbeams 2081 can be attached at an interior side of the bottom cover and/or attached at both interior and exterior sides thereof. Crossbeams 2081 can be formed from a thin material similar to or the same as material used for the top, bottom and side covers, or can be formed from alternative materials, such as structurally enhanced materials. As shown, the crossbeams 2081 can be formed as a geometric beams similar to formations of C-channel beams of cover edge regions, which can likewise provide a lightweight, yet high strength beam having a high cross-sectional area moment of inertia. Thus, the crossbeams 2081 can likewise provide high bending strength and structural reinforcement properties in their arrangement on the platform along with low weight and low-cost benefits. Crossbeams 2081 can be attached to the bottom cover 2053 via rivets, bolts and the like and provide high strength, structurally sound bottom for the platform. In some arrangements, cross beams may extend all the way to the sides of the base, and may be tapered. Tapering may reduce the risk of pinching the toes of a bystander who is standing next to the machine when the machine is declining. Extending the crossbeams to the sides of the base plate may enhance strength and bending resistance of the base plate. In some cases, riveting, or other attachment points may be higher on the ends as compared to the center portion of the cross beam where the attachment points may be spaced further apart.

Referring now to FIGS. 11B & 11C, example forces that can be applied to the enclosure 2042 along with resultant moments are generally shown based on the attachment of the enclosure base (not shown) to base support 2046 located along the perimeter region of the ellipsoidal base opening defined through the top cover 2050. As depicted, base support 2046 is located proximate edge portions of the top cover at length and width extremes of the base support 2046, which generally experiences the greatest concentration or effects of forces and moments applied to the enclosure via the base support 2046 from the inflated enclosure 2010 during use. Thus, enclosure 2042 experiences significant bending moments applied along its length between the front and rear ends thereof, as well as lateral, widthwise bending moments during use of the DAP System. Geometric beams formed in the top and bottom covers, mated with reinforced double wall, high bending strength geometric beams formed in the side covers as discussed above provide a robust, enclosure arrangement having high structural integrity and strength for resisting such bending along the length of the enclosure along with transmitting the applied forces and moments within the enclosure to the bottom cover 2053 at its base. The series of crossbeams attached to the bottom cover 2053 at its exterior create a high bending strength structure and lattice-type reinforcement construction at the enclosure base, which can effectively absorb and resist the high moments and applied forces applied to the enclosure and passed through to the bottom cover 2053 and base with minimal enclosure movements or flexing.

Thus, various advantageous structural designs, arrangements and features of the platform 2042 can combine together to provide a lightweight, high-strength structural platform for supporting operations of the DAP System and enclosure. Further, such a generally frameless construction arrangement can provide significant benefits and advantages for easy platform access as needed or desired for maintenance and other purposes without affecting the structural integrity of the enclosure and DAP System. For instance, the side covers shown in FIGS. 12 & 16 as partial exploded views can, in fact, readily be removed as shown to quick and easy access to the enclosure and/or exercise equipment (e.g., treadmill) disposed therein. Note also that, as best seen in FIG. 11A, the enclosure 2042 includes aligned supports for the treadmill or other exercise devices retained within the enclosure, and/or openings formed through the bottom cover 2053, which pass through the enclosure to the ground impact forces and other forces from the exercise device during use, such that the enclosure can be directed to providing a robust structural support system for operation of the DAP System including the enclosure without effects from user forces applied directly to the exercise device retained therein.

Figure 23:
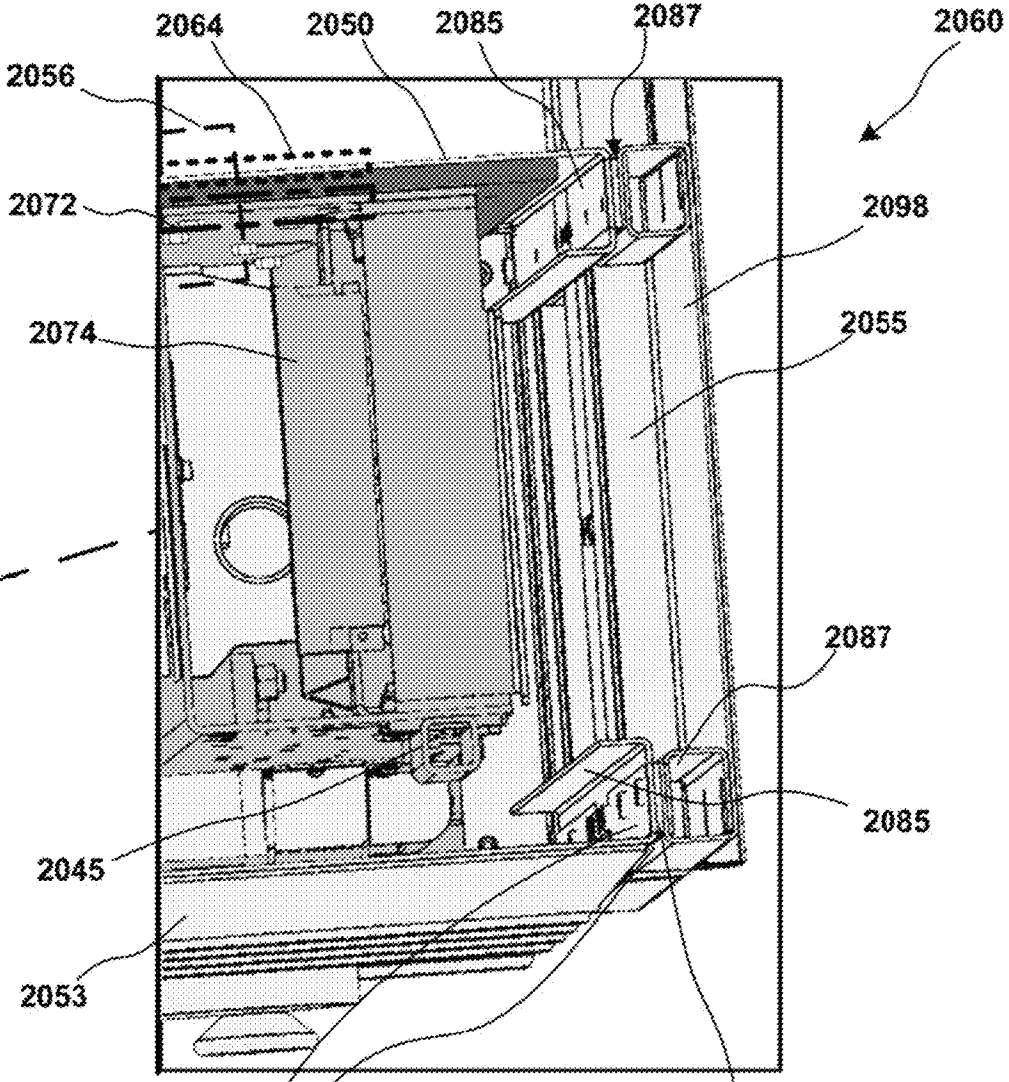
FIG. 23 is a close view of the cross-sectional view focus portion of FIG. 22.
Figure 22:
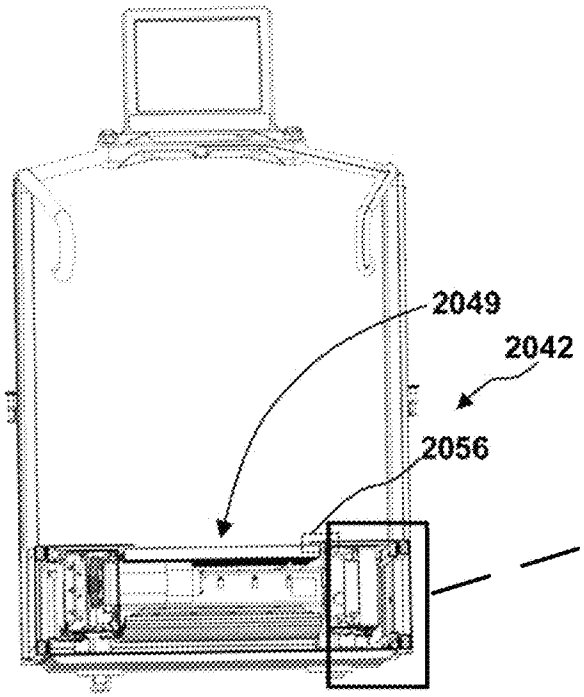
FIG. 22 is a cross-sectional view of the DAP System of FIG. 4A without showing the enclosure as viewed along Line 22-22 shown in FIG. 17, which indicates a focus portion of the platform and example treadmill depicted as close view in FIG. 23.
Figure 24B:
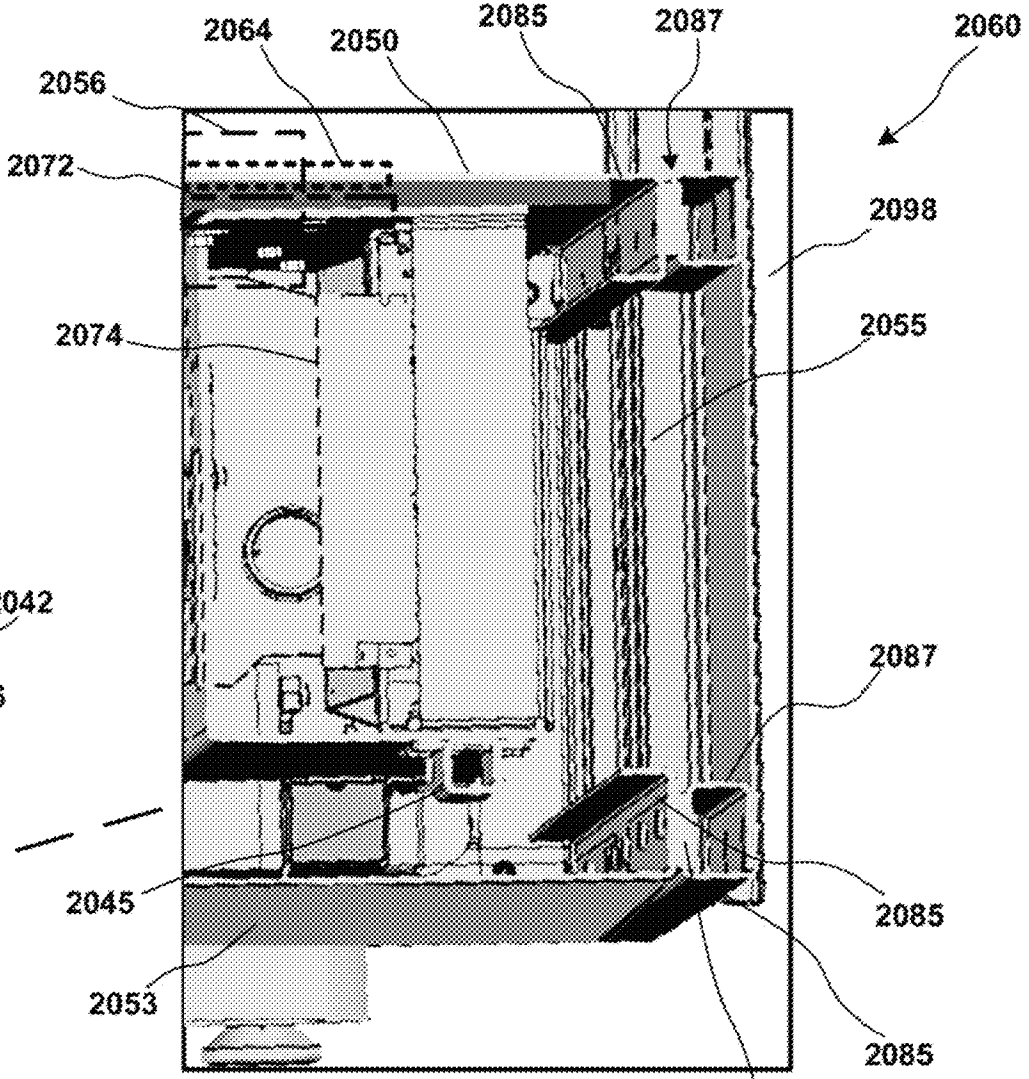
FIG. 24B is a close view of the cross-sectional view of FIG. 24A, which is similarly depicted in shaded view and enhanced contrast for improved depiction of features therein.
Figure 24A:
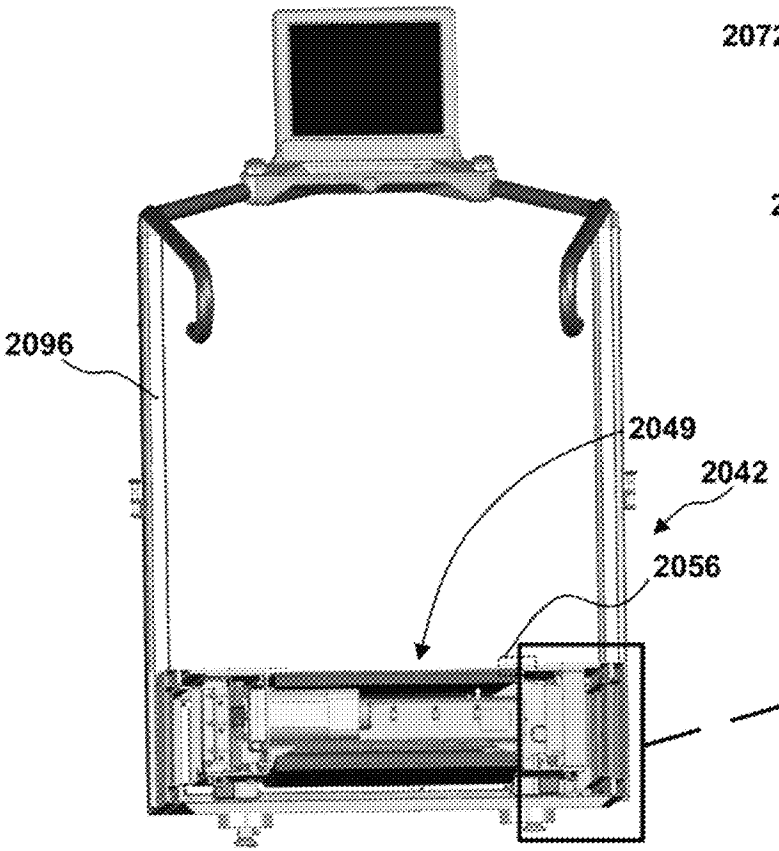
FIG. 24A depicts the same cross-sectional view of the DAP System as depicted in FIG. 22 but shown as a shaded view for increased contrast and clearly for viewing C-Channel features and related platform features.

Referring now to FIGS. 22 to 24B, a portion of support platform 2042 is shown pertaining to interfaces and secure connections between the support platform and the exercise device depicted as a treadmill in the example arrangement including secure connections with a treadmill frame 2074, which can include a pair of inner C-shaped frame structures 2074. As can been in FIGS. 22 and 24A, a perimeter region 2056 extends along the truncated access opening 2049 along which a base opening (not shown) of the inflatable enclosure is secured. As can be seen in FIGS. 23 and 24B, the treadmill 2060 can include a pair of parallel frame structures 2074 that extend along opposite sides of the treadmill in a longitudinal direction thereof, which can be generally arranged as a pair of C-shaped frame structures having a pair of horizontal flanges spaced vertically apart by a wall.

An inner portion 2064 of the truncated access opening 2049 along each side of the access opening extending in a longitudinal direction of the DAP system can be secured proximate the perimeter region 2056 to an upper region 2072 of the treadmill frame 2074 including to each top flange of the C-shaped treadmill frame structures. Further, the bottom cover can be connected to a lower region of the treadmill frame 2074 via a plurality of lower interfaces within the platform extending between the bottom cover and the treadmill frame. In this manner, the treadmill frame can be used as an internal reinforcement structure between the top cover and the bottom cover. Further, the treadmill frame 2074 can cooperate with the platform to receive and oppose upward forces and moments transmitted to the top cover from the enclosure base opening. In particular, the arrangement of C-shaped frame structures extending in the longitudinal direction of the DAP system and the treadmill and secure attachment between the top cover support surface and the top flanges of the frame structures can significantly cooperate with and assist the platform for receiving and opposing moments exerted on the platform in substantially longitudinal directions about the top cover.

Figure 25:
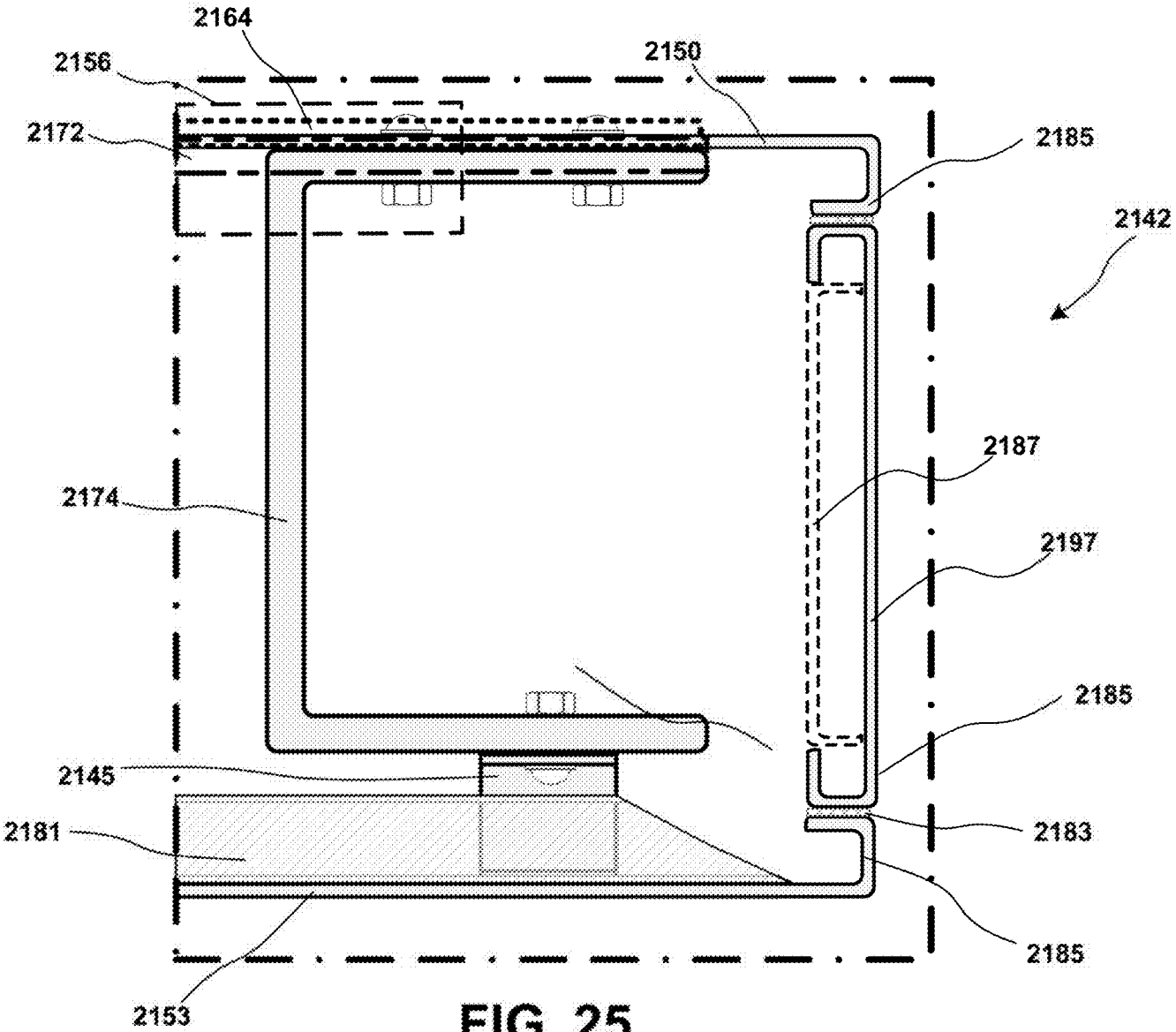
FIG. 25 is a schematic close view corresponding with the cross-sectional views of FIGS. 22 and 24A depicting an alternative platform arrangement including alternative top cover, bottom cover and side cover reinforced edge arrangements and connections therebetween.
Figure 27:
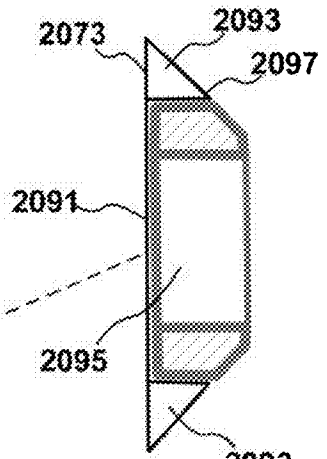
FIG. 27 is an enlarged schematic representation of a lift bracket and a lift pillar attached to a side portion of the platform shown in FIG. 26.

Referring now to FIG. 25, an alternative platform arrangement is shown that generally includes the same aspects and features described above for platform 2040, excepts as described hereafter. Accordingly, like numbers refer to like features. Platform 2140 schematically depicts various options or alternatives regarding various features described along with platform 2040, which are shown together as an example arrangement of platform 2140. However, as with platform 2040, aspects and features described for platform 2140 can be incorporated individually and/or in various combinations and arrangements according to aspects and features of platforms described herein.

As depicted in FIG. 25, reinforced edge regions of each of the top cover 2150, the bottom cover 2153 and the side covers 2197 can form various types and arrangements of integrated support members and matingly connect with adjacent reinforced edge regions along different attachment faces while maintaining structural strength and integrity, as well as independent access and removability of the side panels. In particular, as an additional example having C-channels formed along the reinforced edge regions, upper and lower attachment faces respectively of the bottom and top covers can matingly connect with lateral attachment faces along the upper and lower reinforced edge regions of the side covers. Further, a plurality of bottom crossbeams 2181 can be attached to the bottom cover 2153 at an internal side of the bottom cover instead of at an external, lower side of the bottom cover, and/or at both internal and external sides of the bottom cover. Further, robust lower interfaces 2145 can be used for securely attaching lower regions of the treadmill frame 2174 to the lower cover 2153.

Figure 29:
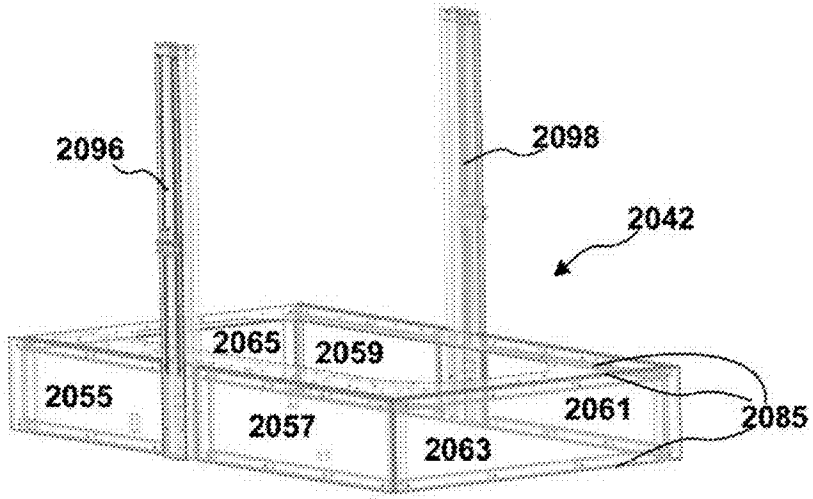
FIG. 29 is a rear, perspective view of the platform of the DAP System of FIG. 4A shown with each of the panels or covers depicted as partially transparent.
Figure 30:
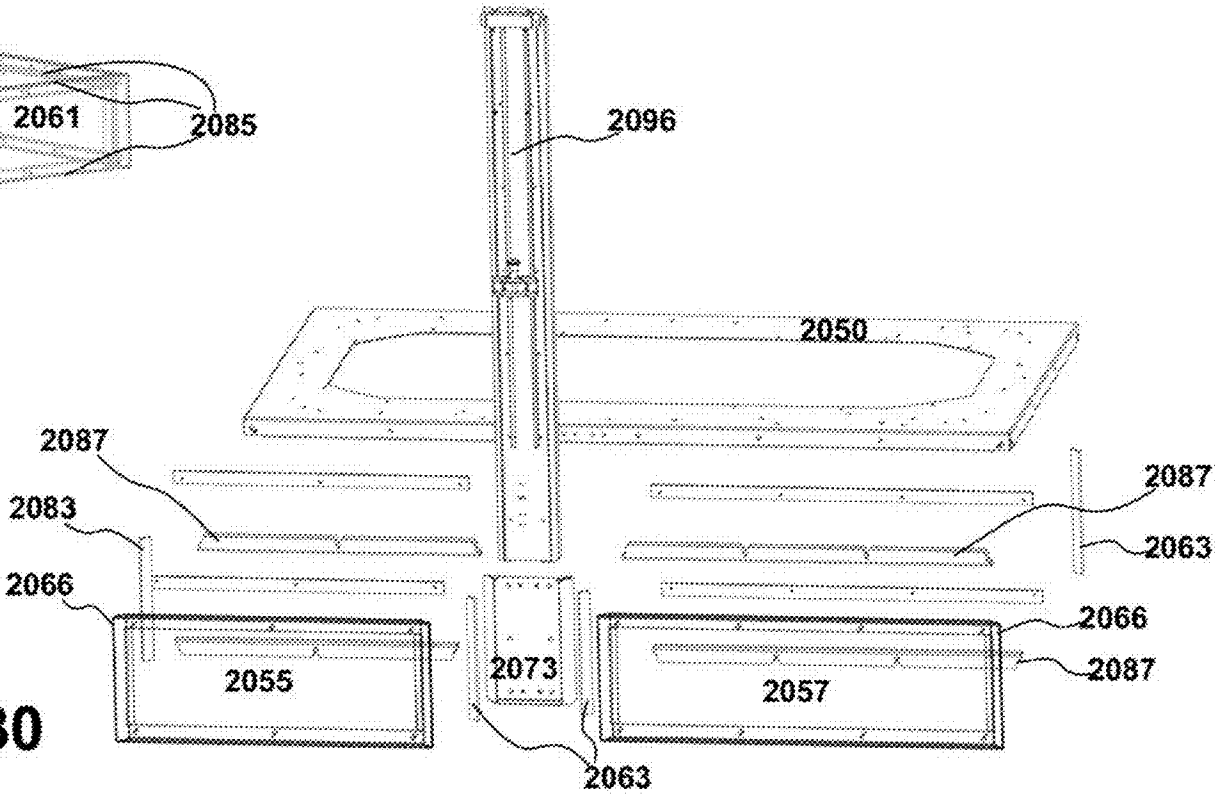
FIG. 30 is a left, side perspective view of components of the DAP System platform of FIG. 29 shown partially exploded, which includes a top cover, front left cover, rear left cover, left vertical lift, and left lift bracket of the platform.

Referring now to FIGS. 29 to 36, aspects and features are shown related to an optional arrangement for incorporating vertical lifts with the enclosure arrangement and construction, as well as optional handrails connecting top portions of the vertical lifts. Although vertical lifts and handrails are shown in other figures including figures pertaining to describing example aspects and features of the enclosure 2042, it is understood that vertical lifts, related support brackets, handrails and other features are optional features that are not required as integral features pertaining to the example enclosure arrangements and features discussed above. As best seen in FIGS. 29 & 30 along with FIG. 28, a pair of vertical lifts 2096 and 2098 can be attached to the platform 2042 and can further be integrated into the platform structure, which can enable the vertical lifts and platform structure to cooperate with each other enhance overall stability and structural integrity of the platform 2042 along with firmly supporting the arrangement and orientation of the pair of lift for improved lift operations. Each of the vertical lifts can be integrated into the platform structure via a lift bracket 2073 for each vertical lift disposed on opposite sides of the platform around a middle region thereof. Each vertical lift can firmly attach to the C-channel beams of each of the top cover 2050 and bottom 2053 for rigid connection with the platform. In addition, each lift bracket can supportively engage adjacent side panels 2055, 2057 & 2059, 2061 located to the front and rear of each bracket for enhanced attachment and integration of the lift brackets into the platform structure. Further, each of the lift brackets can provide structural support and reinforcement for the platform along its middle region, which can bolster bend strength, rigidity and structural integrity of the platform along its side regions and its mid portions where high enclosure forces are encountered along with resultant moments. Lift brackets can also improve alignment along the long edges of top and bottom covers, so that holes for attaching side covers stay within tolerance and avoid stripping of threads.

Figure 31B:
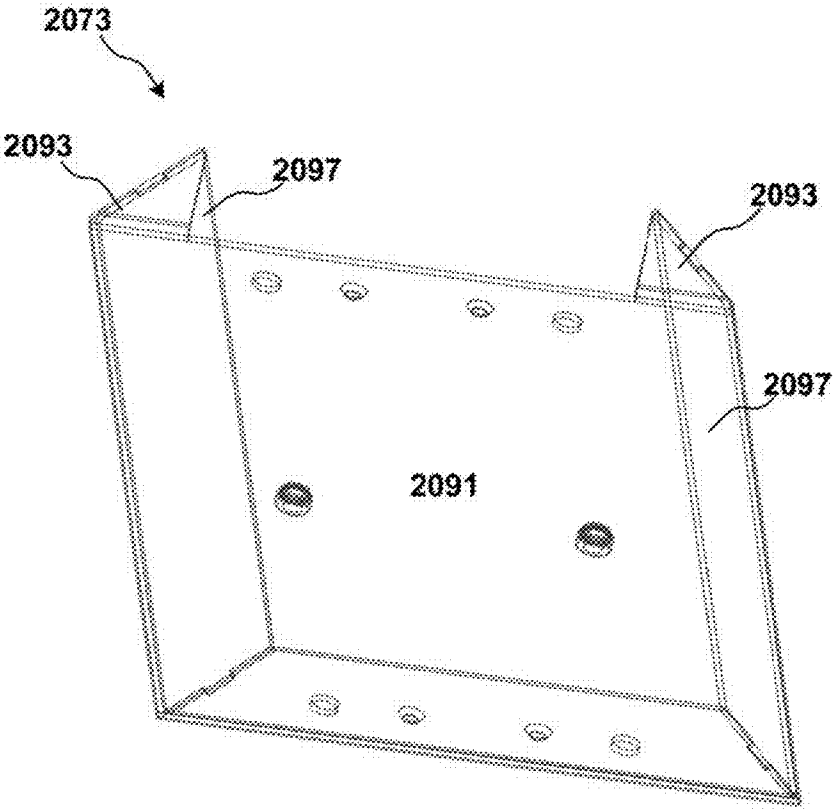
FIG. 31B is a rear perspective view of the lift bracket of FIG. 31A.
Figure 31A:
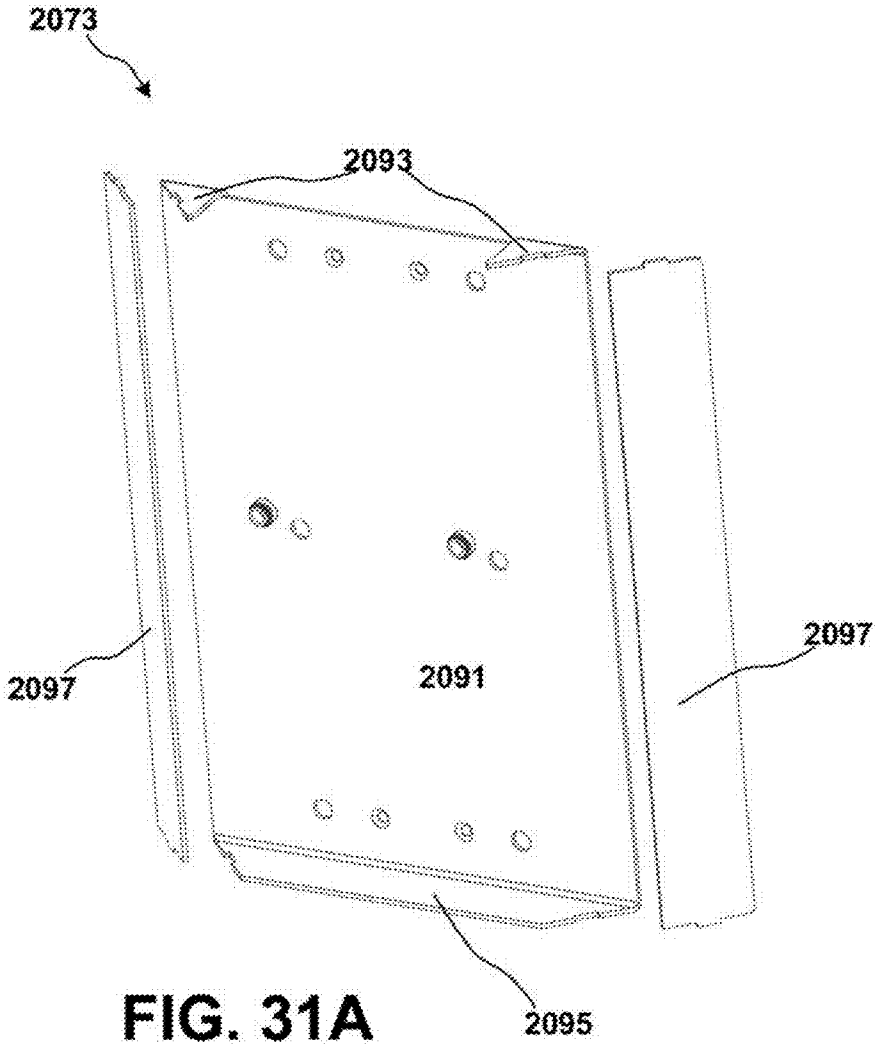
FIG. 31A is a front perspective view of the lift bracket of FIG. 30 shown in an exploded view.
Figures 32, 33:
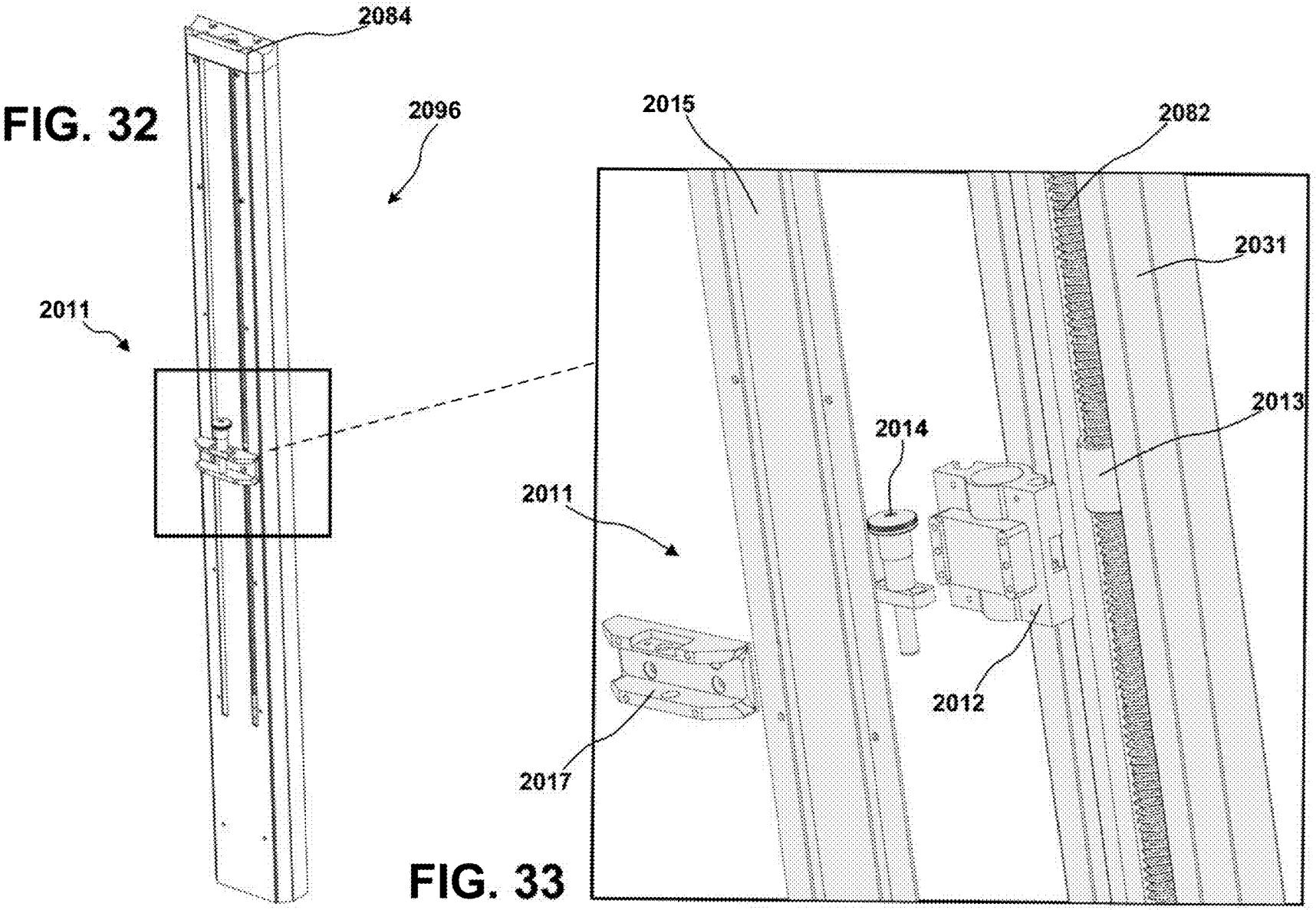
FIG. 32 is a left perspective view of the left vertical lift shown in FIG. 30.
FIG. 33 is a close, perspective view of a portion of the left vertical shown in FIG. 32 according to the region identified in FIG. 32, which is shown in a partially exploded view.

Referring now to FIGS. 31A and 31B, an example arrangement for the left lift bracket 2073 is generally shown, for which it is understood that the right lift bracket can have the same arrangement as a mirror image version of the left lift bracket 2073. As shown, left lift bracket 2073 includes a side base plate 2091, a base 2095 at its bottom end, and a pair of triangular, spaced apart top flanges 2093 at its opposite upper end. A pair of angled supports 2097 attach to a corresponding one of the top angled support flanges and extend downward to attach to angled portion of the base 2095 and provide a sealing surface for a gasket. In this manner, each of the lift brackets 2073 form a support assembly bracket arranged to cradle vertical support components of corresponding lifts between the pair of angled support flanges 2083 and the corresponding pair of angled supports 2087, and support the lift upward from the base 2095. The side base plate 2091 can include multiple attachment holes for firmly attaching each lift bracket to the top and bottom C-channel beams at each side, and may similarly contain alignment features, such as countersunk holes, pins, or studs, for aligning the vertical spacing between the top and bottom covers. For instance, a pair of inner holes can be provided for firmly attaching each lift bracket to the C-channel beams, and a pair of outer holes can further be provided for allowing a vertical lift pillar 2031 (see FIG. 33) to also firmly attach to the corresponding top and bottom cover C-channel beams along pillar columns that can be formed therein. The lift pillar can attach to the C-channel beams through the corresponding lift bracket for further enhancing the rigid connection between the lift brackets and top and bottom cover C-channel beams. As such, each of the lift brackets can be firmly integrated into the platform structure for securely connecting the lifts with the platform, and the lift brackets further reinforce the platform structure along its middle region by connecting the top and bottom C-channel beams to each other vertically along with assisting with the transmission of forces encountered by the top cover 2050 to the bottom cover 2053 and through the platform.

As best seen in FIG. 30, each of the adjacent side covers can be arranged and placed to reinforce each of the lift bracket structures as needed while also form an angled, spaced apart arrangement with the angled supports of each lift bracket similar to the angled corner arrangements of the corners. In such an arrangement, unnecessary contact, vibrations and related noise effects can be avoided based on movements between adjacent side covers and each lift bracket while having the side covers arranged in close proximity for supporting each of the lift brackets as needed. Further, such an angled, gapped arrangement between adjacent side covers and each of the lift brackets enables ready removal of the side covers as needed for quick access to the interior of the platform without removal of the side covers significantly impacting the structural integrity of the platform or lifts. Gaskets may be placed along these angled edges in order to ensure a seal with the machine, and the lift brackets may allow for removal of a lift column while maintaining the airtight seal, which may aid in production line testing and packaging. I.e. it may be convenient in mass production to build an enclosed base and exercise machine, test it for airtight-ness, and then box it and pack and store it for later use. Lift columns add bulk and weight and are more cumbersome to work with than a bracket, thus a bracket may speed in manufacturing efficiency.

The spacing and sizing of the lift column bracket width and height may be important for creating a rigid post for attachment of a console or handrails. It was found in testing the top mounted handrails, mounted only to the top cover, do not offer substantial rigidity and therefore may not be optimal as a gripping surface. Further, these handrails may be susceptible to outboard bending from the enclosure, and thus may be required to be placed in 4 corners in order to escape the high side loading from the enclose. Such a configuration is shown in FIG. 2A. However, a more efficient column and rail configuration may be to have only two lift columns approximately in the middle of the DAP system as in FIG. 4A with console cantilevering on the front and handrails cantilevering on the back in a balanced configuration. Such an arrangement reducing contact points with the base, holes going through the top cover into the sealed compartment that can leak, and aesthetically forms a less intimidating structure. However, the two lift columns form the only point of strength for the handrails and console which must remain rigid to provide a good, safe, smooth user experience. As shown in FIG. 4A, lift columns, through lift column brackets, form an extremely strong and cross-braced structure in all directions due the width of the columns themselves and the spacing between the vertical and horizontal attachment points on top cover and bottom cover. Forces and moments from a user grabbing a handrail is countered by the width of the lift column and the 4 point contact it has with the top and bottom cover. Force from someone hanging on the front area similarly is countered by the four bolt connection to the top and bottom cover. The largest loads will occur from the enclosure pressure. While aided by the enclosure being a self-supported style of enclosure with minimal width, the tight arrangement of the lift column and frame in FIG. 4A still has and shows bag pressure trying to splay out the lift columns away from one another. In the case of top attachments, there would be little bending counter-moment to prevent this splaying and possible deformation. However, due to the vertical spacing between the top and bottom cover, the lift column will fulcrum around the connection at the top cover, and counter the splaying moment with the connection at the bottom cover which is put in compression. The thickness of the lift column profile, as in FIG. 37 this provides sufficient rigidity to resist deformation and splaying and this was tested in practice up to 2×the operating pressure of the machine. Preferably, the width of the lift column may be between 4-8 inches, and more specifically 5-6 inches and the thickness of the lift column may be 1-3 inches and preferably about 2 inches. The width and vertical spacing between the connection points to the top and bottom cover may be between 3-7 inches and 4-12 inches respectively, and preferably about 4 inches and 10 inches respectively.

Referring now to FIGS. 32, 33, 35 and 36, various components, aspects and features of an example arrangement for the left vertical lift 2096 are generally shown. Again, it is understood that the right vertical lift 2098 can have the same construction and arrangement as a mirror image of the same. As shown, left vertical lift 2096 can generally include a vertical lift pillar 2031, a powered rotatable threaded drive screw 2082, a driven slide or carriage 2012, and a motor (not shown) along with drive connections (not shown) between the motor and drive screw 2082. Each lift 2096, 2098 operates as a powered, linear drive mechanism for raising and lowering the carriage 2012 along an outboard side of each lift as driven by rotation of the powered drive screw 2082.

Figure 36:
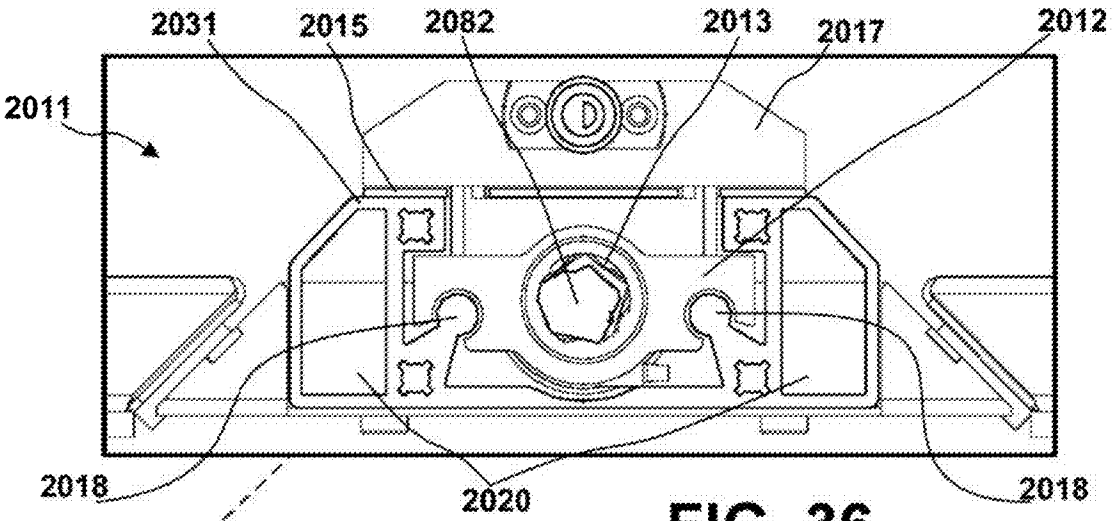
FIG. 36 is a close cross-sectional view of a portion of the left vertical lift and corresponding lift bracket as indicated in FIG. 35.
Figure 35:
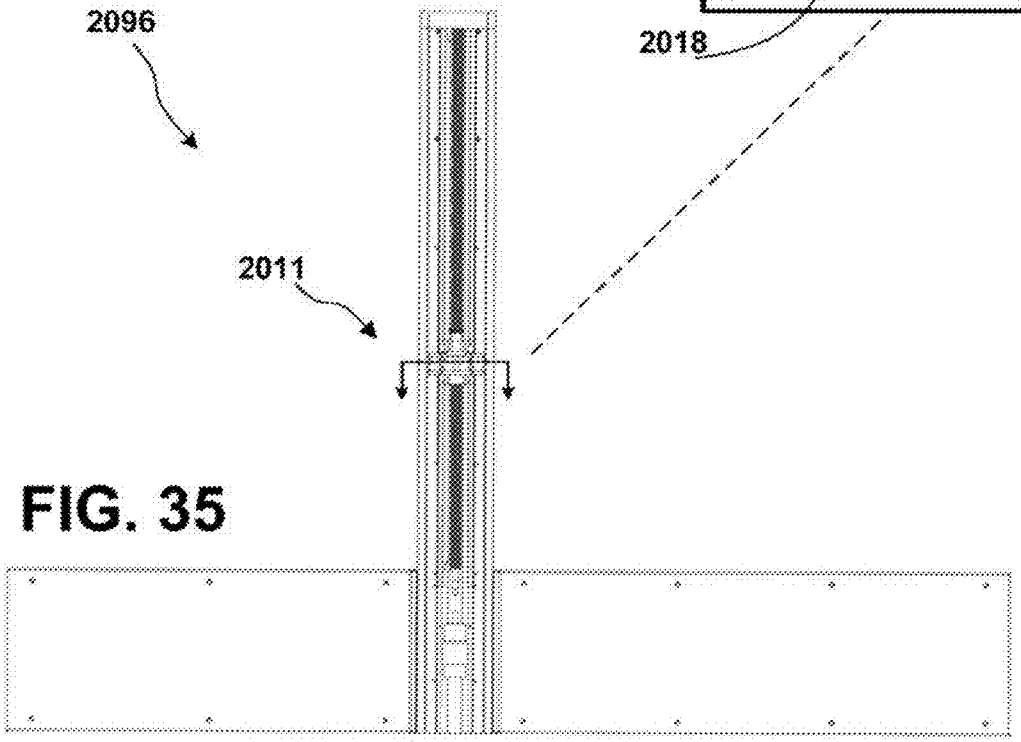
FIG. 35 is a left, side view of a subset of components of the platform shown in FIG. 29, which depicts the front left cover, rear left cover, left vertical lift and left lift bracket.

The lift pillar 2031 provides a vertical support for the corresponding lift and thereby extends substantially the full length of the vertical lift including from a secure attachment at its base end with the corresponding lift bracket and extending upward for the height of the lift with the exception of a top cap or bracket at the upper end of each lift for supporting an upper end of each drive screw and/or interfacing with a handrail or other structure. The lift pillar can be formed as an aluminum extrusion 2031 having a pair of parallel internal rails formed along a travel length of the lift for supporting movement of a carriage vertically as driven by the linear drive mechanism. The extruded lift pillar can further form a central opening along its length for placement of a drive screw therein along with a drive motor (not shown) connected thereto at a lower end portion for rotating the screw. A front slide cover 2015 attached to a face of the lift pillar can provide a smooth slide surface for the carriage to slide along during lift operations. As shown, the slide cover 2015, slide surface, and carriage slide 2012 can be arranged on the vertical lift at an outboard surface thereof facing away from the enclosure for avoiding contact damage with the enclosure. As can be seen in FIG. 36, the lift pillar 2031 can form a pair of parallel internal support columns 2020 disposed along edge portions of the pillar and extend along its length, which can enhance rigidity and structural integrity for the lifts while in a lightweight arrangement. A top support can be attached to a top portion of each lift pillar for connecting with lower portions of a handrail along with supporting an upper end of the drive screw.

When driven by rotation of a motor, such as can be located at a bottom end of each vertical lift, rotation of the drive screw 2082 causes drive screw threads to engage corresponding threads within a carrier 2013 located on the drive screw and thereby move up or down base on thread engagement. Carrier 2013 can be attached to a carriage 2012 supported in a vertical sliding arrangement against a pair of vertical rails 2018 defined within each vertical pillar 2031. In addition, the carriage 2012 can be attached to an external carriage slide 2017 via a pair of thin support arms extending through slots formed in the slide cover 2015. The width of the thin support arms is preferably less than 8 mm to avoid pinch hazards. As such, upon movement of carrier 2013 as driven vertically up or down by the drive thread, carriage 2012 correspondingly slides vertically along its pair of rails while its support arms extending outward engage carriage slide 2017 to slide in like manner and direction vertically along the surface of the slide cover 2015. Thin support arms allow for an efficient and aesthetically pleasing cover arrangement while minimizing the potential pinch hazards of a moving surface. Optional brushes, sweeps, or rail guards may further be added to keep debris out of the lift column.

Figure 37:
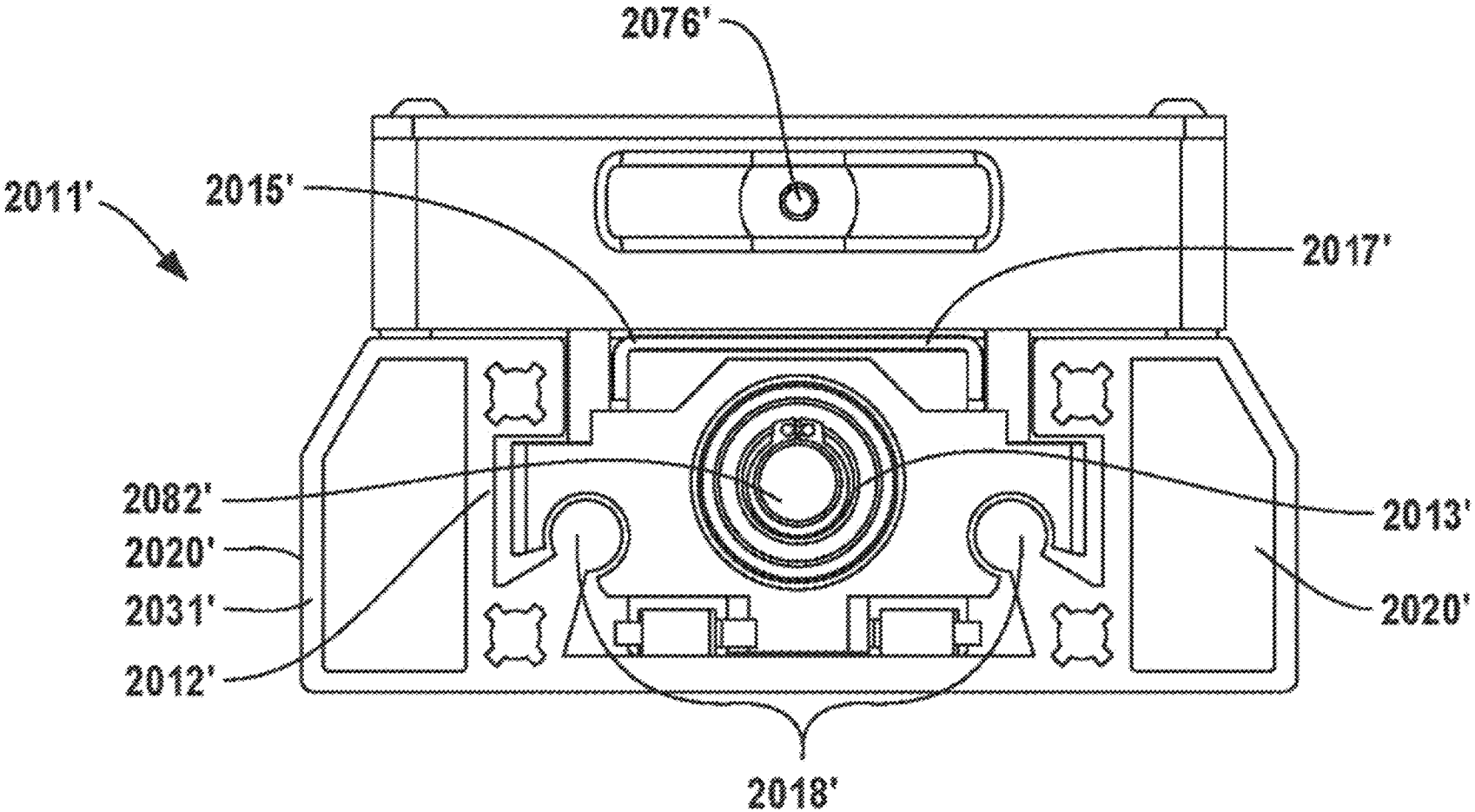
FIG. 37 is a close, cross-sectional view of an optional arrangement for left (and right) vertical lift including showing a different arrangement for the carriage and related driven lift components.
Figure 38:
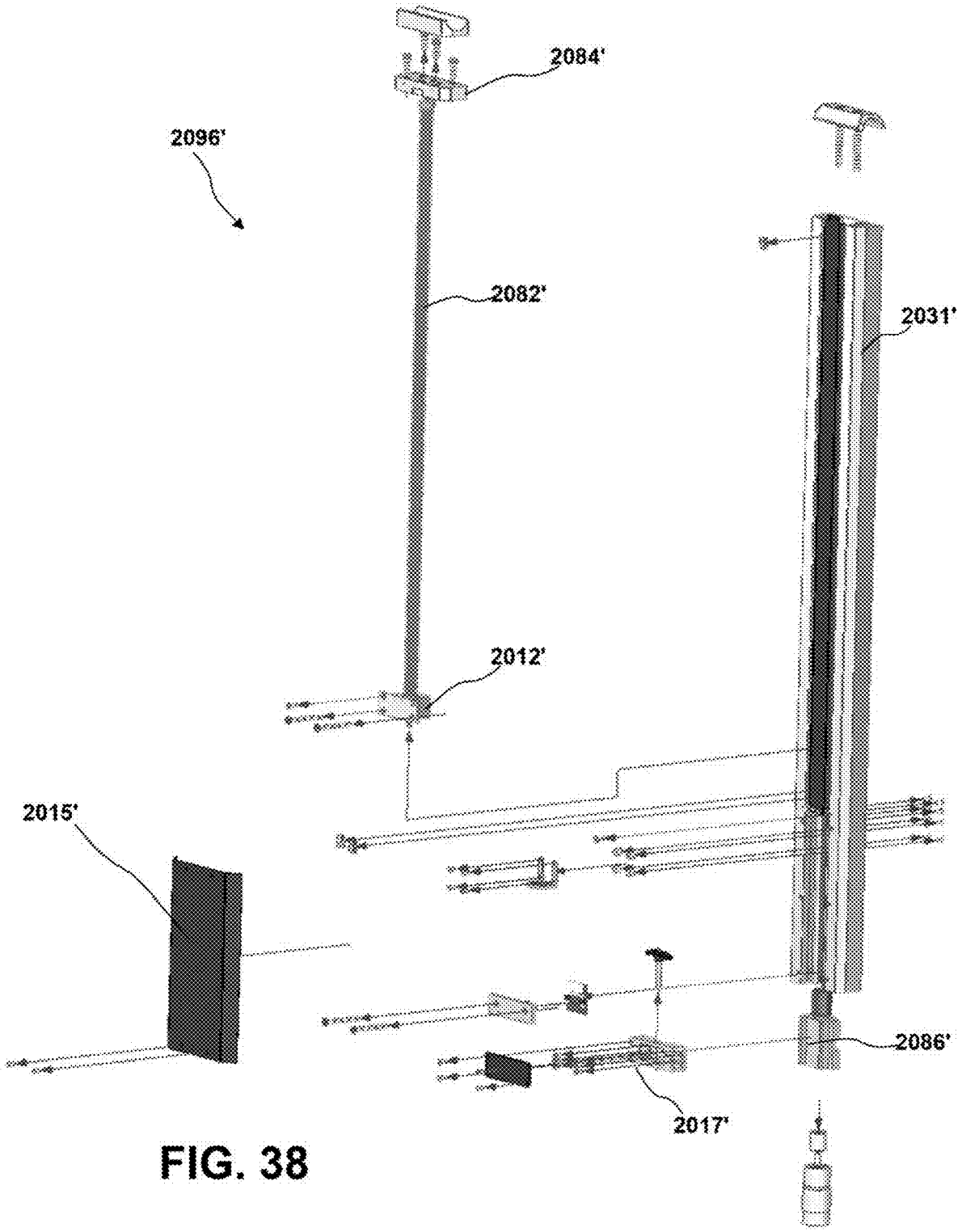
FIG. 38 is an exploded left or outboard, rear perspective view of the optional arrangement for the left vertical lift of FIG. 37.
Figure 40:
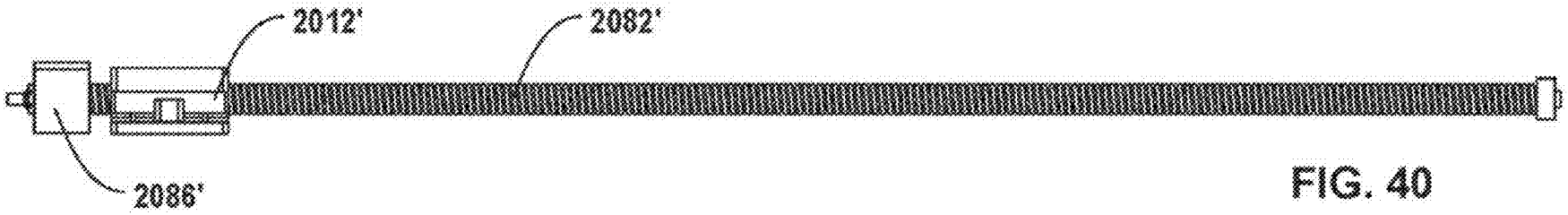
FIG. 40 is a plan view of the threaded screw drive of the optional arrangement for the left vertical lift of FIGS. 37-39 along with related components.
Figure 39:
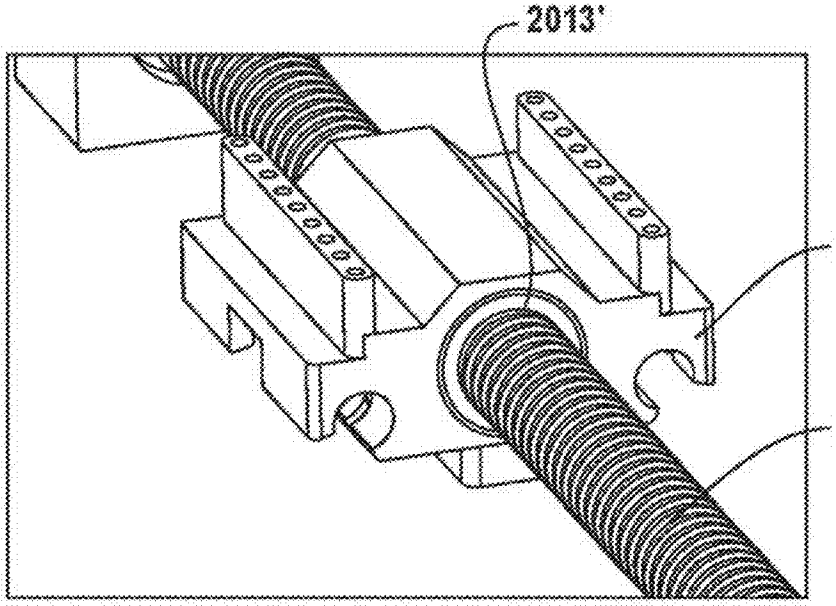
FIG. 39 is an upper, outboard perspective view of the threaded drive screw, driven carriage, carrier and related portions of the optional left vertical lift arrangement of FIGS. 37 and 38.

The example arrangement of vertical lift 2096 & 2098 includes various beneficial features for working with and enhancing arrangements of the platform, such as integrated attachment of the vertical lifts with the platform via lift brackets as discussed above. Further, use of an aluminum extrusion lift pillar cooperates with lightweight, high strength features of the platform, such that an aluminum extrusion support system can reduce weight and costs compared with other support structures, such as steel columns. In addition, use of an aluminum extrusion arrangement for the vertical pillars allows for custom shaping of the pillars, such as to form a pair of outer, hollow support columns along each side of the pillars through which cabling may be routing while remaining hidden from the user for example. These columns provide lightweight support based on their hollow construction while forming geometric high strength columns having high cross-sectional area moments of inertia for providing high column strength and bending resistance for the vertical lifts. Further, the use of aluminum extrusions allows rails to be integrally formed along with the vertical pillars for the carriage to slide upon, which reduces the need for additional rail components. In addition, customization options for the rails allows for beneficial arrangements of the rails, such as angled rail orientations as shown in FIG. 37 for providing enhanced retention and control of the carriage while vertically sliding thereon. Other features and benefits can include reduced interference and 'snags' with the enclosure while inflated based on arranging each of the vertical lifts as an outboard facing linear drive, such that the vertically movable carriage slide 2012 faces away from the enclosure and potential engagements therewith. Other advantageous features can include the use of limit switches 2014 (FIG. 33) as well as other sensors, such as proximity sensors or accelerometers, which can detect potential harmful movements or circumstances, such as an out-of-position user.

Figure 34:
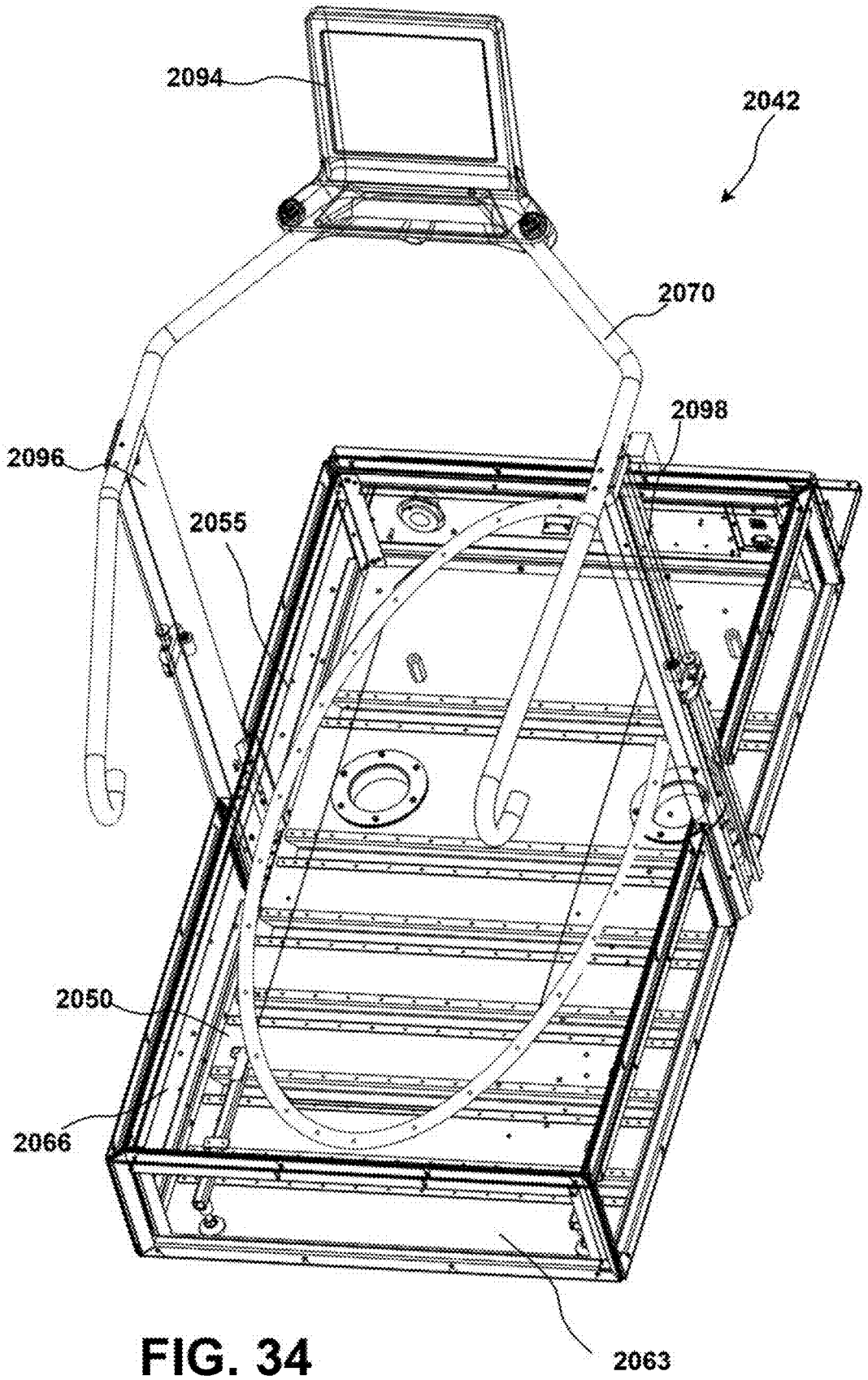
FIG. 34 is a rear, top perspective view of the DAP System of FIG. 4A shown without the enclosure, omitting a blower box and electronics box at a front portion of the platform, and with the platform covers or panels shown partially transparent for depicting the structural arrangement of the example platform as a frameless assembly of removable panels attached along integrated C-Channel columns.

Referring now to FIGS. 37 to 40, another arrangement of an example vertical lift (e.g., left lift 2096') is generally shown. Left lift 2096' generally includes the same aspects, features and preferences as left lift 2096 except as discussed hereafter. As such, like numbers refer to like features. As best seen in FIG. 37, the carriage slide 2017' of left vertical lift 2096' includes a housing enclosure formed around its exterior, which protects against inadvertent user contact, enclosure contact, or other contact being made with the restraint attachments. A restraint pin 2076' can be disposed within the housing enclosure for retaining the restraint attachments, which can optionally be arranged for external withdrawal by a user for readily releasing the restraint attachments. In other arrangements, such as shown in FIG. 34, a unitary handrail can be attached to top portions of the left and right vertical lifts for thereby connecting the lifts to each other at their top ends along with providing a beneficial handrail arrangement. Forming the handrail 2070 as a unitary rail, such as from a contiguous bent pipe or pole, can further enhance the stability of the platform and integrated vertical lift arrangement by structurally supporting each of the lifts at their top ends with each other along with providing firm structural support as their bases integrated with the platform. As shown, the unitary handrail 2070 can be arranged to have a general U-shape for avoiding interference with the user and optionally providing a support for a terminal or interactive panel forward of the user. In addition, the unitary handrail can act as a stabilizer spring bar configured for damping vibrations and other movements induced during use and propagated through the vertical lifts, as well as applying a restoring spring force in both inboard and outboard directions to return the vertical lifts an initial static position.

An additional benefit of the design as shown in FIG. 29 is that the framing absent the treadmill forms a hollow compartment which may be filled with additional parts for shipment. The top plate, bottom plate, and side covers and lift column brackets may be connected to form the outer protective layer, while more sensitive electronics, screens and other components may be packed inside. In this way, a kit may be assembled with a rigid and strong outershell, that protects the remaining contents required to add to an existing exercise machine for building up a DAP system in a very volume efficient manner. Also, as mentioned above related to squeaking and reducing noise during inflation or from vibration, rivets or other fasteners may be installed with a non-metallic interface such as a silicone or polyurethane glue, or plastic washers. Thus, as the metal expands under pressure, metal doesn't rub on metal and cause audible noise. As mentioned above, the angled ends of the covers and the lift brackets create sealing surfaces that may be covered by gaskets for sealing airtight. The nature of the angles are such that when tightening bolts which pull the covers directly toward the sealing surface, the angled ends similarly become compressed without limiting the sealing capability on the long flat edges of each side cover and top and bottom plate.

Figure 41:
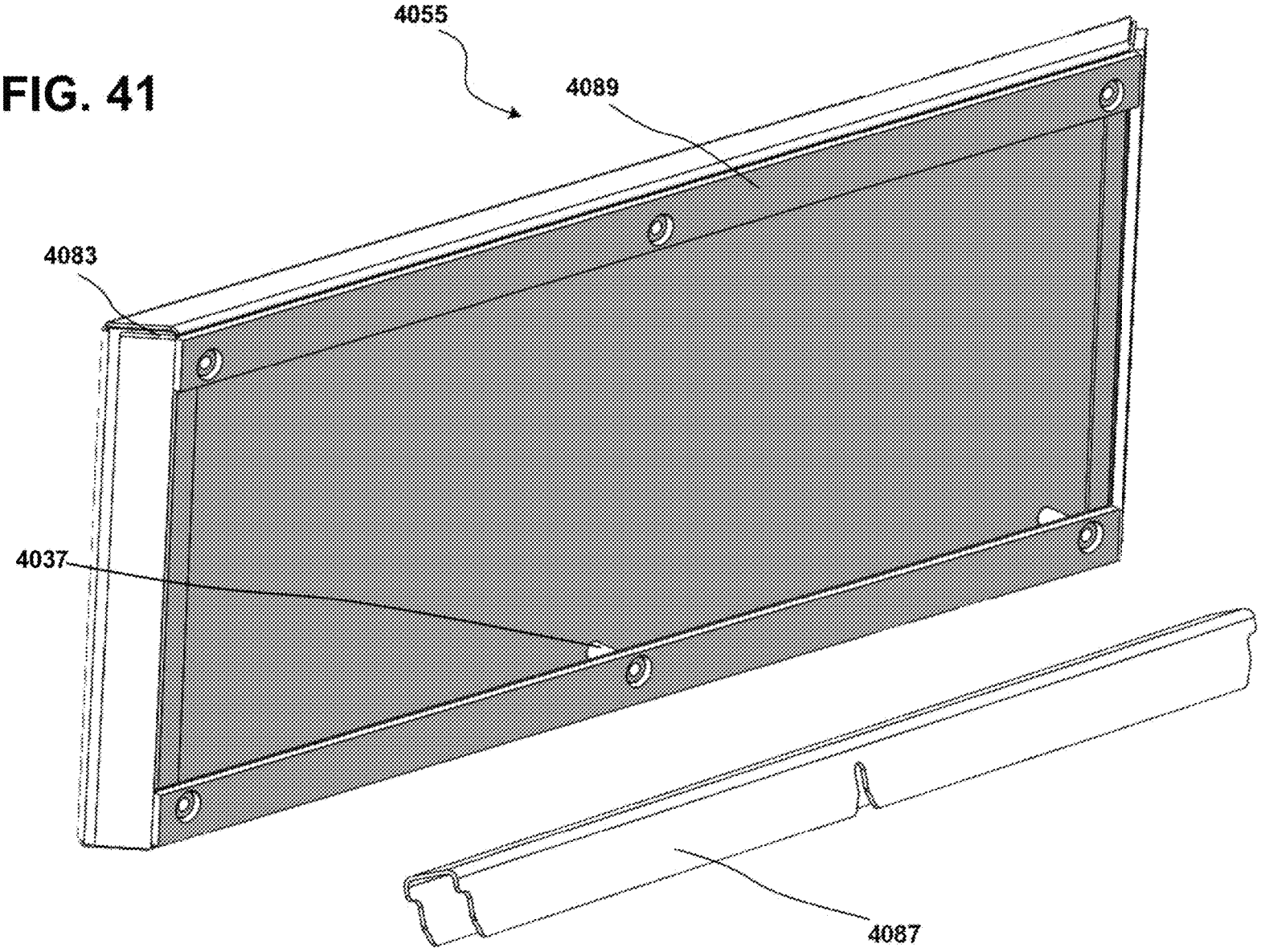
FIG. 41 is a perspective view of another arrangement for a left front cover of the platform, which schematically represents another arrangement for multiple side covers of the platform that can be combined with reverse C-channel reinforcements.

Referring now to FIG. 41 another arrangement for a left front cover 4055 is shown for use with platforms described herein, which schematically represents another arrangement use with all or some of the side covers of the platform. As shown and described in greater detail above, left front cover 4055 can optionally be combined with reverse C-channel reinforcements disposed along top and bottom portions of each cover and generally includes aspects, features and preferences of side covers discussed previously herein except as described.

In particular, left front cover 4055 differs via the addition of reinforcing collars 4037 extending through the C-channels 4083 for each attachment hole defined through the cover. Collars 4037 may be pressed, welded, screwed, or otherwise connected to the left front cover 4055. Collars 4037 may offer some additional distinct advantages over designs without the collars. For example collars 4037 may include a collar lip 4037A with a thickness of, for example 0.125" which allows for easy pressing into the left front cover 4055, Beyond providing a locating point for easy assembly, the collar lip 4037A may also provide a mechanical limit such that when left front cover 4055 is screwed into the top or bottom cover, the left front cover is pull tight against the top and bottom cover to the point when the collar lip 4037A is in compression and in connection with the surface of the top and bottom cover.

In this position, further tightening of the screw does not move the left front cover 4055 closer to the top or bottom cover because of that interference. As such, the gasket 4089 cannot be further compressed beyond that point leaving a minimum gasket thickness equal to approximately the thickness of the collar lip 4037A. As gaskets have a compression limit by design, this can prevent over compression of the gasket 4089 and extend the life of the gasket. An additional benefit of the collar lip 4037A, is that it may have an unpainted raw metal surface 4037B, which may mate with a masked or unpainted surface of the top and bottom cover such that when the left front cover 4055 is installed, these two raw metal surfaces come into contact and form a grounding connection, thus grounding left front cover 4055. The raw metal surface 4037B therefore may help ground the paneling which helps with EMI front electronics enclosed inside, as well as prevent against electrical shock hazards. Finally collar 4037 may prevent dimpling on the outer surface via overtightening of the fasteners that connect the left front cover 4055 to the top and bottom cover. Absent the collar 4037, severe tightening of the fastener can compress the reverse C-channels, 4087, thus drawing the outer surface of left front cover 4055 closer to the top and bottom cover edges in the region of the fastener and cause a localized visual dimple. It is important to note that reverse C-channel 4087 may be added and included for strength, but is optional and the benefits of collar 4037 with collar lip 4037A and raw metal surface 4037B endure even without reverse C-channel, and therefore reverse C-channel may in fact be omitted with inclusion of collars thereby reducing cost, weight, and manufacturing complexity.

Platform with Hybrid Transverse Framework Used with Enclosure & DAP System

Figure 42:
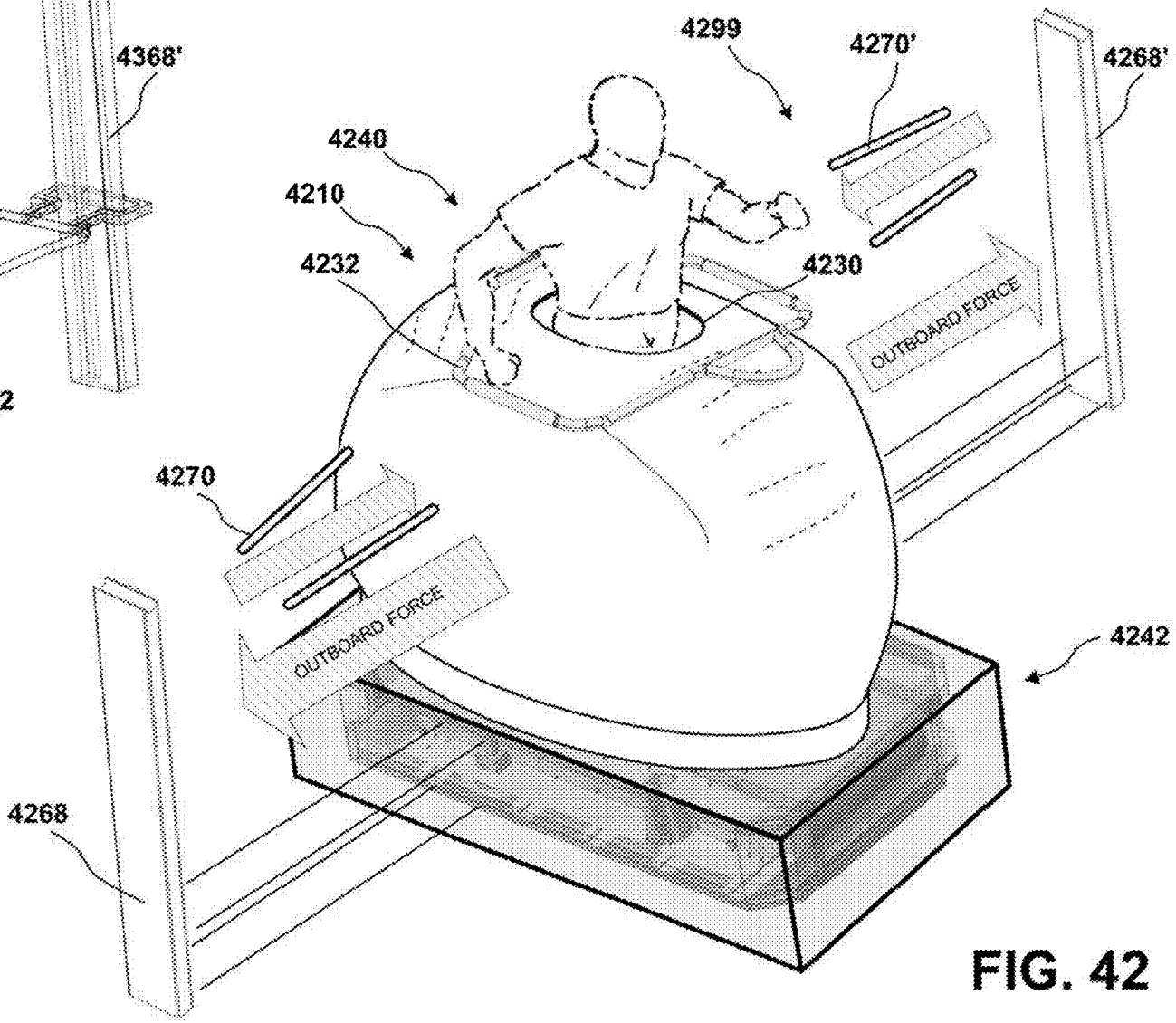
FIG. 42 is a front right perspective view of a platform in use with an inflatable enclosure and an exercise device, in which the platform includes a pair of lifts attached to each other in a transverse direction across the DAP System via tensile restraints and a bridge member that form a hybrid transverse framework according to inventive aspects, features and concepts described herein, which depicts forces and outboard forces and moments applied to the platform along with counteracting forces and moments applied by the hybrid transverse framework.

Referring now to FIG. 42 along with FIGS. 22-25 pertaining to secure connections with a treadmill frame, an example platform 4242 is shown in use with a DAP system 4240 including inflatable enclosure 4210, which generally includes the same aspects and features described above for platforms, inflatable enclosures described above including platform 2042, DAP system 2040, and inflatable enclosure 2010, excepts as described hereafter. Accordingly, like numbers refer to like features. As shown, platform 4242 includes a pair of opposing lifts 4268 and 4268' integrated into platform 4242 and securely connected to each of the top cover and the bottom cover along a midregion of the platform, which can be disposed proximate the top opening 4230 of the inflatable enclosure, as well as disposed fore or of the top opening.

In some arrangements, an additional pair of lifts can be included and attached or integrated within the platform either fore or aft of the top opening along with a first pair attached or integrated within the platform fore or aft of the top opening at an opposite side of the top opening. Opposing pairs of flexible tensile restraints 4270 and 4270' can securely connect between a corresponding connector at a vertically drivable carriage (not shown) attached to each lift and a corresponding connector or set of connectors formed at opposite lateral end regions of a bridge member 4232. In an alternative arrangement (not shown), the pair or pairs of vertical lifts can have a connector at a fixed height or a plurality of connectors at different fixed heights, and the flexible restraints can be attached to corresponding fixed height connectors. In yet other arrangements (not shown), one or more flexible restraints can connect opposing lifts without including a bridge member. In an additional arrangement (not shown), the pair of lifts attached or integrated into the platform can be formed as a pair of opposing supports for a handrail, monitor support or other fixed features, and the pair of fixed height lifts can be rigidly connected to each other via a rigid member.

With continued reference to FIG. 25, the bridge member 4232 can include a seal frame constructed as described above and/or any of the seal frames described in applications identified herein at the beginning and incorporated by reference, which can be attached to a top portion of the inflatable enclosure about the top opening 4230. However, the bridge member 4232 can also be arranged in an independent arrangement, such that the bridge member is not attached to a top portion of the enclosure, and can be used with or without a seal frame attached about the top opening 4230. In an independent arrangement, the seal frame or bridge member 4232 can be arranged to provide height adjustment features including limited height adjustment features, such via contact with the upper portion of the enclosure proximate and about the top opening 4230 as desired and/or for a range of height adjustments, such as along an upper region of the lifts extended heights.

The bridge member 4232 can include a substantially rigid structure configured for restraining a transverse distance between the lifts along a mid to upper region of the lifts at a predetermined transverse distance or at a predetermined range of transverse distances depending on factors such as enclosure pressure when inflated and relatively small amounts of flexibility for the bridge member 4232 and/or tensile restraints 4170, 4270'. The bridge member can extend across the user in front and in back of the user during use. However, other bridge member arrangements can be used, such as a substantially rigid bridge member arranged to extend transversely across the DAP system only in front of or in back of the user as described above for alternative arrangements.

As indicated in FIG. 42, the transverse bridge member 4232 along with the flexible restraints can restrict the pair of lifts from flexing outboard or outward away from the inflatable enclosure while in the inflated state and thereby opposing torque applied to the platform 4242 by the enclosure secure attachment to the platform. The pair of lifts 4268, 4268' in combination with the flexible tensile restraints 4270,4270' and the bridge member 4232 can form a hybrid transverse framework 4299, which an operate as an on-demand, as-needed or optional framework that moves to functional positions and only functions during use of the DAP system 4240.

As shown and described in greater detail along with FIGS. 22-25, parallel, longitudinal portions of the platform top cover or secure surface can be secured proximate opposite longitudinal portions of the truncated access opening to a parallel and corresponding pair of frame structures of a treadmill exercise device retained within the platform 4242. Such a reinforced, secure attachment with the treadmill frame can reinforce the platform and significantly assist with opposing torque or moment applied to the platform in substantially longitudinal directions of the DAP system, but can provide only limited support for opposing torque or moment applied to the platform in substantially transverse directions of the DAP system. As such, the hybrid transverse framework 4299 can operate for opposing outboard torque exerted on the platform when in the inflated condition. Further, as described herein and in related applications listed herein at the beginning and incorporated by reference, the hybrid transverse framework 4299 can be integrated with an adjustable seal frame structure for providing highly beneficial height adjustment features concurrent with hybrid transverse framework features.

Figure 43:
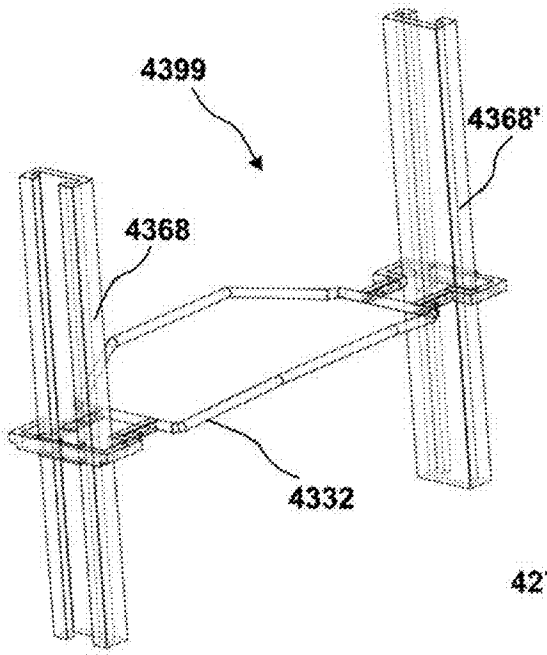
FIG. 43 is a schematic front right perspective view of another example arrangement for a hybrid transverse framework that can be used with components of the DAP System shown in FIG. 42 according to inventive aspects, features and concepts described herein.

Referring now to FIG. 43, an alternative arrangement for a hybrid transverse framework 4399 is generally shown that can be integrated in platform 4242 described above and used with example DAP system 4240 and inflatable enclosure 4210 described along with FIG. 42, which generally includes the same aspects and features described above for platforms, inflatable enclosures described above including platform 4242, DAP system 4240, and inflatable enclosure 4210, except as described hereafter. Accordingly, like numbers refer to like features. Hybrid transverse framework 4399 includes an alternative arrangement for lifts 4368 and 4368', which include vertically drivable carriages arranged for rigidly connecting with a substantially rigid bridge member 4332 without including flexible tensile restraints.

Figure 45:
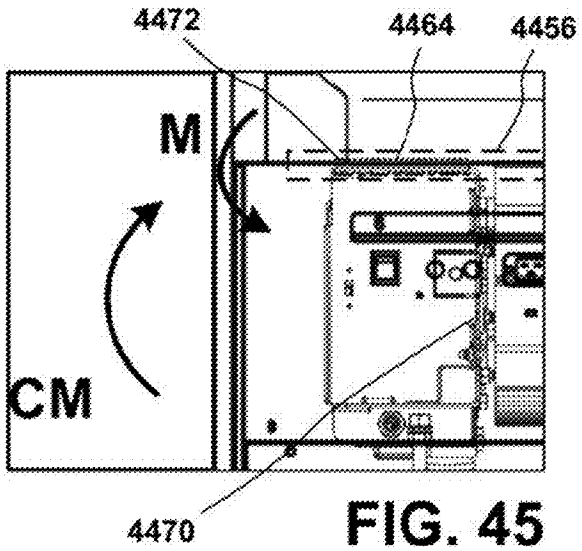
FIG. 45 is a close view of a portion of FIG. 44 as indicated in FIG. 44.
Figure 44:
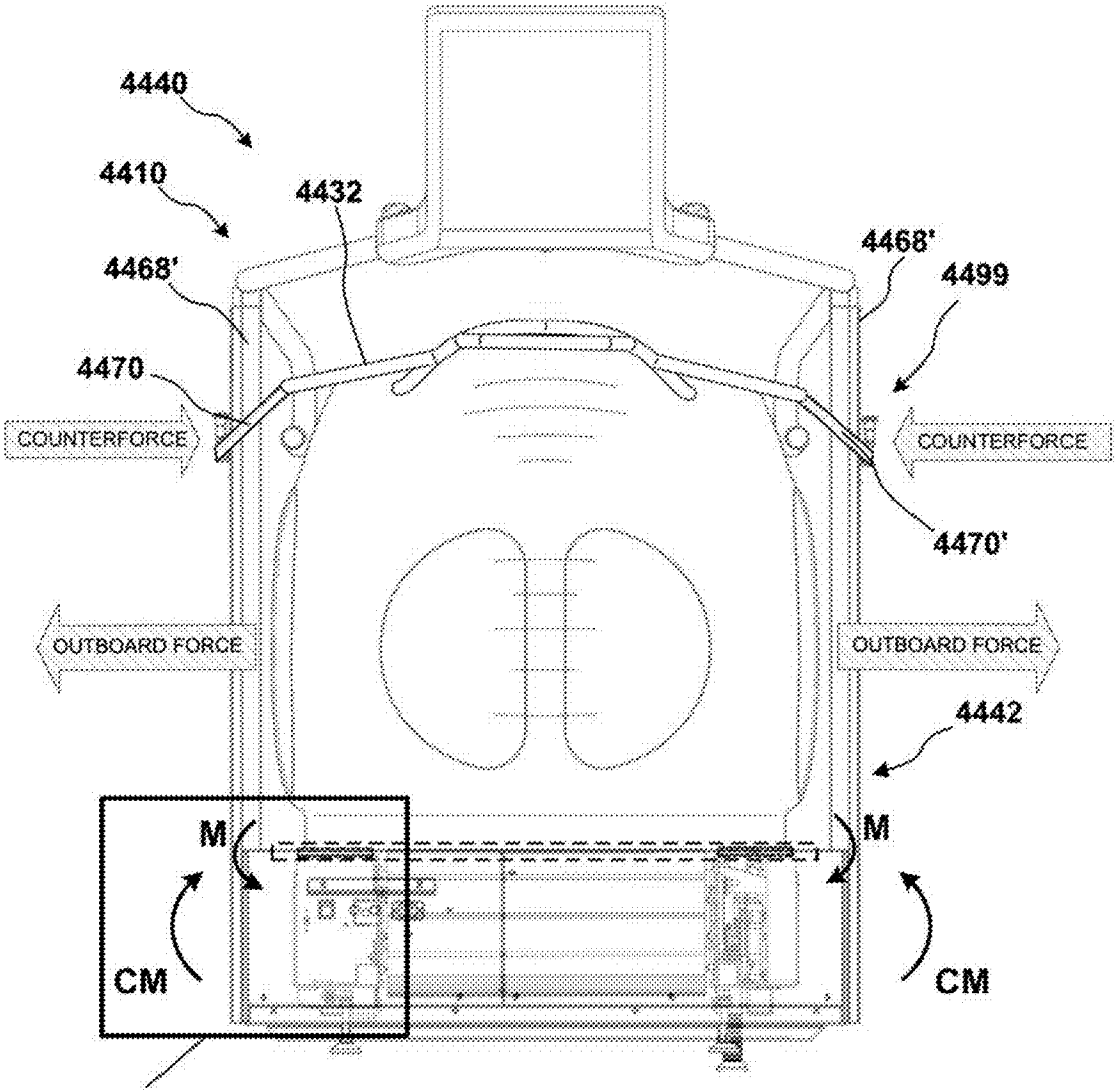
FIG. 44 is a schematic front view of yet another example arrangement for a hybrid transverse framework that can be used with components of the DAP System shown in FIG. 42 according to inventive aspects, features and concepts described herein.

Referring now to FIGS. 44 and 45, an additional arrangement for a hybrid transverse framework 4499 is generally shown for a platform 4442 and used with example DAP system 4440 and inflatable enclosure 4410, which generally includes the same aspects and features described above for platforms, inflatable enclosures described above including for platforms 2042 & 4042, DAP system 2040 & 4240, and inflatable enclosure 2010 & 4210, except as described hereafter. Accordingly, like numbers refer to like features.

FIG. 44 generally shows a hybrid transverse framework 4399 in a corresponding arrangement as shown in FIG. 44 except for having a different construction for the seal frame 4432, but shown without exploded components and in a front view. FIG. 44 depicts outboard transverse forces and corresponding transverse torques or moments along with counterforces exerted via the transverse hybrid framework 4399 and corresponding counter-torques or counter-moments in an inward rotation direction at the platform. FIG. 45 is a close view of a portion of FIG. 45 showing applied moments and counter-moments, as well as secure attachment regions between a treadmill frame structure and portions of the top cover or structural support of the platform.

As can be seen from the front view of FIG. 44, innovative aspects and features described herein for secure support connections between inward portions of the platform top cover proximate the perimeter region of the truncated access opening can significantly enhance secure support for the enclosure when in the inflated condition, and can particularly do so in a longitudinal direction of the DAP system. Innovative aspects and features described herein and in related applications identified herein at the beginning that pertain to truncated access openings and low-hoop stress inflatable enclosures can reduce upward forces overall applied to the platform by the enclosure when inflated along with transverse moments applied to the platform. Innovative aspects and features described herein pertaining to the platform can resist the applied counter-torques on the platform in addition to structural benefits gained from secure connections with the treadmill frame. Further, innovative aspects and features pertaining to lifts integrated with the platform and hybrid transverse framework features can further resist applied forces and torques including transverse torques along with providing a robust, secure foundation for a DAP system along with enhanced functionality pertaining to high adjustment features.

The subject matter described above is provided by way of illustration only and should not be construed as limiting. Various modifications and changes may be made to the subject matter described herein without following the example embodiments and applications illustrated and described, and without departing from the true spirit and scope of the embodiments of the concepts and technologies disclosed herein.

Although various embodiments have been described as having particular features and/or combinations of components, other embodiments are possible having a combination of any features and/or components from any of embodiments as discussed above. Aspects have been described in the general context of exercise devices, and more specifically supplemental lifting, unweighting or differential air pressures mechanisms, devices, systems, and methods for exercise devices, but inventive aspects are not necessarily limited to use with exercise devices.

We claim:

1. A support platform configured for use with a differential air pressure (DAP) system for retaining an inflatable enclosure thereof over an exercise device during use, the platform comprising:

a top cover comprising a support surface, the top cover having a maximum length and maximum width;

a truncated access opening defined through an inner portion of the support surface, the support surface configured for secure attachment to an upper portion of the exercise device proximate a perimeter region of the access opening, wherein a perimeter length of the truncated opening is less than two times the maximum length plus two times the maximum width;

a bottom cover comprising a panel;

a plurality of side covers each comprising a panel, the top cover, the bottom cover and the plurality of side covers connected to each other to form a substantially airtight platform defining an interior cavity for retaining therein the exercise device; and a blower interface configured for forming an operative, airtight connection with a blower.

2. The support platform of claim 1, wherein:

the support surface of the top cover comprises a plurality of reinforced side regions, each reinforced side region forming an integrated beam;

the panel of the bottom cover comprises a plurality of reinforced side regions, each reinforced side region forming an integrated beam; and each panel of the plurality of side covers comprises:

an upper reinforced side region forming an integrated beam, an attachment face of the integrated beam secured to an adjacent top cover attachment face along at least a portion of one of the reinforced side regions of the top cover support surface;

a lower reinforced side region forming an integrated beam, an attachment face of the integrated beam secured to an adjacent bottom cover attachment face along at least a portion of one of the reinforced side regions of the bottom cover;

a first lateral side region; and a second lateral side region opposite the first lateral side region;

the platform further comprising:

a plurality of brackets disposed along a perimeter region of each of the top cover and the bottom cover and forming at least one integrated column supporting the top cover at a vertical offset above the bottom cover, each bracket secured at a lower end region to the bottom cover along at least a portion of one of the plurality of bottom cover reinforced side regions, and secured to the top cover at an upper region opposite the lower region along at least a portion of one the plurality of top cover support surface reinforced side regions; and an exercise device lower interface configured for securing a lower region of the exercise device to the bottom cover;

wherein the top, bottom and side covers and the plurality of brackets form a substantially frameless, airtight platform cavity.

3. The support platform of claim 2, further comprising:

a damping gap defined between mating pairs of the attachment faces; and a gasket formed from a flat, compressible material disposed between each mated pair of the attachment faces.

4. The support platform of claim 3, further comprising a plurality of fastener-collar sets securing each mated pair of the attachment faces and fixing a minimum compressible distance between the attachment faces.

5. The support platform of claim 2, further comprising:

a plurality of substantially hollow crossbeams attached to and extending across a width of the bottom cover.

6. The support platform of claim 2, wherein the plurality of brackets comprise a plurality of corner brackets, each corner bracket disposed proximate a corner formed between intersecting edge portions of each of the top cover and the bottom cover.

7. The support platform of claim 6, further comprising:

a pair of mated angled surfaces formed along mating vertical edge portions of each pair of side covers meeting at each corner, the mated angled surfaces being spaced apart from each other without direct contact between the mating vertical edge portions.

8. The support platform of claim 2, wherein:

the plurality of brackets comprise a pair of vertical lift brackets attached to opposite lengthwise side portions of the platform and to each of the top cover and the bottom cover at a middle portion of an opposite lengthwise pair of each of the plurality of reinforced side regions; and the pair of vertical lift brackets are attached to an adjacent reinforced side region of each of the top and bottom covers and to a first or second lateral side region of adjacent ones of the side covers.

9. The support platform of claim 8, wherein each vertical lift bracket is formed from a thin sheet and comprises:

a pair of vertically oriented, parallel angle supports spaced apart from each other and opposing each other, the pair of angle supports arranged for reinforcing a corresponding vertical lift attached to each one of the vertical lift brackets in a vertical orientation; and a bottom flange formed from the thin sheet configured to attach to a bottom of a corresponding one of the vertical lifts.

10. The support platform of claim 9, further comprising:

a pair of vertical pillars integrated with the platform, each vertical pillar attached to a corresponding one of the vertical lift brackets for providing a support structure for the corresponding vertical lift, each vertical pillar comprising an extruded pillar having a pair of outboard columns extending along a height of each pillar, each outboard column attached to the corresponding vertical lift bracket.

11. The support platform of claim 2, wherein:

for at least one of the top cover, the bottom cover, and the plurality of side covers, at least one integrated beam of the plurality of reinforced side regions comprises:

a C-channel formed within the corresponding panel along at least one reinforced side region;

a C-channel formed within the corresponding panel along at least one reinforced side region mated with a reinforcing member configured as an opposing C-channel;

a multi-faceted, substantially hollow structure formed along at least one reinforced side region defining a closed shape; and a columnar reinforcement defined along at least one edge portion of an extruded panel.

12. The support platform of claim 2, wherein:

each of the side covers are configured for independent removal from and attachment to the platform; and the interior cavity and the exercise device configured to be retained therein are accessible through an exposed opening corresponding with removal each side cover.

13. The support platform of claim 2, wherein:

each of the plurality of side covers are attached to the top cover in one of a stacked beam arrangement and a parallel beam arrangement;

for the stacked beam arrangement, the attachment face of the upper reinforced side region and the adjacent attachment face secured thereto of the top cover are oriented substantially parallel with a top surface region of the top cover, each attachment face offset and vertically lower than the top surface region, the integrated beam of the upper reinforced side region located under the attached, adjacent integrated beam of the top cover; and for the parallel beam arrangement, the attachment face of the upper reinforced side region and the adjacent attachment face secured thereto of the top cover are oriented substantially perpendicular with a top surface region of the top cover, the integrated beam of the upper reinforced side region located alongside the attached, adjacent integrated beam of the top cover.

14. The support platform of claim 1, wherein:

the exercise device comprises a pair of frame structures comprising a left frame structure and a right frame structure;

the exercise device upper interface comprises:

a plurality of left fasteners and a plurality of right fasteners, each of the left fasteners configured to secure an upper region of the left frame structure to the support surface along a left portion of the access opening perimeter region, each of the right fasteners configured to secure an upper region of the right frame structure to the support surface along a right portion of the access opening perimeter region;

the exercise device lower interface comprises:

a plurality of left bottom connectors and a plurality of right bottom connectors, each of the left bottom connectors configured to connect a lower region of the left frame structure to one of the bottom cover and the ground, each of the right bottom connectors configured to connect a lower region of the right frame structure to one of the bottom cover and the ground; and a plurality of ground supports each configured to extend from the bottom cover to the ground in alignment with a corresponding one of the left bottom connectors and the right bottom connectors connecting to the bottom cover for extending support for the left and right frame structures through the bottom cover and directly to the ground.

15. The support platform of claim 14, further comprising:

a plurality of pass-through openings defined through the bottom cover each arranged for passing one of the left and right bottom connectors not connected to the bottom cover through the bottom cover directly to the ground and thereby enabling optional height adjustments for the exercise device with respect to the ground and the platform.

16. The support platform of claim 14, wherein:

the exercise device comprises a treadmill;

the left frame structure and the right frame structure each extend parallel to each other in a longitudinal direction of the treadmill along opposite lateral regions of the treadmill; and the left and right frame structures secure corresponding left and right portions of the perimeter region along the truncated access opening during use by exerting, proximate the perimeter region, reaction forces substantially equal in magnitude and opposite in direction to upward forces transmitted by a base of the enclosure to the support surface of the top cover.

17. The support platform of claim 16, wherein:

the upper region of each of the left frame structure and the right frame structure form a left upper flange and a right upper flange respectively, each of the left and right upper flanges having a top, substantially horizontal, flange surface;

the lower region of each of the left frame structure and the right frame structure form a left lower flange and a right lower flange respectively;

a left wall connects the left upper flange to the left lower flange defining a left channel-shaped frame structure;

a right wall connects the right upper flange to the right lower flange defining a right channel-shaped frame structure;

the pair of left and right channel-shaped frame structures form a pair of parallel, channel-shaped frame structures, each having a top, substantially horizontal, flange surface substantially coplanar with each other;

the set of upper flanges of the pair of channel-shaped frame structures together form a parallel, longitudinally oriented pair of support tracks for the treadmill disposed proximate and below the top cover support surface and extending lengthwise along opposite, left and right portions of the perimeter region of the truncated access opening; and the pair of support tracks are secured at multiple locations to the top cover support surface along the opposite left and right portions of the perimeter region of the truncated access opening.

18. The support platform of claim 17, further comprising:

a left lift attached to a left side of the platform along a longitudinal midregion of the platform, the left lift securely attached to a left side region of the top cover and to a left side region of the bottom cover at a bottom region of the lift, the lift extending vertically upward from the bottom region;

a right lift attached to a right side of the platform along a longitudinal midregion of the platform, the right lift securely attached to a right side region of the top cover and to a right side region of the bottom cover at a bottom region of the lift, the lift extending vertically upward from the bottom region; and a transverse bridge member extending horizontally between a vertically movable carriage attached to the left lift and a vertically movable carriage attached to the right lift, the transverse bridge member restraining each carriage at a horizontal, transverse distance across a depth of the DAP system at a range of vertical heights of the carriages;

wherein the pair of lifts having vertically movable carriages and the transverse bridge member form a hybrid transverse framework across the DAP system configured for opposing at the bottom region of each lift and the opposite side regions of the platform outward torques exerted on the platform by the base of the enclosure during use of the DAP system.

19. A differential air pressure (DAP) system comprising:

an exercise device, the exercise device comprising a treadmill having a pair of frame structures extending in a longitudinal direction of the treadmill along opposite lateral regions;

an inflatable enclosure having a base defining a base opening, the enclosure extending upward from the base to a top opening defined therein; and the support platform according to claim 1, the enclosure base opening secured to the top side of the top cover proximate the access opening, the treadmill retained within the platform, the treadmill pair of frame structures secured to and integrated with the platform inner frame structure such that each frame structure of the pair of frame structures is secured to the top cover proximate the truncated access opening perimeter and to the lower cover as part of the inner frame structure;

wherein;

the platform exerts reaction forces and torques substantially equal in magnitude and in opposite directions to upward forces transmitted by the enclosure base and torques imparted by the upward forces during use of the DAP system; and the treadmill pair of frame supports integrated with the platform inner frame structure substantially receives and counteracts the platform rotational torques imparted by the upward forces in a generally longitudinal direction of the DAP system.

20. The DAP system of claim 19, further comprising a hybrid framework configured for substantially counteracting the platform rotational torques imparted by the upward forces in a generally transverse direction of the DAP system, the hybrid framework comprising:

a pair of vertical lifts integrally attached to opposite sides of the platform along a mid-region of the platform in the longitudinal direction of the DAP system disposed proximate the enclosure top opening, each vertical lift structurally attached at a base portion to one of the plurality of reinforced side regions of the top cover and to one of the plurality of reinforced side regions of the bottom cover, each vertical lift having a vertically drivable carriage attached thereto;

a bridge member having a pair of lateral connectors, each lateral connector disposed at an opposite lateral side region of the bridge member and secured to a carriage of a corresponding one of the vertical lifts, the bridge member restraining each carriage of the pair of lifts at a transverse distance between the carriages along a range of vertical heights for each carriage located at a raised end portion of each lift opposite the base portion; and a DAP system controller operatively connected to the pair of lifts configured for vertically driving each carriage to a vertical height within the range of vertical heights for DAP system operations in which the inflated enclosure is in an inflated condition;

wherein:

the bridge member restrains the pair of vertical lifts at a transverse distance therebetween along the raised end portion of each lift when the enclosure is in the inflated condition; and the restrained pair of vertical lifts substantially counteract the platform rotational torques imparted by the upward forces in the generally transverse direction of the DAP system.

21. The support platform of claim 1, wherein the truncated access opening has an access length less than the maximum length and an access width less than the maximum width.

* * * * *